US009052649B2

(12) United States Patent
Iio et al.

(10) Patent No.: US 9,052,649 B2
(45) Date of Patent: Jun. 9, 2015

(54) APPARATUS FOR PRODUCING DETACHABLE INFORMATION SHEET AND METHOD OF PRODUCING DETACHABLE INFORMATION SHEET

(71) Applicants: Masato Iio, Kanagawa (JP); Toshiyuki Kabata, Kanagawa (JP)

(72) Inventors: Masato Iio, Kanagawa (JP); Toshiyuki Kabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/191,822

(22) Filed: Feb. 27, 2014

(65) Prior Publication Data

US 2014/0255069 A1 Sep. 11, 2014

(30) Foreign Application Priority Data

| | | |
|---|---|---|
| Mar. 8, 2013 | (JP) | 2013-046804 |
| Mar. 29, 2013 | (JP) | 2013-072360 |
| Jun. 7, 2013 | (JP) | 2013-121025 |
| Jul. 29, 2013 | (JP) | 2013-156966 |

(51) Int. Cl.

| | |
|---|---|
| ***G03G 15/20*** | (2006.01) |
| ***G03G 13/20*** | (2006.01) |
| ***G03G 15/00*** | (2006.01) |

(52) U.S. Cl.

CPC ..... *G03G 15/20* (2013.01); *G03G 13/20* (2013.01); *G03G 15/6585* (2013.01)

(58) Field of Classification Search

USPC ..... 399/122, 320, 328–330, 341; 428/195.1

See application file for complete search history.

(56) References Cited

U.S. PATENT DOCUMENTS

| | | | | |
|---|---|---|---|---|
| 8,838,004 | B2 * | 9/2014 | Shimao et al. | 399/341 |
| 2005/0169680 | A1 * | 8/2005 | Ng et al. | 399/341 |
| 2006/0269323 | A1 | 11/2006 | Kabata et al. | |
| 2009/0028618 | A1 | 1/2009 | Kabata et al. | |
| 2010/0285281 | A1 * | 11/2010 | Mashtare et al. | 428/195.1 |
| 2011/0223527 | A1 | 9/2011 | Iio et al. | |
| 2012/0082829 | A1 | 4/2012 | Iio et al. | |
| 2012/0243890 | A1 | 9/2012 | Iio et al. | |
| 2014/0011949 | A1 | 1/2014 | Asami et al. | |

FOREIGN PATENT DOCUMENTS

| | | |
|---|---|---|
| JP | 52-036016 | 3/1977 |
| JP | 1-163747 | 6/1989 |
| JP | 9-143442 | 6/1997 |
| JP | 10-309876 | 11/1998 |
| JP | 11-349854 | 12/1999 |
| JP | 2004-231890 | 8/2004 |
| JP | 2007-277547 | 10/2007 |
| JP | 2009-169337 | 7/2009 |

* cited by examiner

*Primary Examiner* — Hoan Tran

(74) *Attorney, Agent, or Firm* — Oblon, McClelland, Maier & Neustadt, L.L.P.

(57) ABSTRACT

An apparatus for producing a detachable information sheet includes an image forming device, an applying and curing unit, and a heating and pressing unit. The image forming device includes an image bearing body, an electrostatic latent image forming unit to form an electrostatic latent image on the image bearing body, a development unit to develop the latent image with a toner to form a visible toner image, a transfer unit to transfer the toner image from the image bearing body onto a recording medium, and a fixing unit to fix the toner image on the recording medium. The applying and curing unit applies an energy-ray curable composition precursor onto the recording medium having the toner image fixed thereon, and cures the precursor to form an energy-ray curable composition to coat the recording medium. The heating and pressing unit heats and presses the recording medium coated with the energy-ray curable composition.

20 Claims, 14 Drawing Sheets

APPARATUS FOR PRODUCING DETACHABLE INFORMATION SHEET AND METHOD OF PRODUCING DETACHABLE INFORMATION SHEET

CROSS-REFERENCE TO RELATED APPLICATIONS

This patent application is based on and claims priority pursuant to 35 U.S.C. §119 to Japanese Patent Application Nos. 2013-046804, filed on Mar. 8, 2013, 2013-072360, filed on Mar. 29, 2013, 2013-121025 filed on Jun. 7, 2013, and 2013-156966, filed on Jul. 29, 2013, in the Japan Patent Office, the entire disclosure of each of which is hereby incorporated by reference herein.

BACKGROUND

1. Technical Field

Embodiments of the present invention relate to an apparatus for producing a detachable information sheet that includes an electrophotographic image forming apparatus, and a method for producing a detachable information sheet.

2. Related Art

Catalogs, covers, DM postcards, etc. conventionally with images and texts formed by printing have been used for predetermined purposes.

For these use applications, the printing surfaces may be protected with surface treatment or film in some cases in order to protect from water leakage and contamination or provide gloss.

Examples of the surface treatment include overprint, vinyl coating, and press coat, which need to be applied after printing. Recently, treatment with ultraviolet curable compositions has become mainstream in terms of cost and environmental consciousness.

In addition, for DM postcards, etc., an approach is used in such a way that print sides with information input are subjected to pressure bonding to conceal the information, which are detachable when needed. While latex rubbers, ultraviolet curable pressure-sensitive compositions, and the like are used for the adhesive, the ultraviolet curable pressure-sensitive compositions have become mainstream as in the case of surface treatment.

In addition, recently, information has been frequently modified, and accordingly there are increasing number of systems that are able to output variable information such as information modified for each copy, acceleration of printout has been desired, and on-demand printing has been used as a printing method which is suitable for the acceleration.

Machines for use in on-demand printing typically include electrophotographic machines and ink-jet machines, and the electrophotographic methods using toners have become mainstream for output including images.

The colors of images recorded by the electrophotographic methods are reproduced by fixing powdery color materials referred to as toners onto recording media with heat, pressure, etc.

In addition, as for the ultraviolet curable compositions, some commercially available ultraviolet curable compositions are commonly used for offset printing. However, the use of the commercially available ultraviolet curable compositions for images recorded by the electrophotographic methods may result in a failure to obtain satisfactory results, because of incompatibility between toners and the ultraviolet curable compositions. In general, toners are composed of resins, colorants such as pigments, additives such as silica, waxes, etc., and some of fixed toners have colorants, additives, etc. present as powders or incompletely dissolved, and thus have a certain number of gaps generated. It is often the case that the ultraviolet curable compositions permeate the gaps, which exhibits incompatibility therebetween.

The varnish composition and preparation method therefor disclosed in JP-2007-277547-A improve the compatibility by fixing oil applied on the prints, through a water-based film-forming agent containing no ammonia and having a low static surface tension. In addition, the resin forming apparatus and an apparatus including the resin forming apparatus, which are disclosed in JP-3570853-B (JP-H10-309876-A), form a silicon resin layer on print sides to provide protection for the print surfaces, waterproof treatment, gloss, etc. In addition, for a metal container with a printed surface and a method for printing on the metal container as disclosed in JP-2522333-B (JP-H01-163747-A), a wide variety of prints in small quantities can be efficiently achieved through the use of an electrophotographic method, and toner layers can be protected and provided with gloss by processing with an ultraviolet curable composition.

In addition, JP-3827124-B (JP-H11-349854-A) discloses a detachable ultraviolet curable pressure-sensitive composition for use in DM postcards, etc. In addition, JP-4471334-B (JP-2004-231890-A) discloses an ultraviolet curable pressure-sensitive adhesive composition matched with liquid toners.

In particular, for the ultraviolet curable composition disclosed in JP-3827124-B (JP-H11-349854-A), the presence of a (meth)acrylic copolymer (B) is critically important, which has an average molecular weight of 10000 to 100000, and a glass transition temperature of −35.2° C. to 20° C.

The (meth)acrylic copolymer (B) is a straight-chain polymer, which has pressure-sensitive adhesiveness. On the other hand, an ultraviolet curing component (a) basically has no pressure-sensitive adhesiveness, even when the component (a) is cured with ultraviolet light. The ultraviolet curing substance in the ultraviolet curing component (a) is hard, and present to surround the (meth)acrylic copolymer (B), which serves to prevent tackiness at the surface of the (meth)acrylic copolymer (B) before pressure bonding and after detachment, and keep the copolymer (B) from being pressure-bonded again at pressures applied by people in normal life.

When extremely strong pressure is applied to the substance (pressure bonding is carried out), the (meth)acrylic copolymer (B) is attached to the copolymer (B) to develop adhesiveness. However, the bond between the (meth)acrylic copolymers (B) moves the ultraviolet curing substance in the ultraviolet curing component (a), and the copolymers (B) are thus bonded with stress left by the resilience of the ultraviolet curing substance in the ultraviolet curing component (a). Therefore, peeling with a strong force can achieve clear detachment.

However, even with these techniques, the combination of dry toner with the ultraviolet curable composition may result in peeling of toner images in some cases due to poor matching between the toner images and the ultraviolet curable composition, even when the ultraviolet curable composition can be applied. More specifically, when toner images are subjected to pressure bonding with the ultraviolet curable composition disclosed in JP-3827124-B (JP-H11-349854-A), a lack of peeling strength may result in a failure to withstand vibrations at the time of transportation, or conversely, excessively high peeling strength may result in peeling of one image when detachment is carried out. In addition, even if there is no problem immediately after the pressure bonding, the bonding strength may lack or be conversely increased during storage, and for toner images, the composition is not developed to a practical level at all.

In addition, ultraviolet curable pressure-sensitive compositions for use as detachable adhesive agents for use in DM postcards, etc. also have poor matching with dry toner images, and the toner images may be peeled at the time of detachment.

As just described, in the related art described above, the combination of toner with the ultraviolet curable composition or the ultraviolet curable pressure-sensitive composition results in poor matching, thereby failing to achieve protection, provide gloss, or achieve detachable pressure bonding by applying and curing the ultraviolet curable composition or the ultraviolet curable pressure-sensitive composition on toner images.

Conventionally, for electrophotographic images, silicon oil is used as a fixation peeling agent, and the use of images formed with the use of silicon oil somewhat reduces peeling of the images in detachment (for example, see JP-2009-169337-A). However, the reduction has not been developed to a level for use as direct mail.

In addition, recently, in order to prevent offices from being contaminated by silicon oil and prevent image quality from being degraded due to a shortage of silicon oil, so-called oilless toners containing therein wax have been commonly used. Furthermore, on the request of energy conservation, so-called low-temperature fixing toners have been used in which resins are used for low toner softening temperatures.

However, when energy-ray curable precursors are to be provided on toner images subjected to such oilless fixing, there is a problem that the following defects are caused.

Defect (1) the wax on the toner image surface repels the energy-ray curable precursor to reduce the thickness of the energy-ray curable precursor layer in a large image area, and the precursor directly serves as an energy-ray curable pressure-sensitive adhesive, thus partially failing to be pressure-bonded, and resulting in peeling of the information sheet depending on vibrations and handling at the time of transportation.

Defect (2) with the poor bondability between the cured energy-ray curable pressure-sensitive adhesive and the toner image subjected to oilless fixing, the detachment causes the energy-ray curable pressure-sensitive adhesive to be partially peeled from one side, resulting in an unsightly image with image quality significantly decreased.

BRIEF SUMMARY

In at least one exemplary embodiment of this disclosure, there is provided an apparatus for producing a detachable information sheet. The apparatus includes an image forming device, an applying and curing unit, and a heating and pressing unit. The image forming device includes an image bearing body, an electrostatic latent image forming unit to form an electrostatic latent image on the image bearing body, a development unit to develop the electrostatic latent image with a toner to form a visible toner image, a transfer unit to transfer the toner image from the image bearing body onto a recording medium, and a fixing unit to fix, on the recording medium, the toner image transferred onto the recording medium. The applying and curing unit applies an energy-ray curable composition precursor onto the recording medium having the toner image fixed thereon, and cures the energy-ray curable composition precursor to form an energy-ray curable composition to coat the recording medium. The heating and pressing unit heats and presses the recording medium coated with the energy-ray curable composition.

In at least one exemplary embodiment of this disclosure, there is provided a method of producing a detachable information sheet. The method includes an image forming step, an applying and curing step, and a heating and pressing step. The image forming step includes an electrostatic latent image forming step of forming an electrostatic latent image on an image bearing body, a development step of developing the electrostatic latent image with a toner to form a visible toner image, a transfer step of transferring the toner image from the image bearing body onto a recording medium, and a fixing step of fixing, on the recording medium, the toner image transferred onto the recording medium. The applying and curing step applies an energy-ray curable composition precursor onto the recording medium having the toner image fixed thereon, and cures the energy-ray curable composition precursor to form an energy-ray curable composition to coat the recording medium. The heating and pressing step heating and presses the recording medium coated with the energy-ray curable composition.

In at least one exemplary embodiment of this disclosure, there is provided a recording medium produced by the above-described method.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
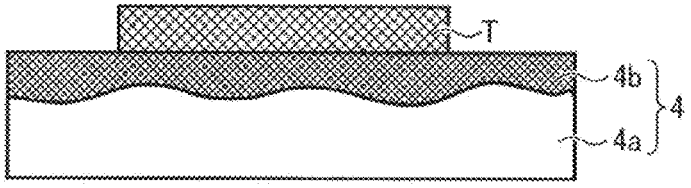
FIG. 1A is a schematic view of a recording medium with an image formed by an apparatus for producing a detachable information sheet according to an embodiment of the present invention, which is illustrated to explain a configuration with a toner image formed on the recording medium with a coat layer.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

An apparatus for producing a detachable information sheet according to embodiments of the present invention includes: an image bearing body; an electrostatic latent image forming unit to form an electrostatic latent image on the image bearing body; a development unit to develop the electrostatic latent image with a toner to form a visible toner image; a transfer unit to transfer the toner image from the image bearing body onto a recording medium; a fixing unit to fix, on the recording medium, the toner image transferred onto the recording medium; an applying and curing unit to apply an energy-ray curable composition precursor onto the recording medium having the toner image fixed thereon, and curing the precursor to form an energy-ray curable composition to coat the recording medium; and a heating and pressing unit for heating and pressing the recording medium coated with the energy-ray curable composition.

Below, a recording object (a recording medium provided with a toner image) achieved according to an embodiment of the present invention is described with reference to FIGS. 1A to 1D.

First, a toner image T subjected to normal fixing is adequately fixed on a recording medium 4 as shown in FIG. 1A.

Figure 1B:
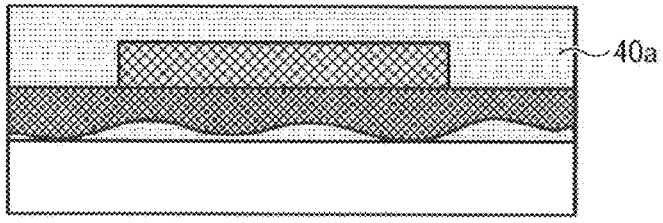
FIG. 1B is a schematic view of a configuration of the recording medium onto which an ultraviolet curable composition precursor is applied.

Then, when an ultraviolet curable composition 40 is applied onto the toner image T as shown in FIG. 1B, the ultraviolet curable composition 40 penetrates into minute gaps of the toner image T.

Figure 1C:
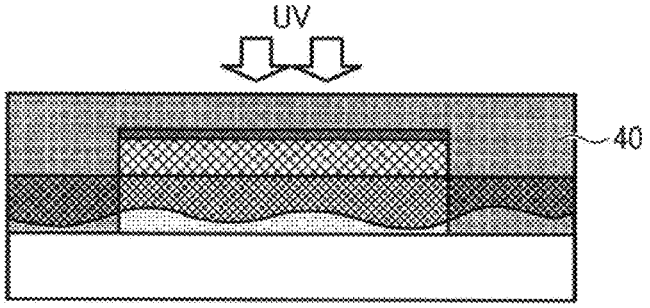
FIG. 1C is a schematic view of a configuration of the recording medium on which the ultraviolet curable composition precursor is cured.

The penetrating ultraviolet curable composition 40 as shown in FIG. 1B penetrates into the toner image T, as well as partially into a coat layer 4*b* and paper fibers 4*a* of the recording medium 4. Then, even when an ultraviolet curable composition precursor 40*a* is cured by irradiation of ultraviolet light (UV), the ultraviolet light fails to reach the inside of the toner image T and a portion below the toner image T. As a result, the ultraviolet curable composition precursor 40*a* is present in a liquid state to swell the toner image T and the coat layer 4*b* of the recording medium 4 (FIG. 1C).

Figure 1D:
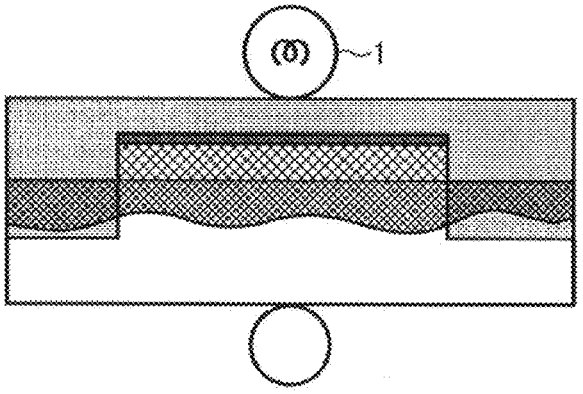
FIG. 1D is a schematic view of a configuration of the recording medium after passage through a heating and pressing device.

Then, as in FIG. 1D, the toner is softened through a heating and pressing device serving as a heating and pressing unit, and when the toner is cured again, the ultraviolet curable composition precursor 40*a* in a liquid state is eliminated from the toner layer to improve the fixing of the toner. Likewise, the ultraviolet curable composition precursor 40*a* in a liquid state is eliminated from the coat layer 4*b* of the recording medium 4, the strength of the coat layer 4*b* is increased by the heating and pressing, and the toner image T can be prevented from being peeled at the time of detachment.

Next, prior to describing other embodiments of the present invention, various studies for reaching the completion of the other embodiments are mentioned below.

The inventors have studied how images are peeled in detail, about why the image on one side is peeled when sheets with toner are attached to each other with the ultraviolet curable pressure-sensitive composition and detached from each other.

Papers made whiter by forming a coat layer of a white pigment such as calcium carbonate are used direct mail for eye appeal, and the inventors found that image peeling is caused by peeling of the coat layers in most cases, rather than by peeling of the toner image layers.

Then, it was determined that when papers subjected to no image formation with the ultraviolet curable pressure-sensitive composition formed thereon are attached to each other and detached from each other, the papers are successfully peeled without causing the coat layer of the paper to be peeled. Thus, it has been determined that the coat layers of the papers are weakened when the papers have toner images.

The ultraviolet curable pressure-sensitive composition is obtained in such a way that an ultraviolet curable pressure-sensitive composition precursor in a liquid state is applied onto a toner image, irradiated with ultraviolet light to induce a radical reaction, for curing the precursor into an ultraviolet curable pressure-sensitive composition. Based on further studies by the inventors, the ultraviolet curable pressure-sensitive composition precursor in a liquid state partially permeates the toner image to slightly swell the toner image. In addition, the inventors found that the ultraviolet curable pressure-sensitive composition precursor in a liquid state penetrates even the coat layer under the toner and paper fibers.

It was found that, while the ultraviolet curable pressure-sensitive composition precursor in a liquid state can be turned into the ultraviolet curable pressure-sensitive composition only when irradiated with ultraviolet light, the ultraviolet light fails to reach the toner image layer in the section with the toner image and the coat layer under the toner image layer to leave the ultraviolet curable pressure-sensitive composition in a liquid state, and therefore the coat layer is pruned and decreased in strength. It was also found that, while the surface of a portion of the coat layer in contact with the toner image adheres strongly to the toner image because of the melt of the toner image in fixing, the ultraviolet curable pressure-sensitive composition precursor in a liquid state penetrates to slightly swell the image, thereby decreasing the strength of the coat layer. It can be also understood that the image is extensively peeled in the case of detachment on the next day than in the case of detachment immediately after the attachment because the ultraviolet curable pressure-sensitive composition precursor in a liquid state permeates through the coat layer or the toner image.

On the other hand, it was found that when the ultraviolet curable pressure-sensitive composition precursor is applied to a paper sheet with no toner image and irradiated with ultraviolet light, detachment can be carried out without any problem because the ultraviolet curable pressure-sensitive composition precursor is cured to increase the strength of the coat layer itself, while the ultraviolet curable pressure-sensitive composition precursor permeates the coat layer.

The inventors have carried out earnest studies for the detachment without peeling of a toner image even when the ultraviolet curable pressure-sensitive composition precursor is applied to the toner image, irradiated with ultraviolet light, and then attached, and found that when information sheets attached to each other are subjected to pressure bonding while applying a temperature equal to or higher than the softening temperature of the toner, the ultraviolet curable pressure-sensitive composition precursor permeating the toner image is eliminated from the toner image while the toner image melts, and the toner image fixes the surface of the coat layer to increase the strength of a layer of a loading material. In addition, it was found that the ultraviolet curable pressure-sensitive composition precursor permeating the coat layer under the toner image diffuses throughout the paper sheet to be diluted and furthermore, the pressure bonding itself by heating increases the strength of the coat layer of the paper sheet, and the image is thus not peeled at all even when detachment is carried out.

Figure 2:
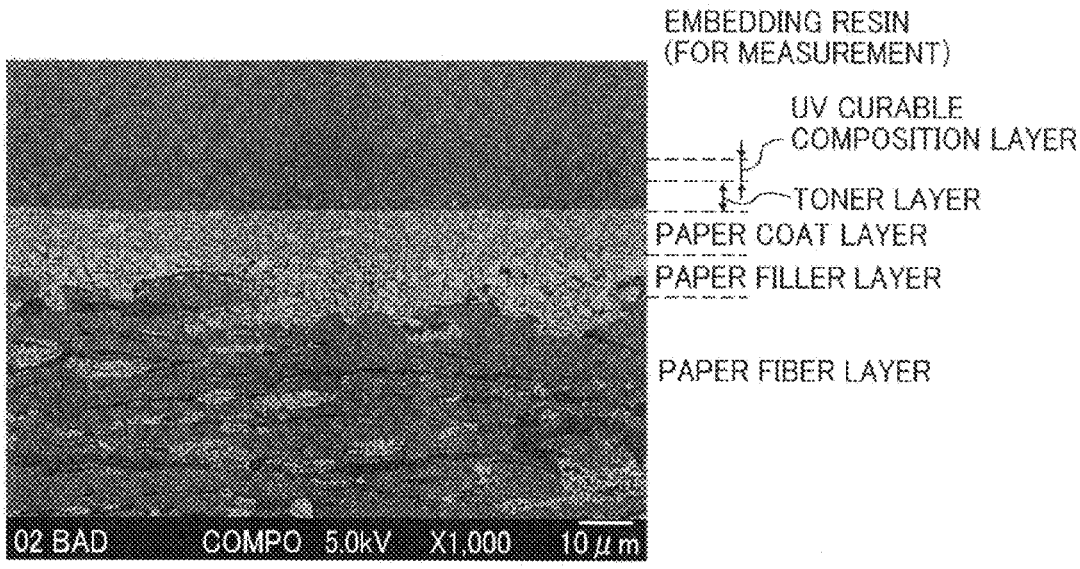
FIG. 2 is a cross-sectional scanning electron microscope (SEM) photograph of a detachable information sheet obtained when an ultraviolet curable pressure-sensitive composition precursor is applied onto a paper sheet with a toner image formed, and irradiated with ultraviolet light, followed by attachment to each other, pressure bonding, and then detachment.
Figure 3:
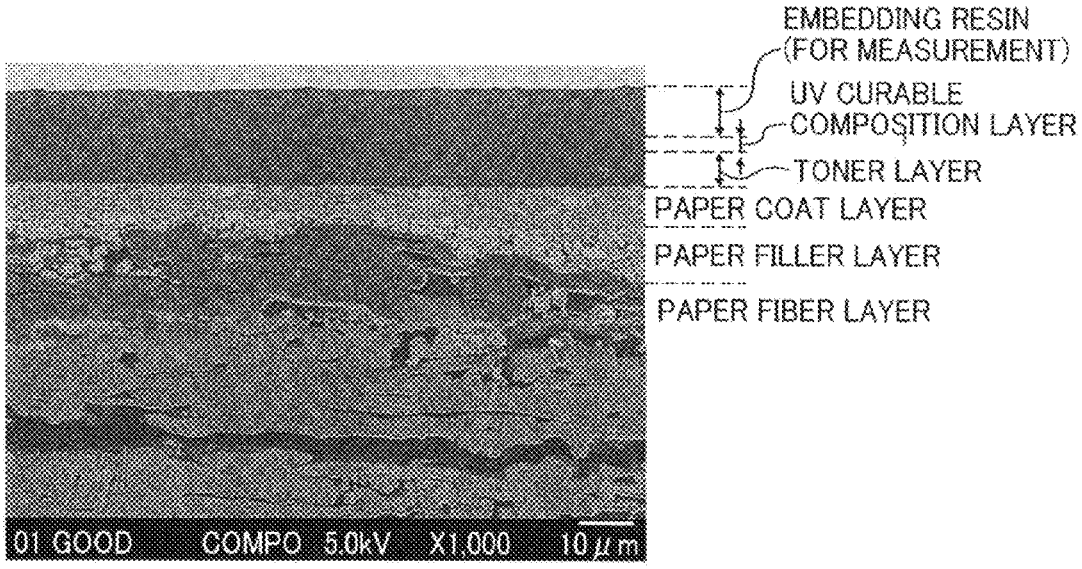
FIG. 3 is a cross-sectional SEM photograph of a detachable information sheet obtained when an ultraviolet curable pressure-sensitive composition precursor is applied onto a paper sheet with a toner image formed, and irradiated with ultraviolet light, followed by attachment to each other, pressure bonding, then further pressure bonding by heating to a temperature equal to or higher than the softening temperature of the toner, and then detachment.

FIGS. 2 and 3 show cross-sectional SEM photographs of detachable information sheets from which the phenomena mentioned above are observed.

FIG. 2 is a cross-sectional SEM photograph obtained when an ultraviolet curable pressure-sensitive composition precursor is applied onto a paper sheet with a toner image formed, and irradiated with ultraviolet light, followed by attachment to each other, pressure bonding, and then detachment. On the other hand, FIG. 3 is a cross-sectional SEM photograph obtained when an ultraviolet curable pressure-sensitive composition precursor is applied onto a paper sheet with a toner image formed, and irradiated with ultraviolet light, followed by attachment to each other, pressure bonding, then further pressure bonding by heating to a temperature equal to or higher than the softening temperature of the toner, and then detachment.

When FIG. 2 is compared with FIG. 3, it is found that FIG. 2 has gaps between particles in a swollen coat layer which is thicker, FIG. 3 has fewer gaps in a coat layer which is thinner, and increased in strength. In addition, the same applies to a layer of a loading material between the coat layer and paper fibers.

More specifically, other embodiments of the present invention are characterized in that in the above-described embodiment, the ultraviolet curable composition is an ultraviolet curable pressure-sensitive composition, and in a pressure bonding step of applying pressure bonding to a recording medium, the recording medium is subjected to pressure bonding while applying a temperature equal to or higher than the softening temperature of the toner, or subjected to pressure bonding, and then to a temperature equal to or higher than the softening temperature of the toner.

Next, an apparatus for producing a detachable information sheet according to embodiments of the present invention is described in more derail.

It is to be noted that while the embodiments described below are preferred embodiments of the present invention and are limited in various ways technically preferred, the scope of the present invention is not to be considered limited to these embodiments unless otherwise indicated for limiting the present invention in the following description.

In addition, while among energy-ray curable compositions (precursors), ultraviolet curable compositions (precursors) and ultraviolet curable pressure-sensitive compositions (precursor) are presented and described as specific examples in this description, the present invention is not to be considered limited to these compositions in any way. That is to say, the present invention is not intended to exclude, from the scope thereof, compositions curable by various energy rays which are not limited to ultraviolet rays.

Figure 4:
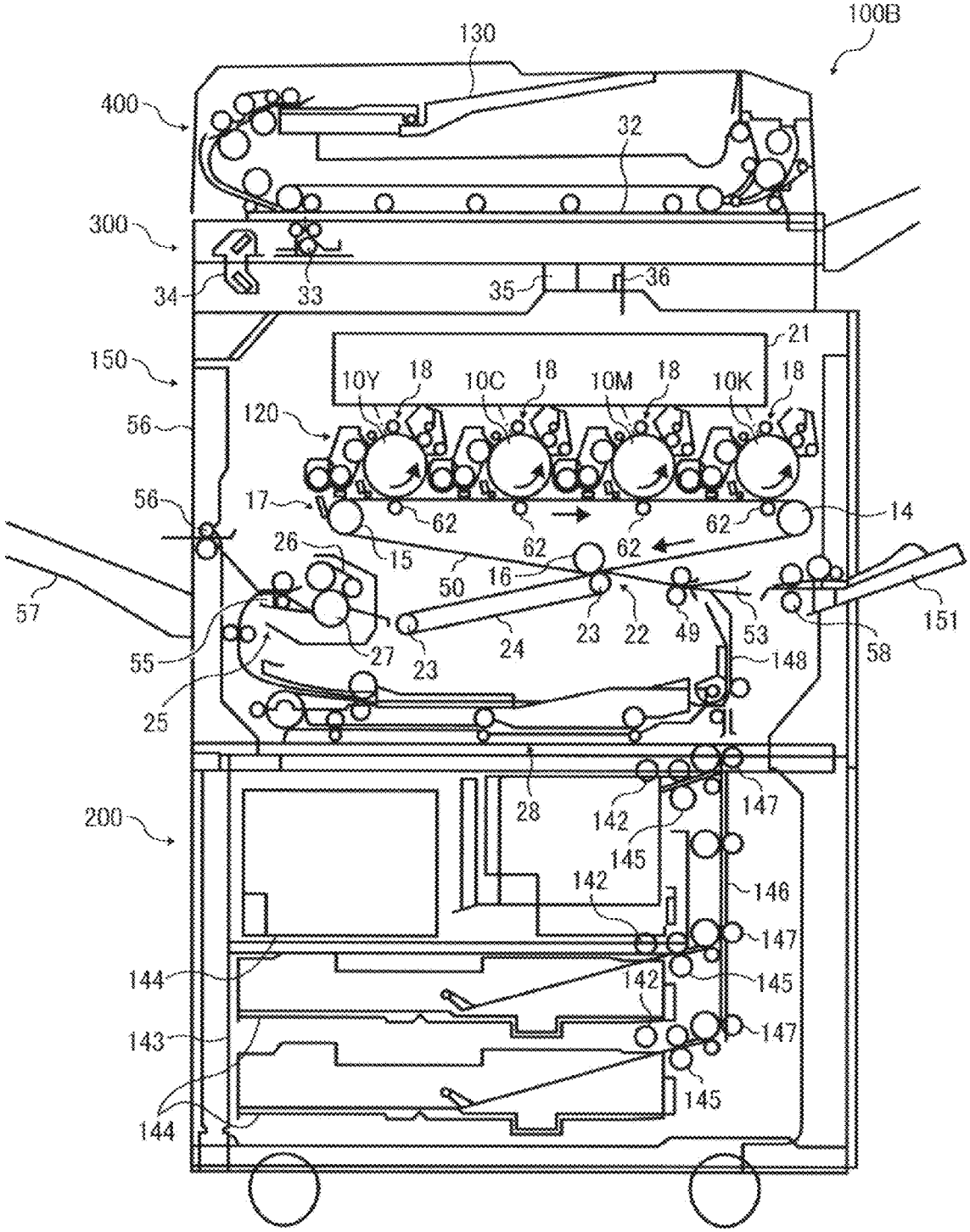
FIG. 4 is a schematic view of an example of the configuration of an image forming apparatus included in an apparatus for producing a detachable information sheet according to an embodiment of the present invention.

An image forming apparatus included in an apparatus for producing a detachable information sheet according to an embodiment of the present invention has at least an image bearing body, an electrostatic latent image forming unit, a development unit, a transfer unit, an applying and curing unit, and a fixing unit, preferably has a cleaner, and further has other units selected appropriately, if necessary, for example, a neutralization unit, a recycle unit, and a controller (FIG. 4).

An image forming method included in method for producing a detachable information sheet according to an embodiment of the present invention includes at least an electrostatic latent image forming step, a development step, a transfer step, an applying and curing unit, and a fixing unit, preferably has a cleaning step, and further has other steps selected appropriately, if necessary, for example, a neutralization step, a recycle step, and a control step.

The image forming method can be carried out in a preferred manner with the use of the image forming apparatus, the electrostatic latent image forming step can be carried out with the use of the electrostatic latent image forming unit, the development step can be carried out with the use of the development unit, the transfer step can be carried with the use of the transfer unit, the applying and curing step can be carried out with the use of the applying and curing unit, the fixing step can be carried out with the use of the fixing unit, and the other steps can be carried out with the use of the other units.

<Electrostatic Latent Image Forming Step and Electrostatic Latent Image Forming Unit>

The electrostatic latent image forming step is a step of forming an electrostatic latent image on an image bearing body.

—Image Bearing Body—

The image bearing body (which may be referred to as an "electrostatic latent image bearing body" or a "photoreceptor" in some cases) is not particularly limited on the material, shape, structure, size, etc. thereof, which can be selected appropriately from among known ones, and preferred examples of the shape include a drum-like shape, and examples of the material include, for example, inorganic photoreceptors such as amorphous silicon and selenium, and organic photoreceptors such as polysilane and phthalo-polymethyne.

The image bearing body (photoreceptor) for use in the image forming apparatus according to an embodiment of the present invention has a conductive bearing body, and at least a photosensitive layer on the conductive bearing body, and further has other layers, if necessary.

Examples of the photosensitive layer include a single-layer type that has a mixture of a charge generating substance and a charge transporting substance, a forward layered type that has a charge transporting layer provided on a charge generating layer, and a reversely layered type that has a charge generating layer provided on a charge transporting layer. Further, an outermost surface layer can be also provided on the photosensitive layer, in order to improve the mechanical strength, abrasion resistance, gas resistance, cleaning performance, etc. of the photoreceptor. Further, a priming layer may be provided between the photosensitive layer and the conductive bearing body. Further, appropriate amounts of plasticizer, antioxidant, leveling agent, etc. can be also added to the respective layers, if necessary.

The conductive bearing body is not particularly limited as long as the body exhibits a conductivity of a volume resistance of $1.0\times10^{10}$ Ω·cm or less, which can be selected appropriately for any purpose, and as the body, for example, filmy or cylindrical plastics and paper sheets can be coated by vapor deposition or sputtering with metals such as aluminum, nickel, chromium, nichrome, copper, gold, silver, and platinum, and metal oxides such as tin oxide and indium oxide, or tubes can be used which are obtained in such a way that plates such as aluminum, aluminum alloys, nickel, and stainless steel are made into drum-like element tubes by a method such as extrusion or drawing, and subjected to surface treatments such as cutting, super finishing, and polishing.

The drum-like bearing body is preferably 20 mm to 150 mm, more preferably 24 mm to 100 nm, and further preferably 28 mm to 70 mm in diameter. When the drum-like bearing body is less than 20 mm in diameter, it may be physically difficult in some cases to arrange respective steps of charging, exposure, development, transfer, and cleaning around the drum, and in excess of 150 mm, the image forming apparatus may be increased in size in some cases. In particular, when the image forming apparatus is a tandem-type apparatus, it is necessary to carry more than one photoreceptor, and the bearing body is thus preferably 70 mm or less, and more preferably 60 mm or less in diameter. In addition, endless nickel belts or endless stainless belts as disclosed in JP-52-036016-A can be also used as the conductive bearing body.

The priming layer on the photoreceptor may be a single layer, or composed of multiple layers, and examples of the priming layer include, for example, (1) a layer containing a resin as a main constituent, (2) a layer containing a white pigment and a resin as a main constituents, and (3) a metal oxide film obtained by chemically or electrochemically oxidizing a surface of a conductive substrate. Among these examples, the layer containing a white pigment and a resin as main constituents is preferred.

Examples of the white pigment include, for example, metal oxides such as titanium oxide, aluminum oxide, zirconium oxide, and zinc oxide, and among these example, titanium oxide is particularly preferred which is excellent in prevention of charge injection from the conductive bearing body.

Examples of the resin include, for example, thermoplastic resins such as polyamide, polyvinyl alcohol, casein, and methyl cellulose; and thermosetting resins such as acrylics, phenols, melamine, alkyd, unsaturated polyesters, and epoxy. One of these resins may be used by itself, or two or more thereof may be used in combination.

The thickness of the priming layer is not particularly limited, which can be selected appropriately for any purpose, and preferably 0.1 μm to 10 μm, and more preferably 1 μm to 5 μm.

Examples of the charge generating substance in the photosensitive layer include, for example, organic pigments or dyes such as azo pigments, e.g., monoazo pigments, bisazo pigments, trisazo pigments, and tetrakisazo pigments, triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, industron pigments, squarylium pigments, and phthalocyanine pigments; and inorganic materials such as selenium, selenium-arsenic, selenium-tellurium, cadmium sulfate, zinc oxide, titanium oxide, and amorphous silicon. One of these substances may be used by itself, or two or more thereof may be used in combination.

Examples of the charge transporting substance in the photosensitive layer include, for example, anthracene derivatives, pyrene derivatives, carbazole derivatives, tetrazole derivatives, metallocene derivatives, phenothiazine derivatives, pyrazoline compounds, hydrazone compounds, styryl compounds, styrylhydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. One of these substances may be used by itself, or two or more thereof may be used in combination.

As a binder resin for use in the formation of the photosensitive layer, thermoplastic resins, thermosetting resins, photocurable resins, photoconductive resins, and the like can be used which are electrically insulative and known per se. Examples of the binder resin include, for example, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyester, phenoxy resins, (meth)acrylic resins, polystyrene, polycarbonate, polyarylate, polysulfone, polyethersulfone, and ABS resins; thermosetting resins such as phenolic resins, epoxy resins, urethane resins, melamine resins, isocyanate resins, alkyd resins, silicone resins, thermosetting acrylic resins; polyvinyl carbazole; polyvinyl anthracene; and polyvinyl pyrene. One of these resins may be used by itself, or two or more thereof may be used in combination.

Examples of the antioxidant include, for example, phenolic compounds, para-phenylenediamines, hydroquinones, organic sulfur compounds, and organic phosphorus compounds.

Examples of the phenolic compounds include, for example, 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherols.

Examples of the para-phenylenediamines include, for example, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include, for example, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include, for example, dilauryl-3,3'-thiodipropionate, distearyl-3,3'-thiodipropionate, and ditetradecyl-3,3'-thiodipropionate.

Examples of the organic phosphorus compounds include, for example, triphenylphosphine, tri(nonylphenyl)phosphine, tri(dinonylphenyl)phosphone, tricresyl phosphone, and tri(2,4-dibutylphenoxy)phosphone.

These compounds are known as antioxidants such as rubbers, plastic, and oils and fats, and commercialized products thereof are easily available.

The additive amount of the antioxidant is preferably 0.01 mass % to 10 mass % with respect to the total mass of layers added.

As the plasticizer, common resins for use as plasticizers can be directly used such as dibutyl phthalate and dioctyl phthalate, and the amount of the plasticizer used is appropriately on the order of 0 to 30 parts by mass with respect to 100 parts by mass of the binder resin.

In addition, a leveling agent may be added into the photosensitive layer. For example, silicon oils such as dimethyl silicon oil and methylphenyl silicon oil; or polymers or oligomers having a side chain with a perfluoroalkyl group are used as the leveling agent. The amount of the leveling agent use is preferably 0 to 1 parts by mass with respect to 100 parts by mass of the resin.

The formation of an electrostatic latent image can be achieved, for example, by uniformly charging the surface of the image bearing body, and then carrying out imagewise exposure, with the use of the electrostatic latent image forming unit. The electrostatic latent image forming unit includes, for example, at least a charger to uniformly charge the surface of the image bearing body, and an exposing device to expose the surface of the image bearing body in an imagewise fashion.

The charging can be achieved, for example, by applying voltage to the surface of the image bearing body with the use of the charger.

The charger is not particularly limited, which can be selected appropriately for any purpose, and examples of the charger include, for example, contact chargers, known per se, including a conductive or semiconductive roll, brush, film, rubber blade, and non-contact chargers such as a corotron or scorotron charging device using corona discharge.

The charger preferably has a voltage application unit for applying voltage including an alternating-current component.

The exposure can be achieved, for example, by exposing the surface of the image bearing body in an imagewise fashion with the use of the exposing device.

The exposing device is not particularly limited as long as the surface of the image bearing body charged with the charger can be exposed in an imagewise fashion to be formed, which can be selected appropriately for any purpose, and examples of the exposing device include, for example, various types of exposing devices such as copying optical systems, rod lens array systems, laser optical systems, and liquid crystal shutter optical systems.

It is to be noted that a back exposure method for carrying out imagewise exposure from the back surface of the image bearing body may be adopted in an embodiment of the present invention.

<Development Step and Development Unit>

The development step is a step of developing the electrostatic latent image with the use of a toner or a developer to form a visualized toner image.

The formation of the visualized toner image can be achieved, for example, by developing the electrostatic latent image with the use of the toner or the developer, with the use of the development unit.

The development unit is not particularly limited as long as the development can be achieved with the use of, for example, the toner or the developer, which can be selected appropriately from among known units, and preferred examples of the development unit include, for example, a unit including at least a development device housing the toner or the developer, which is able to provide the toner or the developer to the electrostatic latent image in a contact or non-contact way.

—Toner—

The toner is preferably 0.93 to 1.00, more preferably 0.95 to 0.99 in average circularity, which is an average value for the circularity SR indicated by the following mathematical formula 1. This average circularity is an indicator of the degree of toner particle irregularity, which represents 1.00 when the toner is perfectly spherical, and the average circularity has a smaller value as the surface profile is more complicated.

Circularity SR=(Perimeter of Circle equal to Projected Area of Toner Particle)/(Perimeter of Projection Image of Toner Particle) <Mathematical Formula 1>

In the range of 0.93 to 1.00 in average circularity, the toner particles have smooth surfaces, and are excellent in transferability because of small areas of contact between the toner particles and between the toner particles and the photoreceptor. In addition, because the toner particles are not angular, the agitation torque of the developer is low in the development device, and the agitation is driven stably, so that abnormal images are not generated. In addition, the toner for forming dots includes therein no angulate toner particles, and thus, in the case of pressure welding to a recording medium by transfer, the pressure is uniformly applied throughout the toner for forming dots, and missing dots are less likely to be produced during the transfer. In addition, because the toner particles are not angulate, the toner particles themselves have a low polishing power, and will not scratch or abrade the surface of the image bearing body.

The circularity SR can be measured with the use of, for example, a flow-type particle image analyzer (FPIA-1000 from Toa Medical Electronics Co., Ltd.).

First, a surfactant (preferably alkyl benzene sulfonate) of 0.1 ml to 0.5 ml is added as a dispersant into 100 ml to 150 ml of water in a container, from which impurity solids are removed in advance, and a measurement sample on the order of 0.1 g to 0.5 g is further added thereto. The suspension with the sample dispersed therein is subjected to a dispersion treatment for about 1 to 3 minutes with an ultrasonic disperser, and with the dispersion concentration of 3000/μl to 10000/μl, the shape and particle size of the toner are measured with the analyzer.

The mass average particle size (D4) of the toner is preferably 3 μm to 10 μm, and more preferably 4 μm to 8 μm. In this range, the toner has toner particles which are sufficiently small in particle size with respect to microscopic latent image dots, and thus has excellent dot reproducibility. The mass average particle size (D4) less than 3 μm is likely to cause phenomena such as decrease in transfer efficiency and decrease in blade cleaning performance, whereas in excess of 10 μm, it may be difficult in some cases to keep character or line missing from being caused.

In addition, the toner preferably has a ratio (D4/D1) of 1.00 to 1.40, and more preferably 1.00 to 1.30 between the mass average particle size (D4) and the number average particle size (D1). The ratio (D4/D1) closer to 1 means that the toner has a sharper particle size distribution, and in the (D4/D1) range of 1.00 to 1.40, the stability of image quality is excellent because selections are not made depending on the toner particle size. In addition, the toner has a sharp particle size distribution, the frictional charge quantity distribution is thus also sharp, and fogging is kept from being caused. In addition, the toner particles in the same size result in development of latent image dots in a dense fashion and in a perfect array, and thus have excellent dot reproducibility.

In this case, the mass average particle size (D4) and particle size distribution of the toner are measured by, for example, a Coulter Counter method. Apparatuses for measuring the particle size distribution for toner particles by the Coulter Counter method include Coulter Counter TA-II and Coulter Multisizer II (both from Beckman Coulter, Inc.).

First, 0.1 ml to 5 ml of a surfactant (preferably alkyl benzene sulfonate) is added as a dispersant into 100 ml to 150 ml of an aqueous electrolytic solution. In this case, the electrolytic solution refers to an aqueous solution of approximately 1% NaCl prepared with the use of first-grade sodium chloride, and for example, ISOTON-II (from Beckman Coulter, Inc.) can be used. Then, 2 mg to 20 mg of a measurement sample is further added. The electrolytic solution with the sample suspended therein is subjected to a dispersion treatment for about 1 minute to 3 minutes with an ultrasonic disperser, and the volume and number of the toner or toner particles are measured with the use of a 100 μm aperture as the aperture through the measurement device mentioned previously to calculate the volume distribution and number distribution. The mass average particle size (D4) and number average particle size (D1) of the toner can be figured out from the obtained distributions.

Thirteen channels of: 2.00 μm or more and less than 2.52 μm; 2.52 μm or more and less than 3.17 μm; 3.17 μm or more and less than 4.00 μm; 4.00 μm or more less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm are used as the channel, which are intended for particles of 2.00 μm or more and less than 40.30 μm.

Such a substantially spherical toner can be prepared by developing a cross-linking and/or elongation reaction of a toner composition including a polyester prepolymer with a functional group including a nitrogen atom, polyester, a colorant, and a release agent in the presence of resin fine particles in an aqueous medium. The toner produced by this reaction can reduce the generation of hot offset through toner surface hardening, and can keep itself from contaminating a fixing device and causing the contamination to appear on images.

Prepolymers of modified polyester resins include polyester prepolymers (A) having an isocyanate group, and compounds elongated or cross-linked with the prepolymers include amines (B).

The polyester prepolymer (A) having an isocyanate group is obtained by, for example, reacting a polyisocyanate (3) with a polyester that is a polycondensation product of a polyol (1) and a polycarboxylic acid (2) and has an active hydrogen group. The active hydrogen groups of the polyesters include hydroxyl groups (alcoholic hydroxyl groups and phenolic hydroxyl groups), amino groups, carboxyl groups, and mercapto groups. Among these groups, the alcoholic hydroxyl groups are particularly preferred.

The polyols (1) include diols (1-1) and trivalent or more polyols (1-2), and preferred are the diol (1-1) alone or a mixture of the diol (1-1) with a minute amount of the polyol (1-2).

Examples of the diols (1-1) include, for example, alkylene glycols (e.g. ethylene glycol, 1,2-propylene glycol, 1,3-propylene glycol, 1,4-butanediol, 1,6-hexanediol); alkylene ether glycols (e.g. diethylene glycol, triethylene glycol, dipropylene glycol, polyethylene glycol, polypropylene glycol, polytetramethylene ether glycol); alicyclic diols (e.g. 1,4-cyclohexane dimethanol, hydrogenated bisphenol A); bisphenols (e.g. bisphenol A, bisphenol F, bisphenol S); alkylene oxide (e.g. ethylene oxide, propylene oxide, butylene oxide) adducts of the alicyclic diols mentioned above; and alkylene oxide (e.g. ethylene oxide, propylene oxide, butylene oxide) adducts of the bisphenols mentioned above. Among these diols, the alkylene glycols having 2 to 12 carbon atoms and the alkylene oxide adducts of the bisphenols are preferred, and the alkylene oxide adducts of the bisphenols, and the use of the adduct in combination with the alkylene glycol having 2 to 12 carbon atoms are particularly preferred.

Examples of the trivalent or more polyols (1-2) include trivalent to octavalent or more polyaliphatic alcohols (e.g. glycerin, trimethylolethane, trimethylolpropane, pentaerythritol, sorbitol); trivalent or more phenols (e.g. trisphenol PA, phenol novolac, cresol novolac); and alkylene oxide adducts of the trivalent or more polyphenols.

The polycarboxylic acids (2) include dicarboxylic acids (2-1) and trivalent or more polycarboxylic acids (2-2), and among these acids, the acid (2-1) alone or a mixture of the acid (2-1) with a minute amount of the acid (2-2) is preferred.

Examples of the dicarboxylic acids (2-1) include, for example, alkylene dicarboxylic acids (e.g. succinic acid, adipic acid, sebacic acid); alkenylene dicarboxylic acids (e.g. maleic acid, fumaric acid); and aromatic dicarboxylic acids (e.g. phthalic acid, isophthalic acid, terephthalic acid, naphthalenedicarboxylic acid). Among these acids, the alkenylene dicarboxylic acids having 4 to 20 carbon atoms and the aromatic dicarboxylic acids having 8 to 20 carbon atoms are particularly preferred.

Examples of the trivalent or more polycarboxylic acids (2-2) include aromatic polycarboxylic acids having 9 to 20 carbon atoms (e.g. trimellitic acid, pyromellitic acid). It is to be noted that as the polycarboxylic acids (2), anhydrides of the acids mentioned above or lower alkyl esters (e.g. methyl esters, ethyl esters, isopropyl esters) may be used for reactions with the polyols (1).

As for the ratio between the polyol (1) and the polycarboxylic acid (2), the equivalent ratio [OH]/[COOH] between hydroxyl group [OH] and carboxyl group [COOH] is preferably 2/1 to 1/1, more preferably 1.5/1 to 1/1, and further preferably 1.3/1 to 1.02/1.

Example of the polyisocyanates (3) include, for example, aliphatic polyisocyanates (e.g. tetramethylene diisocyanate, hexamethylene diisocyanate, 2,6-diisocyanato methyl caproate); alicyclic polyisocyanates (e.g. isophorone diisocyanate, cyclohexylmethane diisocyanate); aromatic diisocyanates (e.g. tolylenediisocyanate, diphenylmethane diisocyanate); aromatic aliphatic diisocyanates (e.g. $\alpha,\alpha,\alpha',\alpha'$-tetramethylxylene diisocyanate); isocyanurates; and the polyisocyanates blocked with phenol derivatives, oxime, caprolactam, or the like. One of these polyisocyanates may be used by itself, or two or more thereof may be used in combination.

As for the ratio of the polyisocyanate (3), the equivalent ratio [NCO]/[OH] between isocyanate group [NCO] and hydroxyl group [OH] of polyester having a hydroxyl group is preferably 5/1 to 1/1, more preferably 4/1 to 1.2/1, further preferably 2.5/1 to 1.5/1. The ratio [NCO]/[OH] in excess of 5 may worsen fixing at low temperatures in some cases, whereas the molar ratio of [NCO] less than 1 lowers the urea content in the modified polyester to worsen the resistance to hot offset.

The content of the polyisocyanate (3) constituent in the prepolymer (A) having a terminal isocyanate group is preferably 0.5 mass % to 40 mass %, more preferably 1 mass % to 30 mass %, and further preferably 2 mass % to 20 mass %. The content less than 0.5 mass % may worsen the resistance to hot offset, and bring disadvantages in terms of balance between heat-resistance storage stability and low-temperature fixing, whereas the content in excess of 40 mass % may worsen the low-temperature fixing in some cases.

The number of isocyanate groups contained per molecular in the prepolymer (A) having an isocyanate group is preferably 1 or more on average, more preferably 1.5 to 3 on average, and further preferably 1.8 to 2.5 on average. When the number of isocyanate groups is less than 1 per molecule, the molecular weight of the urea-modified polyester may be decreased to worsen the resistance to hot offset.

The amines (B) include diamines (B1), trivalent or more polyamines (B2), amino alcohols (B3), aminomercaptans (B4), amino acids (B5), and the blocked amino groups in B1 to B5 (B6). Example of the diamines (B1) include aromatic diamines (e.g. phenylenediamine, diethyltoluenediamine, 4,4'diaminodiphenylmethane); alicyclic diamines (e.g. 4,4'-diamino-3,3'dimethyldicyclohexylmethane, diamine cyclohexane, isophorone diamine); and aliphatic diamines (e.g. ethylenediamine, tetramethylenediamine, hexamethylenediamine). Examples of the trivalent or more polyamines (B2) include diethylenetriamine and triethylenetetramine. Examples of the amino alcohols (B3) include ethanolamine and hydroxyethylaniline. Examples of the aminomercaptans (B4) include aminoethylmercaptan and aminopropylmercatan. Examples of the amino acids (B5) include aminopropionic acids and aminocaproic acids. Examples of the blocked amino groups (B6) of B1 to B5 include ketimine compounds and oxazoline compounds obtained from the amines and ketones (e.g. acetone, methyl ethyl ketone, methyl isobutyl ketone) of the B1 to B5. Preferred among these amines (B) are: B1; and a mixture of B1 with a small amount of B2.

Furthermore, the molecular weight of the urea-modified polyester can be adjusted with the use of an elongation terminator, if necessary. Examples of the elongation terminator include monoamines (e.g. diethylamine, dibutylamine, butylamine, laurylamine), or the blocked monoamines (ketimine compounds).

As for the ratio of the amines (B), the equivalent ratio [NCO]/[NHx] between isocyanate group [NCO] in the prepolymer (A) having an isocyanate group and amino group [NHx] in the amines (B) is preferably 1/2 to 2/1, more preferably 1.5/1 to 1/1.5, and further preferably 1.2/1 to 1/1.2. The ratio [NCO]/[NHx] in excess of 2 or less than 1/2 decreases the molecular weight of the urea-modified polyester (i), and worsens the resistance to hot offset.

In the present embodiment, the polyester (i) modified by an urea bond may contain therein an urethane bond along with the urea bond. The molar ratio between the urea bond content and the urethane bond content is preferably 100/0 to 10/90, more preferably 80/20 to 20/80, and further preferably 60/40 to 30/70. When the molar ratio of the urea bond is less than 10%, the resistance to hot offset may be worsened.

The modified polyester for use in the toner, above all, the urea-modified polyesters (i) can be prepared by these reactions. The urea-modified polyesters (i) are produced by a one-shot method or a prepolymer method. The mass average molecular weight of the urea-modified polyester (i) is preferably 10,000 or more, more preferably 20,000 to 10,000,000, and further preferably 30,000 to 1,000,000. When the mass average molecular weight is less than 10,000, the resistance to hot offset may be worsened.

In addition, the number average molecular weight of the urea-modified polyester is not to be considered particularly limited in the case of using an unmodified polyester (ii) as is described later, and may be any number average molecular weight for easily achieving the mass average molecular weight mentioned previously. In the polyester (i) alone, the number average molecular weight is preferably 20,000 or less, more preferably 1,000 to 10,000, and further preferably 2,000 to 8,000. The number average molecular weight in excess of 20,000 may worsen, the low-temperature fixing and the gloss in the case of use in a full-color image forming apparatus.

In an embodiment of the present invention, the polyester (i) modified by the urea bond can be used not only alone, but also contained along with the unmodified polyester (ii) as a binder resin component. The use of the polyester (i) in combination with the polyester (ii) is more preferable than the use of the polyester (i) alone, because the combination use improves the low-temperature fixing and the gloss in the case of use in a full-color apparatus. Examples of the polyester (ii) include polycondensation products of the polyols (1) with the polycarboxylic acids (2) similar to the polyester component of the polyester (i) mentioned previously, and preferred polycondensation products are also similar to those in the case of the polyester (i). In addition, the polyester (ii) may be not only unmodified polyesters, but also polyesters modified by chemical bonding other than urea bonds, and for example, may be modified by urethane bonds. The polyesters (i) and (ii) are preferably partially compatible with each other, in terms of low-temperature fixing and resistance to hot offset.

Therefore, the polyester component of the polyester (i) is preferably similar in composition to the polyester (ii). The mass ratio between the polyesters (i) and (ii) in the case of containing the polyester (ii) is preferably 5/95 to 80/20, more preferably 5/95 to 30/70, further preferably 5/95 to 25/75, and particularly preferably 7/93 to 20/80. The mass ratio of the polyester (i) less than 5 mass % may worsen the resistance to hot offset, and bring disadvantages in terms of balance between heat-resistance storage stability and low-temperature fixing.

The peak molecular weight of the polyester (ii) is preferably 1,000 to 30,000, more preferably 1,500 to 10,000, and further preferably 2,000 to 8,000. The peak molecular weight less than 1,000 may worsen the heat-resistance storage stability, whereas the peak molecular weight in excess of 10,000 may worsen the low-temperature fixing. The hydroxyl value of the polyester (ii) is preferably 5 or more, more preferably 10 to 120, and further preferably 20 to 80. The hydroxyl value less than 5 may bring disadvantages in terms of balance between heat-resistance storage stability and low-temperature fixing. The acid value of the polyester (ii) is preferably 1 to 30, and more preferably 5 to 20. With the acid value, there is a tendency to be negatively charged.

The glass transition temperature (Tg) of the binder resin is preferably 50° C. to 70° C., and more preferably 55° C. to 65° C. The glass transition temperature lower than 50° C. may worsen blocking in the case of storing the toner at high temperatures, whereas the temperature higher than 70° C. results in insufficient fixing at low temperatures. The coexistence of the urea-modified polyester resin shows a tendency for the toner for use in embodiments of the present invention to have favorable heat-resistance storage stability even when the glass transition temperature is low, as compared with known polyester-based toners.

The temperature (TG') at which storage elastic modulus of the binder resin reaches 10,000 dyne/cm$^2$ at a measurement frequency of 20 Hz is preferably 100° C. or higher, and more preferably 110° C. to 200° C. When the temperature (TG') is lower than 100° C., the resistance to hot offset may be worsened.

The temperature (Tη) at which the viscosity of the binder resin reaches 1000 poise at measurement frequency of 20 Hz is preferably 180° C. or lower, and more preferably 90° C. to 160° C. The temperature (Tη) in excess of 180° C. worsens the low-temperature fixing. More specifically, the temperature TG' is preferably higher than the temperature Tη, from the perspective of balance between low-temperature fixing and resistance to hot offset. In other words, the difference (TG'−Tη) between the temperatures TG' and Tη is preferably larger than 0° C., more preferably 10° C. or larger, and further preferably 20° C. or larger. It is to be noted that the upper limit of the difference is not particularly limited. In addition, from the perspective of balance between heat-resistance storage stability and low-temperature fixing, the difference between the temperatures Tη and Tg is preferably 0° C. to 100° C., more preferably 10° C. to 90° C., and further preferably 20° C. to 80° C.

The binder resin can be produced by the following method or the like.

First, the polyol (1) and the polycarboxylic acid (2) are heated to 150° C. to 280° C. in presence of a known esterification catalyst such as tetrabutoxy titanate or dibutyl tin oxide, and if necessary, produced water is distilled away under reduced pressure to obtain a polyester having an hydroxyl group. Then, this polyester is reacted with the polyisocyanate (3) at 40° C. to 140° C. to obtain the prepolymer (A) having an isocyanate group. Furthermore, the prepolymer (A) is reacted with the amines (B) at 0° C. to 140° C. to obtain a polyester modified by an urea bond. In the case of reacting the polyisocyanate (3), and in the case of reacting the prepolymer (A) with the amines (B), solvents can be used, if necessary.

Solvents that are inactive against the isocyanate (3) may be used including, for example, aromatic solvents (e.g. toluene, xylene); ketones (e.g. acetone, methyl ethyl keton, methyl isobutyl ketone); esters (e.g. ethyl acetate); amides (e.g. dimethylformamide, dimethylacetoamide); and ethers (e.g. tetrahydrofurane).

It is to be noted that when the polyester (ii) not modified by any urea bond is used in combination, the polyester (ii) is produced by the same method as for the polyester having a hydroxyl group, dissolved in the solution obtained after the completion of the reaction for the polyester (i), and mixed.

Further, the binder resin other than the polyester resins is also not particularly limited, which can be selected appropriately for any purpose, and examples thereof include, for example, homopolymers of styrene or substitution products thereof, such as polystyrene, poly(p-styrene), and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-c-chloromethyl methacrylate copolymers, styrene-acrylonitrile copolymers, styrene-vinyl methyl ether copolymers, styrene-vinyl methyl ketone copolymers, styrene-butadiene copolymers, styrene-isopropyl copolymers, and styrene-ester maleate copolymers; and polymethyl methacrylate resins, polybuthyl methacrylate resins, polyvinyl chloride resins, polyvinyl acetate resins, polyethylene resins, polyurethane resins, epoxy resins, polyvinyl butyral resins, polyacrylic acid resins, rosin resins, modified rosin resins, terpene resins, phenolic resins, aliphatic or aromatic hydrocarbon resins, and aromatic petroleum resins. One of these resins may be used by itself, or two or more thereof may be used in combination. Among these resins, in terms of fixing affinity for the recording medium, it is particularly preferable to use the polyester resins.

In addition, the toner for use in embodiments of the present invention can be produced by the following methods, but is of course not to be considered limited to these methods.

The toner may be formed by reacting a dispersion of the prepolymer (A) having an isocyanate group with the amines (B) in an aqueous medium, or the urea-modified polyester (i) may be used which is produced in advance. Methods for stably forming the urea-modified polyester (i) or a dispersion of the prepolymer (A) in an aqueous medium include a method of adding a composition as a toner raw material of the urea-modified polyester (i) or the prepolymer (A) into an aqueous medium, and dispersing the composition by shear force.

The prepolymer (A) and the other toner composition (hereinafter, which may be referred to as toner raw materials), e.g., a colorant, a colorant masterbatch, a release agent, a charge controlling agent, an unmodified polyester resin, may be mixed in the formation of a dispersion in an aqueous medium, and more preferably, after mixing the toner raw materials in advance, the mixture is added into an aqueous medium, for dispersing the mixture. In addition, in embodiments of the present invention, it is not always necessary to mix the other toner materials such as a colorant, a release agent, and a charge controlling agent in the formation of particles in an aqueous medium, and the materials may be added after particles are formed. For example, a colorant can be also added by a known dyeing method after the formation of particles containing no colorant.

The aqueous medium may be water alone, or can be also used in combination with a solvent that is miscible with water. Examples of the miscible solvent include alcohols (e.g. methanol, isopropanol, ethylene glycol), dimethylformamide, tetrahydrofurane, cellosolves (e.g. methyl cellosolve), and lower ketons (e.g. acetone, methyl ethyl ketone).

The amount of the aqueous medium used is preferably 50 parts by mass to 2000 parts by mass, and more preferably 100 parts by mass to 1000 parts by mass, with respect to 100 parts by mass of the urea-modified polyester (i) or the toner composition containing the prepolymer (A). The used amount less than 50 parts by mass may worsen the dispersed state of the toner composition to fail to obtain toner particles of predetermined particle size, whereas the amount in excess of 2000 parts by mass is not economical.

In addition, a dispersant can be also used, if necessary. The use of a dispersant is preferred in that the particle size distribution becomes sharp and that the dispersion is stabilized.

The method for the dispersion is not particularly limited, which can be selected appropriately for any purpose, and known equipment can be applied such as, for example, low-speed shear type, high-speed shear type, friction type, high-pressure jet type, ultrasonic equipment. The high-speed shear type is preferred in order to achieve a particle size of 2 μm to 20 μm of the dispersion. In the case of using a high-speed shear type disperser, the number of revolutions is not particularly limited, but preferably 1000 rpm to 30000 rpm, and more preferably 5000 rpm to 20000 rpm. The dispersion time is not particularly limited, but typically 0.1 minutes to 5 minutes in the case of a batch method. The temperature for the dispersion is, typically, preferably 0° C. to 150° C., and more preferably 40° C. to 98° C. The temperature is preferably higher in that the urea-modified polyester (i) or the dispersion of the prepolymer (A) is low in viscosity and easily dispersed.

In the step of synthesizing the urea-modified polyester (i) from the prepolymer (A), the amines (B) may be added and reacted before dispersing the toner composition in the aqueous medium, or the amines (B) may be added to develop a reaction from particle interfaces after dispersing the composition in the aqueous medium. In this case, an urea-modified polyester is produced preferentially on the toner surface produced, and the particles can be provided therein with a concentration gradient.

In the reaction mentioned previously, it is preferable to use a dispersant, if necessary.

The dispersant is not particularly limited, which can be selected appropriately for any purpose, and examples thereof include, for example, surfactants, dispersants of poorly water-soluble inorganic compounds, and polymeric protective colloids. One of these dispersants may be used by itself, or two or more thereof may be used in combination. Among these dispersants, the surfactants are preferred.

Examples of the surfactants include, for example, for example, anionic surfactants, cationic surfactants, non-ionic surfactants, and amphoteric surfactants.

Examples of the anionic surfactants include, for example, alkyl benzene sulfonate, α-olefin sulfonate, and phosphoester, and among there surfactants, preferred examples include surfactants having a fluoroalkyl group. Examples of the anionic surfactants having a fluoroalkyl group include, for example, a fluoroalkyl carboxylic acid or a metal salt thereof having 2 to 10 carbon atoms, perfluorooctanesulfonylglutamic acid disodium salt, sodium 3-[omega-fluoroalkyl (6 to 11 carbon atoms)oxy]-1-alkyl (3 to 4 carbon atoms) sulfonate, sodium 3-[omega-fluoroalkanoyl (6 to 8 carbon atoms)-N-ethylamino]-1-propanesulfonate, fluoroalkyl (11 to 20 carbon atoms) carboxylic acids or metal salts thereof, perfluoroalkyl carboxylic acids (7 to 13 carbon atoms) or metal salt thereof, perfluoroalkyl (4 to 12 carbon atoms) sulfonic acids or metal salts thereof, perfluorooctane sulfonic acid diethanolamide, N-propyl-N-(2-hydroxyethyl)perfluorooctane sulfonamide, perfluoroalkyl (6 to 10 carbon atoms) sulfonamide propyltrimethyl ammonium salts, perfluoroalkyl (6 to 10 carbon atoms)-N-ethylsulfonylglycin salts, and monoperfluoroalkyl (6 to 16 carbon atoms) ethylphosphate. Commercialized products of the surfactants having a fluoroalkyl group include, for example, SURFLON S-111, S-112, and S-113 (from Asahi Glass Co., Ltd.); FLUORAD FC-93, FC-95, FC-98, and FC-129 (from Sumitomo 3M Limited.); UNIDYNE DS-101 and DS-102 (from Daikin Industries, Ltd.); MEGAFAC F-110, F-120, F-113, F-191, F-812, and F-833 (from Dainippon Ink & Chemicals, Inc.); EKTOP EF-102, 103, 104, 105, 112, 123A, 123B, 306A, 501, 201, and 204 (from Tochem Products Co., Ltd.); and PHTHARGENT F-100 and F-150 (from Neos Co., Ltd.).

Examples of the cationic surfactants include, for example, amine salt-type surfactants and quaternary ammonium salt-type cationic surfactants. Examples of the amine salt-type surfactants include, for example, alkylamine salts, amino alcohol fatty acid derivatives, polyamine fatty acid derivatives, and imidazoline. Examples of the quaternary ammonium salt-type cationic surfactants include, for example, alkyltrimethylammonium salts, dialkyldimethylammonium salts, alkyldimethylbenzylammonium salts, pyridinium salts, alkylisoquinolinium salts, and benzethonium chloride. Among the cationic surfactants, preferred examples include aliphatic primary, secondary, or tertiary amine acids having a fluoroalkyl group, aliphatic quaternary ammonium salts such as perfluoroalkyl (6 to 10 carbon atoms) sulfonramide propyl trimethyl ammonium salts, benzalkonium salts, benzethonium chloride, pyridinium salts, and imidazolinium salts. Commercialized products of the cationic surfactants include, for example, SURFLON S-121 (from Asahi Glass Co., Ltd.); FLUORAD FC-135 (from Sumitomo 3M Limited.); UNIDYNE DS-202 (from Daikin Industries, Ltd.); MEGAFAC F-150 and F-824 (from Dainippon Ink & Chemicals, Inc.); EKTOP EF-132 (from Tochem Products Co., Ltd.); and PHTHARGENT F-300 (from Neos Co., Ltd.).

Examples of the non-ionic surfactants include, for example, fatty acid amide derivatives and polyhydric alcohol derivatives.

Examples of the amphoteric surfactants include, for example, alanine, dodecyldi (aminoethyl)glycine, di(octylaminoethyl)glycine, and N-alkyl-N,N-dimethyl ammonium betaine.

Examples of the poorly water-soluble inorganic compound dispersants include, for example, tricalcium phosphate, calcium carbonate, titanium oxide, colloidal silica, and hydroxyapatite.

Examples of the polymeric protective colloids include, for example, acids, (meth)acrylic monomers containing a hydroxyl group, vinyl alcohols or ethers from vinyl alcohols, esters of compounds containing vinyl alcohol and a carboxyl group, amide compounds or methylol compounds thereof, chlorides, homopolmers or copolymers having e.g. a nitrogen atom or a heterocycle thereof, polyoxyethylenes, and celluloses.

Examples of the acids include, for example, acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomers containing a hydroxyl group include, for example, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide. Examples of the vinyl alcohols or ethers from the vinyl alcohols include, for example, vinylmethylether, vinylethylether, and vinylpropylether. Examples of the esters of compounds containing vinyl alcohol and a carboxyl group include, for example, vinyl acetate, vinyl propionate, and vinyl butyrate. Examples of the amide compounds or methylol compounds thereof include, for example, acrylamide, methacrylamide, and diacetone acrylamide acid or methylol compounds thereof. Examples of the chlorides include, for example, acrylic acid chloride and methacrylic acid chloride. Examples of the homopolymers or copolymers having a nitrogen atom or a heterocycle include, for example, vinylpyridine, vinylpyrrolidone, vinylimidazole, and ethyleneimine. Examples of the polyoxyethylenes include, for example, polyoxyethylene, polyoxypropylene, polyoxyethylenealkylamine, polyoxypropylenealkylamine, polyoxyethylenealkylamide, polyoxypropylenealkylamide, polyoxyethylene nonylphenyl ether, polyoxyethylene laurylphenyl ether, polyoxyethylene stearylphenyl ether, and polyoxyethylene nonylphenyl ester. Examples of the cellulose include, for example, methyl cellulose, hydroxyethyl cellulose, and hydroxypropyl cellulose.

In the preparation of the dispersion, a dispersion stabilizer can be used, if necessary. Examples of the dispersion stabilizer include, for example, salts that are able to be dissolved in acids and alkalis, such as calcium phosphate salts.

When the dispersion stabilizer is used, the calcium phosphate salt can be removed from fine particles by a method such as a method of dissolving the calcium phosphate salt in an acid such as a hydrochloric acid and then washing the salt with water or a method of decomposing the salt with an enzyme.

In the preparation of the dispersion, catalysts for the elongation reaction or the cross-linking reaction can be used. Examples of the catalysts include, for example, dibutyl tin laurate and dioctyl tin laurate.

Furthermore, in order to lower the viscosity of the toner composition, a solvent can be also used in which the urea-modified polyester (i) or the prepolymer (A) is soluble. The use of the solvent is preferred in that the particle size distribution becomes sharp. The solvent is preferably volatile in terms of easy removal.

Examples of the solvent include, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. One of these solvents may be used by itself, or two or more thereof may be used in combination. Among these solvents, preferred are the aromatic solvents such as toluene and xylene; and the halogenated hydrocarbons such as methylene chloride, 1,2-dichloroethane, chloroform, and carbon tetrachloride, and the aromatic solvents such as toluene and xylene are more preferred.

The amount of the solvent used is preferably 0 parts by mass to 300 parts by mass, more preferably 0 parts by mass to 100 parts by mass, and further preferably 25 parts by mass to 70 parts by mass with respect to 100 parts by mass of the prepolymer (A). When the solvent is used, the solvent is removed by heating under ordinary pressure or reduced pressure after the elongation and/or cross-linking reaction.

The elongation and/or cross-linking reaction time is selected depending on the reactivity of the combination of the isocyanate group structure of the prepolymer (A) with the amines (B), and typically, preferably 10 minutes to 40 hours, more preferably 2 hours to 24 hours. The reaction temperature is preferably 0° C. to 150° C., and more preferably 40° C. to 98° C. Furthermore, known catalysts can be used, if necessary. Specifically, the catalysts include dibutyl tin laurate and dioctyl tin laurate.

In order to remove the organic solvent from the emulsified dispersion obtained, a method can be adopted in which the entire system is gradually heated up for complete evaporative removal of the organic solvent in droplets. In addition, it is also possible to spray the emulsified dispersion into a drying atmosphere to completely remove the water-insoluble organic solvent in droplets for the formation of toner fine particles, as well as to evaporate and remove the aqueous dispersion. As the drying atmosphere into which the emulsified dispersion is sprayed, gases obtained by heating air, nitrogen, carbon dioxide gas, combustion gas, etc., in particular, various gas flows heated to a temperature equal to or higher than the boiling point of the used solvent with the maximum boiling point are typically used. The intended quality is achieved adequately by a brief treatment with a spray dryer, a belt dryer, a rotary kiln, or the like.

When the cleaning and drying treatments are carried out while keeping the wide particle size distribution in the emulsification and dispersion, the particle size distribution can be adjusted by classification into a desired particle size distribution. The operation for classification can remove a fine-particle region through a cyclone, a decanter, centrifugation, or the like in a liquid.

The operation for classification may be carried out after obtaining a dried powder, but is carried out in a liquid preferably in terms of efficiency. The unnecessary fine particles or coarse particles obtained can be again returned at the kneading step, and used for the formation of particles. In that case, the unnecessary fine particles or coarse particles may have a wet state.

The dispersant used is preferably removed from the obtained dispersion as much as possible, and preferably removed at the same time as the previously described operation for classification.

The mixing of the dried toner powder obtained with heterogeneous particles such as release agent fine particles, charge controlling fine particles, fluidizer fine particles, and colorant fine particles, and the application of a mechanical impact force to the mixed powder can achieve immobilization or fusion at the surface to prevent desorption of the heterogeneous particles from the surfaces of complex particles obtained.

Specific methods include (1) a method of applying impact force to the mixture with the use of an impeller vane rotating at high speed, and (2) a method of putting the mixture into high-speed airflow to accelerate the mixture and cause the particles or complexed particles to collide with an appropriate collision plate. Apparatuses therefor include Angmill (from Hosokawa Micron Corporation), an apparatus with a grinding air pressure reduced by modifying I-type mill (from Nippon Pneumatic Mfg. Co., Ltd.), Hybridization System (from Nara Machinery Co., Ltd.), Kryptron System (from Kawasaki Heavy Industries, Ltd.), and automatic mortars.

In addition, as the colorant for use in the toner, pigments and dyes can be used which have been conventionally used as colorants for toners, and which give a color such as black, yellow, magenta, or cyan. It is to be noted to it is preferable to form full-color images with the use of at least four colors of black, yellow, magenta, and cyan.

The colorant is not particularly limited, which can be selected appropriately for any purpose from among known dyes and pigments, and specifically, carbon black, lampblack, iron black, ultramarine, nigrosine dyes, aniline blue, phthalocyanine blue, phthalocyanine green, Hansa Yellow G, rhodamine 6C lake, Calco Oil Blue, chrome yellow, quinacridone red, benzidine yellow, rose bengal, etc. can be used alone or in mixture.

The content of the colorant is not particularly limited, which can be selected appropriately for any purpose, but is preferably 1 part by mass to 15 parts by mass, more preferably 3 parts by mass to 10 parts by mass with respect to 100 parts by mass of the toner.

The colorant may be used as a masterbatch complexed with a resin. The resin is not particularly limited, which can be selected appropriately for any purpose from among known resins, and examples thereof include, for example, polymers of styrene or substitution products thereof, styrene copolymers, polymethylmethacrylate resins, polybutylmethacrylate resins, polyvinyl chloride resins, polyvinyl acetate resins, polyethylene resins, polypropylene resins, polyester resins, epoxy resins, epoxypolyol resins, polyurethane resins, polyamide resins, polyvinyl butyral resins, polyacrylic resins, rosin, modified rosin, terpene resins, aliphatic hydrocarbon resins, alicyclic hydrocarbon resins, aromatic petroleum resins, chlorinated paraffin, and paraffin. One of these resins may be used by itself, or two or more thereof may be used in combination.

Furthermore, if necessary, in order to provide the toner particles themselves with a magnetic property, known magnetic components, for example, iron oxides such as ferrite, magnetite, and maghemite; and metals such as iron, cobalt, and nickel or alloys of these metals with other metals may be contained alone or in mixture in the toner particles. In addition, these components can be also used as colorant components.

The content of the magnetic substance is not particularly limited, which can be selected appropriately for any purpose, but is preferably 10 parts by mass to 200 parts by mass with respect to 100 parts by mass of the binder resin, and more preferably 20 parts by mass to 150 parts by mass.

In addition, the number average particle size of the colorant in the toner for use in embodiments of the present invention is preferably 0.5 μm or less, more preferably 0.4 μm or less, and further preferably 0.3 μm or less. The number average particle size in excess of 0.5 μm may fail to reach a sufficient level of pigment dispersibility, and fail to achieve preferred transparency. On the other hand, colorants of tiny particle sizes smaller than 0.1 μm in number average particle size are sufficiently smaller than the half wavelengths of visible light, and thus believed to adversely affect reflection and absorption characteristics of light. Therefore, the colorant particles less than 0.1 μm in number average particle size contribute to favorable color reproducibility and the transparency of OHP sheets with fixed images. On the other hand, when there is a lot of colorant of particle sizes larger than 0.5 μm in number average particle size, there is a tendency for the transmission of incident light to be inhibited or scattered to decrease the brightness and vividness of projection images on OHP sheets. Furthermore, when there is a lot of colorant of particle sizes larger than 0.5 μm, the colorants may be desorbed from the toner particle surfaces to cause various problems such as fogging, contaminated drum, and defective cleaning. The colorant of particle sizes larger than 0.7 μm in number average particle size is preferably 10 number % or less of, and more preferably 5 number % or less of the total colorant.

In addition, when the colorant is kneaded with all or part of the binder resin after adding a wetting liquid in advance, the binder resin is initially attached adequately to the colorant, the colorant is dispersed more effectively in the toner particles in the subsequent toner production step, the colorant dispersed is reduced in particle size, and further favorable transparency can be obtained.

While the resins exemplified as binder resins for toners can be directly used as the binder resin for use in the kneading in advance, the binder resin is not to be considered limited to these resins.

As a specific method for kneading the mixture of the binder resin and colorant in advance along with a wetting liquid, for example, the binder resin, the colorant, and the wetting liquid are mixed in a blender such as a Henschel mixer, and the obtained mixture is then kneaded by a kneader such as a two-roll or three-roll kneader at a temperature lower than the softening temperature of the binder resin to obtain a sample.

In addition, as the wetting liquid, common liquid can be used in consideration of the solubility of the binder resin and the wettability thereof with the colorant, while organic solvents such as acetone, toluene, and butanone, and water are preferred in terms of the dispersibility of the colorant. Among these liquids, the use of water is particularly preferred in terms of environmental consciousness and of maintenance of dispersion stability for the colorant in the subsequent toner production step.

This manufacturing method not only reduces the particle sizes of the colorant particles contained in the toner obtained, but also increases the uniformity of the dispersed state of the particles, thus further improving color reproducibility for projection images through OHPs.

The toner contains therein a wax (release agent) for providing a mold release property, in addition to the binder resin and the colorant. The wax preferably has a melting point of 40° C. to 160° C., and particularly preferably 50° C. to 120° C. The melting point less than 40° C. may adversely affect the heat-resistance storage stability, whereas the melting point in excess of 160° C. may be likely to cause cold offset in fixing at low temperatures.

The melt viscosity of the wax is preferably 5 cps to 1000 cps, and more preferably 10 cps to 100 cps at a temperature 20° C. higher than the melting point. The melt viscosity in excess of 1000 cps may diminish the improvement effect on the resistance to hot offset and the low-temperature fixing.

The content of the wax in the toner is preferably 0 mass % to 40 mass %, and more preferably 3 mass % to 30 mass %. In the case of the wax content in excess of 40 mass %, the wax deposition on the image surface after the fixing step may excessively increase to repel an ultraviolet curable composition and an ultraviolet curable pressure-sensitive composition as is described later, or impair the adhesion at the interface between the toner and the ultraviolet curable composition and ultraviolet curable pressure-sensitive composition.

It is to be noted that the detachment can also be favorably carried out with the toner containing the wax.

Examples of the wax can include animal-derived waxes (e.g. beeswax, spermaceti wax, shellac wax), plant-derived waxes (e.g. carnauba wax, Japan wax, rice bran wax, candelilla wax), mineral-derived waxes (e.g. montan wax, ozokerite), and petroleum-derived waxes (e.g. paraffin wax, microcrystalline wax), and the petroleum-derived waxes are preferred because of their high mold release abilities. Examples of the petroleum-derived waxes can include paraffin wax and microcrystalline wax, and two or more of the wax may be used in mixture. In particular, the mixture of the waxes which are different in melting point lowers the malting point as the entire wax, thus improving the mold release property, which is preferable. The microcrystalline wax contains components isoparaffin and cycloparaffin, and thus has relatively small crystals. Therefore, the wax on the oilless fixed image is likely to be dispersed, rather than uniformly present, and the values of Ab/Aa and Ab'/Aa' of the oilless fixed image can be thus reduced.

As the wax, isoparaffin that is a hydrocarbon component is preferably contained at 10 mass % or more, in terms of adhesion to energy-ray curable precursors for electrophotography (ultraviolet curable composition precursors).

The molecular weight of the wax is not particularly limited, which can be selected appropriately for any purpose, but the component which contribute to the adhesion of energy-ray curable precursors for electrophotography preferably has a higher molecular weight, and a molecular weight closer to the higher molecular weight. Specifically, the average molecular weight is preferably 500 or more in terms of adhesion to energy-ray curable precursors for electrophotography. The isoparaffin in mass % in the wax and the average molecular weight of the wax can be measured, for example, by a FD (Field Desorption) method with the use of JMS-T100GC "AccuTOFGC".

In addition, in order to quickly adjust the amount and rise of toner charging, the toner may contain therein a charge controlling agent, if necessary. Colorless or nearly white materials are preferred, because the use of a colored material as the charge controlling agent produces a change in color.

The charge controlling agent is not particularly limited, which may provide any of positive and negative charges, and can be selected appropriately for any purpose from among known agents, and examples thereof include, for example, triphenylmethane dyes, molybdic acid chelate pigments, rhodamine dyes, alkoxy amines, quaternary ammonium salts (including fluorine-modified quaternary ammonium salts), alkylamides, a phosphorus element or phosphorus compounds, a tungsten element or tungsten compounds, fluorine-based activators, and metal salts of salicylic acid and metal salts of salicylic acid derivatives.

Commercialized products can be used as the charge controlling agent, and examples of the commercialized products include, for example, BONTRON P-51 of a quaternary ammonium salt, E-82 of a metal complex with an oxynaphthoic acid, E-84 of a metal complex with a salicylic acid, and E-89 of a phenolic condensation product (all from ORIENT CHEMICAL INDUSTRIES CO., LTD.); molybdenum complexes with quaternary ammonium salts TP-302 and TP-415 (all from Hodogaya Chemical Co., Ltd.); Copy Charge PSYVP2038 of a quaternary ammonium salt, Copy Blue PR of a triphenylmethane derivative, Copy Charge NEGVP2036 of a quaternary ammonium salt, and Copy Charge NXVP434 (all from Hoechst Ltd.); LRA-901 and LR-147 that is a boron complex (all from Japan Carlit Co., Ltd.); and quinacridone, azo pigments, and polymeric compounds having functional groups such as other sulfonic acid groups, carboxyl groups, and quaternary ammonium salts.

The additive amount of the charge controlling agent differs depending on the toner production method including the type of the binder resin, the presence or absence of additives, and the dispersion method, which is not to be considered able to be unambiguously defined, but is preferably 0.1 parts by mass to 10 parts by mass, and more preferably 0.2 parts by mass to 5 parts by mass with respect to 100 parts by mass of the binder resin. The additive amount in excess of 10 parts by mass may, because of the excessively charged toner, diminish the effect of the charge controlling agent, and increase the force of electrostatic attraction between the toner and development roller, thereby leading to the decreased fluidity of the developer and the decreased image density. These charge controlling agents can be melted and kneaded along with the masterbatch and the resins, and then dissolved and dispersed, may be dissolved directly in an organic solvent, and added for dispersion, or may be immobilized after preparing toner particles at the toner surface.

In addition, resin fine particles mainly for dispersion stabilization may be added in dispersing the toner composition into the aqueous medium in the process of the toner production.

For the resin fine particles, any resin can be used as long as the resin can form an aqueous dispersion, which may be a thermoplastic resin or a thermosetting resin, and examples thereof include, for example, vinyl resins, polyurethane resins, epoxy resins, polyester resins, polyamide resins, polyimide resins, silicon-based resins, phenolic resins, melamine resins, urea resins, aniline resins, ionomer resins, and polycarbonate resins. One of these resins may be used by itself, or two or more thereof may be used in combination. Among these resins, the vinyl resins, polyurethane resins, epoxy resins, and polyester resins, or the use thereof in combination are preferred in that an aqueous dispersion of fine spherical resin particles is likely to be obtained.

As the vinyl resins, polymers are used which are obtained by the simple polymerization or copolymerization of vinylic monomers, and examples of the polymers include, for example, styrene-(meth)acrylic acid ester resins, styrene-butadiene copolymers, (meth)acrylic acid-acrylic acid ester polymers, styrene-acrylonitrile copolymers, styrene-maleic anhydride copolymers, and styrene-(meth)acrylic acid copolymers.

Inorganic fine particles are preferred as an external additive for aiding the fluidity, development, and charging characteristics of the toner particles.

Examples of the inorganic fine particles include, for example, silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, and silicon nitride.

The inorganic fine particles are preferably 5 nm to 2 μm, and more preferably 5 nm to 500 nm in primary particle size. In addition, the inorganic fine particles preferably have a specific surface area of 20 $m^2/g$ to 500 $m^2/g$ by the BET method. The additive amount of the inorganic fine particles in the toner is preferably 0.01 mass % to 5 mass %, and more preferably 0.01 mass % to 2.0 mass %.

Other polymeric fine particles include, for example, polystyrenes, methacrylic acid ester and acrylic acid ester copolymers obtained by soap-free emulsion polymerization, suspension polymerization, or dispersion polymerization, a polycondensation system such as silicone, benzoguanamine, and nylon, and polymer particles from thermosetting resins.

In addition, a fluidizer can be also added to the toner. The fluidizer can, through a surface treatment, increase hydrophobicity, and prevent flow characteristics and charging characteristics from being deteriorated even under high humidity. Examples of the fluidizer include, for example, silane coupling agents, silylation agents, silane coupling agents having an alkyl fluoride group, organic titanate-based coupling agents, aluminum-based coupling agents, silicon oils, and modified silicon oils.

In addition, examples of cleaning improvers include, for example, metal salts of fatty acids such as zinc stearate, calcium stearate, and stearic acid; and polymer fine particles produced by soap-free emulsion polymerization or the like, such as polymethylmethacrylate fine particles and polystyrene fine particles. The polymer fine particles preferably have a relatively narrow particle size distribution, and a volume average particle size of 0.01 μm to 1 μm.

The use of such a toner can form high-quality toner images which have excellent stability in development as described above.

Further, the image forming apparatus according to embodiments of the present invention can be not only used in combination with toners obtained by polymerization methods, which are configured to be suitable for obtaining high-quality images as described above, but also applied to amorphous toners obtained by grinding methods, and also in this case, the apparatus lifetime can be substantially extended. As the materials constituting such toners obtained by grinding methods, materials that are used as toners for electrophotography are typically applicable without any particular limitation.

Examples of binder resins for use in the toners obtained by grinding methods include, for example, homopolymers of styrene or substitution products thereof such as polystyrene, poly-p-chlorostyrene, and polyvinyl toluene; styrene copolymers such as styrene/p-chlorostyrene copolymers, styrene/propylene copolymers, styrene/vinyl toluene copolymers, styrene/vinylnaphthalene copolymers, styrene/methyl methacrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/α-methyl chloromethacrylate copolymers, styrene/acrylonitrile copolymers, styrene/methyl vinyl ketone copolymers, styrene/butadiene copolymers, styrene/isoprene copolymers, and styrene/maleic acid copolymers; acrylic acid ester homopolymers or copolymers thereof such as poly(methyl acrylate), poly(butyl acrylate), poly(methyl methacrylate), and poly(butyl methacrylate); polyvinyl derivatives such as polyvinyl chloride and polyvinyl acetate; and polyester copolymers, polyurethane copolymers, polyamide copolymers, polyimide copolymers, polyol copolymers, epoxy copolymers, terpene copolymers, aliphatic or alicyclic hydrocarbon resins, and aromatic petroleum resins. One of these resins may be used by itself, or two or more thereof may be used in combination. Among these resins, the styrene-acrylic copolymer resins, polyester resins, and polyol resins are preferred in terms of electrical properties and cost, and furthermore, the polyester resins and polyol resins are particularly preferred because of having favorable fixing properties.

For the toners obtained by grinding methods, these resin components, as well as the colorant component, wax component, charge controlling component, etc. as described above may be premixed, if necessary, then kneaded at near or lower than the softening temperatures of the resin components, cooled, and then subjected to a grinding classification step to prepare toners, and if necessary, the external components may be appropriately added thereto and mixed.

Examples of melt kneaders include, for example, uniaxial continuous kneaders, biaxial continuous kneaders, and batch-type kneaders with roll mills. For examples, a KTK-type biaxial kneader from Kobe Steel, Ltd., a TEM-type extruder from Toshiba Machine Co., Ltd., a biaxial extruder from KCK, a PCM-type biaxial extruder from Ikegai Iron Works Co., Ltd., a co-kneader from Buss, etc. are preferably used. This melt kneading is preferably under proper conditions so as not to give rise to cutting of molecular chains in the binder resin. Specifically, the melt kneading temperature is determined by reference to the softening point of the binder resin, and the cutting may be severely caused at an excessively higher temperature than the softening point, whereas the dispersion may not progressed at an excessively low temperature.

In the grinding described previously, the kneaded product obtained by the kneading described previously is subjected to grinding. In this grinding, the kneaded product is preferably first subjected to coarse grinding, and then fine grinding. In this regard, a method is preferably used in which the kneaded product is subjected to grinding by collision with a collision plate in a jet stream, to grinding by collision of particles with each other in a jet stream, or to grinding in the gap between a rotor and a stator which are mechanically rotated.

In the classification mentioned previously, the ground product obtained by the grinding described previously is classified to make an adjustment to particles of predetermined particle size. The classification can be carried out by removing fine particles through, for example, a cyclone, a decanter, centrifugation.

After the grinding and classification described previously, the ground product is classified by a centrifugal force or the like into airflow to produce a toner of predetermined particle size.

Besides, toners can be also produced by a suspension polymerization method or an emulsion polymerization method.

—Suspension Polymerization Method—

In the suspension polymerization method, with a colorant, a wax, etc. dispersed in an oil-soluble polymerization initiator and a polymerizable monomer, emulsification and dispersion are carried out by an emulsification method as described later in an aqueous medium containing a surfactant, other solid dispersant, etc. Thereafter, a polymerization reaction is developed to form particles and obtain the toner.

Functional groups can be introduced to the toner particle surfaces by using, as the polymerizable monomer, for example, some of acids such as acrylic acid, methacrylic acid, α-cyanoacrylic acid, α-cyanomethacrylic acid, itaconic acid, crotonic acid, fumaric acid, maleic acid, or maleic anhydride; acrylamide, methacrylamide, diacetone acrylamide, or methylol compound thereof; and acrylates and methacrylates having an amino group such as vinylpyridine, vinylpyrrolidone, vinylimidazole, ethyleneimine, and dimethylaminoethyl methacrylate.

In addition, the selection of, as the dispersant used, a dispersant having an acidic group or a basic group can achieve the dispersant adsorbed and left on the toner surface, and introduce the functional group.

—Emulsion Polymerization Method—

As the emulsion polymerization method, a water-soluble polymerization initiator and a polymerizable monomer are emulsified in water with the use of a surfactant, and subjected to a normal approach of emulsion polymerization to synthesize latex. Separately, a dispersion is prepared which has a colorant, a wax, etc. dispersed in an aqueous medium, and mixed with the latex and subsequently aggregated into a toner size, and subjected to fusion by heating to obtain a toner. Functional groups can be introduced to the toner surface with the use of, as the latex, the same monomers as the monomers for use in the suspension polymerization method.

The development device may be a dry development type or wet development type of instrument, and a monochromatic development device or a multi-color development device, and preferred examples of the instrument include, for example, an instrument including an agitator for frictionally agitating and charging the toner or the developer, and a rotatable magnet roller.

In the development device, for example, the toner and the carrier are mixed and agitated, the toner is charged by the friction, and held in an erect ear fashion on the surface of the rotating magnet roller to form a magnetic brush. The magnet roller is placed near the image bearing body (photoreceptor), and the toner constituting the magnetic brush formed on the surface of the magnet roller is partially moved by an electric attractive force to the surface of the image bearing body (photoreceptor). As a result, the electrostatic latent image is developed with the toner to form a visible image (toner image) with the toner on the surface of the image bearing body (photoreceptor).

While the developer contained in the development device is a developer containing the toner, the developer itself may be a one-component developer or a two-component developer.

<Transfer Step and Transfer Unit>

The transfer step is a step of transferring the toner image to the recording medium, an embodiment thereof is preferred in which an intermediate transfer body is used to carry out primary transfer of the toner image onto the intermediate transfer body, and then secondary transfer of the toner image onto the recording medium, and an embodiment is more preferred which includes a primary transfer step of transferring the toner image onto the intermediate transfer body to form a composite transferred image, with the use of, as the toner, a toner of two or more colors, preferably a full-color toner; and a second transfer step of transferring the composite transferred image onto the recording medium.

The transfers can be carried out by, for example, charging the toner image or the image bearing body (photoreceptor) with the use of a transfer charger, and can be carried out with the transfer unit. As the transfer unit, an embodiment is preferred which includes a primary transfer unit for transferring a visible image onto an intermediate transfer body to form a composite transferred image, and a secondary transfer unit for transferring the composite transferred image onto the recording medium.

It is to be noted that the intermediate transfer body is not particularly limited, which can be selected appropriately for any purpose from among known transfer bodies, and preferred examples thereof include, for example, a transfer belt.

—Intermediate Transfer Body—

The intermediate transfer body preferably exhibits a conductivity of $1.0\times10^{5}$ Ω·cm to $1.0\times10^{11}$ Ω·cm in volume resistance. In the case of the volume resistance below $1.0\times10^{5}$ Ω·cm, the toner image disturbed with discharge, so-called transfer dust may be caused in the transfer of the toner image from the photoreceptor onto the intermediate transfer body, whereas in the case of the volume resistance above $1.0\times10^{11}$ Ω·cm, after transferring the toner image from the intermediate transfer body to the recording medium such as a paper sheet, counter charge of the toner image may remain on the intermediate transfer body, and appear as a residual image on the next image.

As the intermediate transfer body, for example, a belt-like or cylindrical plastic can be used which is obtained in such a way that metal oxides such as tin oxide and indium oxide, conductive particles such as carbon black, and conductive polymers are used alone or in combination for kneading with a thermoplastic resin, and then subjected to extrusion. Besides, a resin liquid containing a thermally cross-linking monomer or oligomer can be also, with the addition of the above-mentioned conductive particles and conductive polymers thereto, if necessary, subjected to centrifugal molding while heating to obtain an intermediate transfer body on an endless belt.

The intermediate transfer body may be provided with a surface layer, and preferably, is appropriately subjected to a resistance adjustment with the use of a conductive substance.

The transfer unit (the primary transfer unit, the secondary transfer unit) preferably includes a transfer equipment for detaching and charging, to the recording medium side, the visible image formed on the image bearing body (photoreceptor). The transfer unit may be one transfer unit, or may have two or more transfer units.

Examples of the transfer equipment include corona transfer equipments with corona discharge, transfer belts, transfer rollers, pressure transfer rollers, and adhesive transfer equipments. It is to be noted that while the recording medium is not particularly limited, which can be selected appropriately from among known recording media (recording sheets of paper), the recording medium itself is preferably white in consideration of use as direct mails, and the recording medium surface preferably has a coat layer of white pigment such as calcium carbonate, talc, and kaolin. The size of the white pigment is 0.1 μm or more, and preferably 0.5 μm to 5 μm in average particle size. The white pigment less than 0.1 μm in average particle size provides a layer of the white pigment with an extremely low strength, and severely causes powder dropping from the white pigment and cracks in a layer thereof, and the image is likely to be peeled when the detachment is carried out.

The layer of the white pigment is preferably 1 μm or more, and preferably 1.5 μm to 3 μm or more in thickness, in order to maintain the appreciated appearance of the information sheet.

<Fixing Step and Fixing Unit>

The fixing step is a step of fixing the toner image transferred to the recording medium with the use of the fixing unit, which may be carried out for each color of toner transferred to the recording medium, or at a time for respective colors of toners stacked.

The fixing unit is not particularly limited, and known heating and pressing unit can be used as the fixing unit. The heating and pressing units include a combination of a heating roller and a pressing roller, and a combination of a heating roller, a pressing roller, and an endless belt.

The toner particles preferably fall within the range of $10^{3}$ Pa·s or more and $10^{4}$ Pa·s or less through heating and pressing in the fixing unit.

The neutralization step is a step of applying a neutralization bias to the image bearing body for carrying out neutralization, which can be carried out with the neutralization unit in a preferred manner.

The neutralization unit is not particularly limited, which may be any unit as long as the unit can apply a neutralization bias to the image bearing body, and which can be selected appropriately from among known neutralization equipments, and preferred examples thereof include, for example, neutralization lamps.

The cleaning step is a step of removing the toner for electrophotography, which remains on the image bearing body, which can be carried out with the cleaning unit in a preferred manner.

The cleaning unit is preferably provided downstream of the transfer unit and upstream of the charger.

The cleaning unit is not particularly limited, which may be any unit as long as the unit can remove the toner remaining on the image bearing body, and which can be selected appropriately from among known cleaners, and preferred examples thereof include, for example, magnetic brush cleaners, static brush cleaners, magnetic roller cleaners, blade cleaners, brush cleaners, and web cleaners.

The recycle step is a step of recycling the toner removed in the cleaning step for the development unit, which can be carried out with the recycle unit in a preferred manner.

The recycle unit is not particularly limited, and examples thereof include known conveying units.

The control unit is a step of controlling the respective steps, which can be carried out with the control unit in a preferred manner.

The control unit is not particularly limited as long as the unit can control the movements of the respective units described previously, which can be selected appropriately for any purpose, and examples thereof include, for example, equipments such as sequencers and computers.

<Step of Applying and Curing Ultraviolet Curable Composition (Applying and Curing Step) and Unit for Applying and Curing Ultraviolet Curable Composition (Applying and Curing Unit)>

The ultraviolet curable composition can be applied onto the recording medium with the toner image borne thereon at any appropriate time after the fixing step. For example, the ultraviolet curable composition can be applied immediately after the formation of the toner image as in an in-line coating apparatus in which printing and coating are carried out with the same printing device, or applied on the recording medium with the toner image borne thereon after a short or long delay time after printing as in an off-line coating apparatus in which printing and coating are carried out with different printing devices. Furthermore, the ultraviolet curable composition can be applied to cover the entire recording medium, the entire toner image, a portion of the recording medium, or a portion of the toner image. Depending on the use application, the printing surface can be protected, or provided with gloss. For bending or folding as is described later, the ultraviolet curable composition precursor is preferably not applied to the bent or folded section in order to reduce the burden on the bent or folded section.

In order to apply the ultraviolet curable composition, liquid film coating equipments can be used, including roll coaters, flexo coaters, rod coaters, blades, wire bars, air knives, curtain coaters, slide coaters, doctor knives, screen coaters, gravure coaters (for example, offset gravure coaters), slot coaters, and extrusion coaters, ink-jet coaters. Such equipments can be used in known methods such as, for example, forward- and reverse-rotation roll coating, offset gravure, curtain coating, lithographic printing, screen coating, gravure coating, and ink-jet coating.

The applied thickness of the ultraviolet curable composition is not particularly limited, which can be selected appropriately for any purpose, but is preferably 1 μm to 15 μm. The applied thickness less than 1 μm may cause repelling or result in insufficient gloss, whereas the thickness in excess of 15 μm may degrade the texture of the image.

After the application step, the ultraviolet curable composition applied is preferably cured.

The ultraviolet curable pressure-sensitive composition can be cured by irradiating the composition with light (mainly ultraviolet light) from a light source.

The light source is not particularly limited, which can be selected appropriately for any purpose, and examples thereof include, for example, low-pressure mercury lamps, medium-pressure mercury lamps, high-pressure mercury lamps, ultra-high pressure mercury lamps, xenon lamps, carbon-arc lamps, metal halide lamps, fluorescent lamps, tungsten lamps, argon ion laser, helium-cadmium laser, helium-neon laser, krypton ion layer, various types semiconductor lasers, YAG laser, light-emitting-diodes, CRT light sources, plasma light sources, electron beams, γ ray, ArF excimer laser, KrF excimer laser, and $F_2$ laser.

Figure 5:
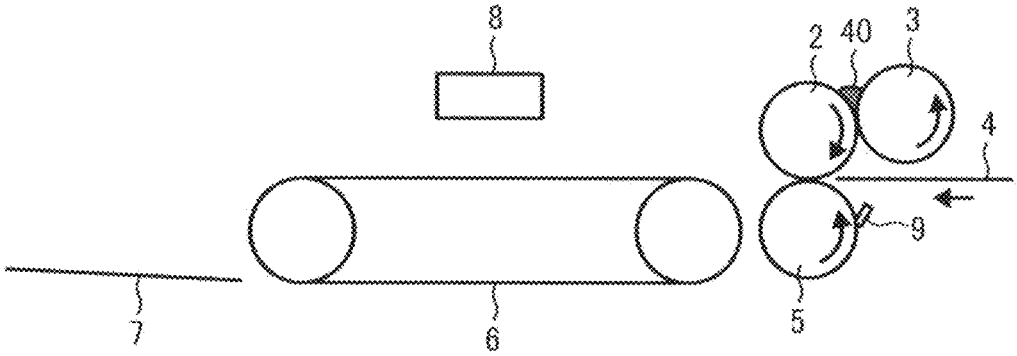
FIG. 5 is a schematic view of an example of a unit for applying and curing an ultraviolet curable (pressure-sensitive) composition for use in an apparatus for producing a detachable information sheet according to an embodiment of the present invention.

FIG. 5 shows an example of the application unit. The application unit in FIG. 5 includes an application roller 2, a metal roller 3, a pressure-welding roller 5, a conveying belt 6, a tray 7, a light source 8, and a scraper 9. The ultraviolet curable composition 40 is accumulated between the application roller 2 and the metal roller 3.

The recording medium 4 with the toner image formed thereon passes between the application roller 2 and the pressure-welding roller 5 while abutting the rotating application roller 2 and pressure-welding roller 5. In that regard, the ultraviolet curable composition 40 is applied to the recording medium 4 by the transfer of the ultraviolet curable composition 40 on the surface of the application roller 2 to the recording medium 4.

The recording medium 4 with the ultraviolet curable composition 40 applied thereon is conveyed by the conveying belt 6 to pass under the light source 8. In that regard, the ultraviolet curable composition 40 applied to the recording medium 4 is cured with ultraviolet light from the light source 8. Thereafter, the recording medium 4 is transferred onto the tray 7.

The unnecessary ultraviolet curable composition 40 adhering to the pressure-welding roller 5 is removed by the scraper 9.

The same step and unit as for the ultraviolet curable composition are adopted for the step of applying and curing the ultraviolet curable pressure-sensitive composition and the unit for applying and curing the ultraviolet curable pressure-sensitive composition.

—Ultraviolet Curable Composition and Ultraviolet Curable Pressure-Sensitive Composition—

Examples of the constituents of the ultraviolet curable composition and ultraviolet curable pressure-sensitive composition include a polymerizable oligomer, a polymerizable unsaturated compound, a photopolymerization initiator, a sensitizer, a polymerization inhibitor, and a surfactant.

—Polymerizable Oligomer—

The polymerizable oligomer is not particularly limited, which can be selected appropriately for any purpose, and examples thereof include, for example, polyester acrylates, epoxy acrylates, and urethane acrylates.

The polyester acrylates are not particularly limited, which can be selected appropriately for any purpose, and examples thereof include, for example, acrylic acid esters of polyester polyols, which are obtained from polyhydric alcohols and polybasic acids. The polyester acrylates exhibit excellent reactivity.

The epoxy acrylates are not particularly limited, which can be selected appropriately for any purpose, and examples thereof include, for example, epoxy acrylates obtained by reactions of bisphenol-type epoxy, novolac-type epoxy, alicyclic epoxy, etc. with acrylic acids. The epoxy acrylates are excellent in hardness, flexibility, and curability.

The urethane acrylates are not particularly limited, which can be selected appropriately for any purpose, and examples thereof include, for example, urethane acrylates obtained by reacting polyester polyols, polyether polyols, and the like with acrylic acid esters having diisocyanate and hydroxyl groups. The use of the urethane acrylates can provide flexible and tough films.

One of the polymerizable oligomers may be used by itself, or two or more thereof may be used in combination.

The contents of the polymerizable oligomers in the ultraviolet curable composition and ultraviolet curable pressure-sensitive composition are not particularly limited, which can be selected appropriately for any purpose, but are preferably 5 mass % to 60 mass %, more preferably 10 mass % to 50 mass %, and particularly preferably 20 mass % to 45 mass %. The contents less than 5 mass % may cause defective curing, excessively lower the viscosity, or impair the flexibility after curing, whereas the contents in excess of 60 mass % may decrease the adhesion or excessively increase the viscosity. The contents in the particularly preferable range are advantageous in terms of proper viscosity, curability, as well as the flexibility and strength of a coating layer of the ultraviolet curable composition after curing.

—Polymerizable Unsaturated Compound—

The polymerizable unsaturated compound is not particularly limited, which can be selected appropriately for any purpose, and examples thereof include, for example, monofunctional polymerizable unsaturated compounds, difunctional polymerizable unsaturated compounds, trifunctional polymerizable unsaturated compounds, and tetrafunctional polymerizable unsaturated compounds.

The monofunctional polymerizable unsaturated compounds include, for example, 2-ethylhexyl acrylate, 2-hydroxyethyl acrylate, 2-hydroxypropyl acrylate, benzyl acrylate, phenyl glycol monoacrylate, and cyclohexyl acrylate.

The difunctional polymerizable unsaturated compounds include, for example, 1,4-butanediol acrylate, 1,6-hexanediol diacrylate, 1,9-nonanediol diacrylate, tripropylene glycol diacrylate, and tetraethylene glycol diacrylate.

The trifunctional polymerizable unsaturated compounds include, for example, trimethylolpropane triacrylate, pentaerythritol triacrylate, and tris(2-hydroxyethyl)isocyanurate triacrylate.

The tetrafunctional polymerizable unsaturated compounds include, for example, pentaerythritol tetraacrylate, ditrimethylolpropane tetraacrylate, dipentaerythritol hydroxypentaacrylate, and dipentaerythritol hexaacrylate.

Materials which have are high in melting ability include 1,6-hexanediol diacrylate, ethylcarbitol acrylate, and acryloylmorpholine. Because the respective materials differ in melting ability, there is a need to tune each of the additive amounts thereof. However, there is a possibility that the excessively low additive amounts may cause defective adhesion, whereas the excessively high additive amounts may disturb the image.

One of the polymerizable unsaturated compounds may be used by itself, or two or more thereof may be used in combination.

The contents of the polymerizable unsaturated compounds in the ultraviolet curable composition and ultraviolet curable pressure-sensitive composition are not particularly limited, which can be selected appropriately for any purpose, but are preferably 35 mass % to 90 mass %, more preferably 40 mass % to 85 mass %, and particularly preferably 45 mass % to 75 mass %. The contents less than 35 mass % may excessively increase the viscosity, whereas the contents in excess of 90 mass % may cause defective curing, excessively decrease the viscosity, or impair the flexibility after curing. The contents in the particularly preferable range are advantageous in terms of proper viscosity, curability, as well as a coating layer of the ultraviolet curable composition after curing.

The multifunctional compounds are higher in curing rate than the monofunctional compounds, and suitable in the case of high-speed fixing, but undergo a substantial volume shrinkage. In the case of polymerizable unsaturated compounds which are substantially shrunk by a curing reaction, polymerizable unsaturated compounds which are low in volume shrinkage percentage as much as possible, and polymers thereof are desirably used, because the compounds are likely to be curled.

The polymerizable unsaturated compounds preferably have a volume shrinkage percentage of 15% or less.

The P.I.I. (skin irritation) of the polymerizable unsaturated compounds and of the polymerizable oligomers is not particularly limited, which can be selected appropriately for any purpose, but is preferably 1.0 or less. The P.I.I. of 5.0 or greater may cause a problem with safety because of excessive skin irritation.

In addition, the hues of the polymerizable unsaturated compounds and of the polymerizable oligomers are preferably close to colorless and transparent as much as possible, and preferably 2 or less in the Gardner gray scale. The Gardner gray scale in excess of 2 may change the color of the image area, and may cause the background area to undergo a noticeable color change in some cases.

—Photopolymerization Initiator—

The photopolymerization initiator is not particularly limited, which can be selected appropriately for any purpose, and examples thereof include, for example, benzophenone, benzoin ethyl ether, benzoin isopropyl ether, and benzyl. Commercialized products can be used can be used as the photopolymerization initiator. The photopolymerization initiators as commercialized products include, for example, IRGACURE 1300, IRGACURE 369, and IRGACURE 907 from Ciba Specialty Chemicals Inc.; and LUCIRIN TPO from BASF.

When a mixture of the polymerizable oligomer or the polymerizable unsaturated compound with the photopolymerization initiator is irradiated with ultraviolet light UV, the photopolymerization initiator generate radicals as indicated in the following formulas (I) and (II). The radicals develop an addition reaction to polymerizable double bonds of the polymerizable oligomer or the polymerizable unsaturated compound. Further radicals are generated by the addition reaction to repeat an addition reaction to other double bonds of the polymerizable oligomer or the polymerizable unsaturated compound, thereby causing a polymerization reaction to proceed as in the following formula (III).

(I) Hydrogen Abstraction Type
[Chemical Formula 1]

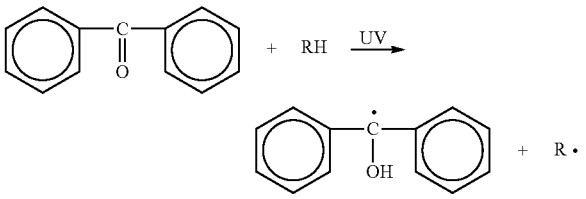

(II) Photofragmentation Type
[Chemical Formula 2]

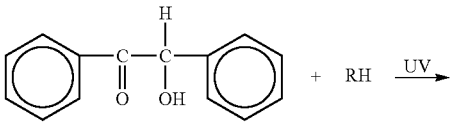

-continued

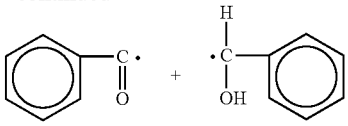

(III) Polymerization
[Chemical Formula 3]

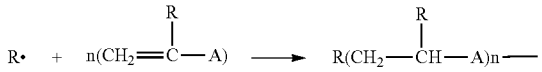

The photopolymerization initiator preferably have favorable properties such as: (i) high efficiency of ultraviolet absorption; (ii) high solubility in the polymerizable oligomer or the polymerizable unsaturated compound; (iii) low odor, yellowing, and toxicity; and (iv) no dark reaction caused.

The contents of the polymerizable oligomers in the ultraviolet curable composition and ultraviolet curable pressure-sensitive composition are not particularly limited, which can be selected appropriately for any purpose, but are preferably 1 mass % to 10 mass %, and more preferably 2 mass % to 5 mass %.

—Sensitizer—

In the case of using the hydrogen abstraction-type benzophenone-based photopolymerization initiator of the formula (I), an amine-based sensitizer is preferably used in combination to increase the reactivity, because the reaction may be retarded only with the photopolymerization initiator.

The amine-based sensitizer contained has the effect of supplying hydrogen to the photopolymerization initiator by the hydrogen abstraction effect, and the effect of preventing the reaction inhibition by oxygen in the air. The amine-based sensitizer is not particularly limited, which can be selected appropriately for any purpose, and examples thereof include, for example, triethanolamine, triisopropanolamine, 4,4-diethylaminobenzophenone, 2-dimethylaminoethyl benzoic acid, 4-dimethylamino ethyl benzoate, and 4-dimethylamino isoamyl benzoate.

The content of the sensitizer in the ultraviolet curable composition and ultraviolet curable pressure-sensitive composition is not particularly limited, which can be selected appropriately for any purpose, but is preferably 1 mass % to 15 mass %, and more preferably 3 mass % to 8 mass %.

—Polymerization Inhibitor—

The polymerization inhibitor is used for enhancing the storage stability of the ultraviolet curable composition and ultraviolet curable pressure-sensitive composition.

The polymerization inhibitor is not particularly limited, which can be selected appropriately for any purpose, and examples thereof include, for example, 2,6-ditert-butyl-p-cresol (BHT), 2,3-dimethyl-6-tert-butylphenol (IA), anthraquinone, hydroquinone (HQ), and hydroquinone monomethyl ether (MEHQ).

The content of the polymer inhibitor in the ultraviolet curable composition and ultraviolet curable pressure-sensitive composition is not particularly limited, which can be selected appropriately for any purpose, but is preferably 0.5 mass % to 3 mass %.

—Surfactant—

The surfactant contained in the ultraviolet curable composition and ultraviolet curable pressure-sensitive composition provides an adsorption property at the interface between the toner and the ultraviolet curable composition and ultraviolet curable pressure-sensitive composition, and reduces the surface tension of the ultraviolet curable composition and ultraviolet curable pressure-sensitive composition to improve wettability.

The surfactant is not particularly limited, which can be selected appropriately for any purpose, and examples thereof include, for example, anionic surfactants, non-ionic surfactants, silicone surfactants, and fluorosurfactants.

The anionic surfactants include, for example, sulfosuccinates, disulfonates, phosphoesters, sulfates, sulfonates and mixtures thereof.

The non-ionic surfactants include, for example, polyvinyl alcohol, polyacrylic acid, isopropyl alcohol, diols of acetylene series, ethoxylated octylphenol, ethoxylated branched secondary alcohols, perfluorobutanesulfonates, and alkoxylated alcohols.

The silicone surfactants include, for example, polyether-modified polydimethylsiloxane.

The fluorosurfactants include, for example, ethoxylated nonylphenol.

The content of the surfactant in the ultraviolet curable composition and ultraviolet curable pressure-sensitive composition is not particularly limited, which can be selected appropriately for any purpose, but is preferably 0.1 mass % to 5 mass %, and more preferably 0.5 mass % to 3 mass %. The content less than 0.1 mass may fail to achieve wettability, whereas the content in excess of 5 mass % may impair curability. The content in the more preferred range is advantageous in that the wettability is improved.

The other constituents further include leveling agents, matting agents, waxes for adjusting film properties, and tackifiers for improving the adhesion to the recording medium such as polyolefin and PET, which do not inhibit polymerization.

In addition, it is preferable to contain a polymer that is able to compatible with the polymerizable oligomer and the polymerizable unsaturated compound. The existence of this polymer can ensure pressure bonding for the production of a protectant sheet, due to the fact that the pressure bonding eliminates the breakage or movement of the energy-ray curable pressure-sensitive composition layer. Preferred examples of the polymer include, as the most preferred examples, meth(acrylic) copolymers which have a weight average molecular weight of 10,000 to 100,000 and a glass transition temperature of −60° C. to 20° C., because the copolymers have high compatibility with the polymerizable oligomer and the polymerizable unsaturated compound, and favorable pressure bondability and also favorable detachability.

The (meth)acrylic copolymers in embodiments of the present invention are obtained by the polymerization of a monomer component of an acrylic acid alkylester or a methacrylic acid alkylester, with the use of an organic solvent as a polymerization solvent.

Examples of the acrylic acid alkylester or methacrylic acid alkylester include, for example, methyl(meth)acrylate, ethyl (meth)acrylate, n-butyl(meth)acrylate, i-butyl(meth)acrylate, t-butyl(meth)acrylate, 2-ethylhexyl(meth)acrylate, lauryl(meth)acrylate, stearyl(meth)acrylate, cyclohexyl(meth) acrylate, n-decyl(meth)acrylate, and glycol di(meth)acrylate, for example, ethylene glycol di(meth)acrylate, butylene glycol di(meth)acrylate, and 1,6-hexanediol di(meth)acrylate.

In the production of the (meth)acrylic copolymer, if necessary, it is possible to copolymerize ethylenically unsaturated monomers which are copolymerizable with (meth) acrylic acid esters, for example, ethylenically unsaturated monomers containing a carboxylic acid such as an acrylic acid, a methacrylic acid, and an itaconic acid; and hydroxyalkyl meth(acrylates), for example, 2-hydroxymethyl meth (acrylate), 2-hydroxyethyl meth(acrylate), and 2-hydroxymethyl meth(acrylate); and alkylamino (meth)acrylates, for example, dimethylaminoethyl(meth)acrylate, and diethylaminoethyl(meth)acrylate; and ethylenically unsaturated monomers having a functional group, such as methoxyethyl (meth)acrylate, ethoxyethyl(meth)acrylate, and glycidyl (meth)acrylate, (meth)acrylonitrile, and (meth)acrylamide, vinyl acetate, vinyl propionate, styrene, α-methylstyrene, etc.

As the polymerization solvent for the (meth)acrylic copolymers, respective organic solvents are able to be used, and examples of the solvents include, for example, alcohols such as methyl alcohol, ethyl alcohol, n-propyl alcohol, i-propyl alcohol, n-butyl alcohol, and i-butyl alcohol; cellosolves such as cellosolve acetate, methyl cellosolve, ethyl cellosolve, n-butyl cellosolve, i-butyl cellosolve, and n-propyl cellosolve; propylene glycol ethers such as propylene glycol-n-butyl ether, propylene glycol methyl ether, propylene glycol phenyl ether, dipropylene glycol methyl ether, and propylene glycol methyl ether acetate; toluene, ethyl acetate, butyl acetate, acetone, methyl ethyl ketone, aromatic (oil fraction) solvents, phthalate ester plasticizers, and alkyl phosphate esters.

In the preparation of the varnish composition (ultraviolet curable composition), a solution of the (meth)acrylic copolymer (B) dissolved in the solvent may be directly blended, and in that case, the solvent may be finally removed from the composition.

The (meth)acrylic copolymers synthesized as described previously can find particularly effective uses in the specific range of the molecular weight and the specific range of the glass transition temperature.

The (meth)acrylic copolymers need to have a weight average molecular weight of 10,000 to 100,000, preferably 20,000 to 50,000.

This constituent will, if the weight average molecular weight is less than 10,000, fail to exhibit moderate detachability or bondability, because of lack of cohesion and poor bondability.

In addition, this constituent will, if the weight average molecular weight exceeds 100,000, decrease the compatibility with the polymerizable oligoner and the polymerizable unsaturated compound.

In such a case, there is a need to use a large amount of diluent for blending the constituent in the polymerizable oligomer and the polymerizable unsaturated compound, thereby leading to the curing rate decreased by ultraviolet light and the decreased surface gloss, and increasing the health problems and problems with the Fire Service Act due to the work environment deteriorated by the solvent.

Next, the glass transition temperatures of the (meth)acrylic copolymers need to fall within the range of −60° C. to 20° C., preferably −50° C. to 10° C.

This constituent will, if the glass transition temperature is lower than −60° C., fail to achieve a sufficient bonding strength, because the constituent is strongly sticky.

In addition, this constituent (B) will, if the glass transition temperature is higher than 20° C., fail to achieve the detachability and bondability.

The glass transition temperature in embodiments of the present invention refers to a second-order transition point measured with a common polymer as described, for example, on p. 110 to p. 115 of "Acrylic Acid Esters and Polymers thereof" written by Eizo OMORI, published by SHOKODO Co., Ltd., and in the case of a copolymer, refers to a calculated glass transition temperature as described on p. 120 of the document.

The (meth)acrylic copolymers described above have favorable compatibility with the polymerizable oligomer and the polymerizable unsaturated compound, and can provide an ultraviolet curable varnish composition with the constituent (B) uniformly dissolved therein.

While the blending proportion of the (meth)acrylic copolymers to the polymerizable oligomer and the polymerizable unsaturated compound is not to be considered particularly limited, the particularly preferable range is 5 parts by weight to 80 parts by weight with respect to 100 parts by weight in total of the polymerizable oligomer and the polymerizable unsaturated compound.

When the blending proportion is less than 5 parts by weight, the varnish composition may fail to provide adequate detachability and bondability, or weaken the adhesion in some cases.

In addition, when this proportion exceeds 80 parts by weight, the obtained varnish composition will become increasingly sticky, and decrease the intrinsic gloss of the varnish, and there is a possibility that a paper sheet will be torn during detachment due to excessively strong adhesion, or coated paper sheet will also lack blocking resistance.

It is to be noted that the blending proportion (parts by weight) of this constituent refers to the quantity of only the copolymer component, excluding the solvent, etc. used for the polymerization.

The (meth)acrylic copolymers according to embodiments of the present invention are uniformly compatible with the other constituents in the composition, and present in a solution state, thus producing excellent gloss on the coating surface, and providing blocking resistance in atmospheres under normal living environments.

In the case of mutually attaching varnish composition surfaces applied onto paper sheet surfaces and cured, and for example, using a combination of pressing at a line pressure on the order of 10 kg/cm to 50 kg/cm or a line pressure on the order of 0.1 kg/cm to 10 kg/cm with heating at a temperature of 50° C. to 150° C. as physical conditions for attachment to each other, the constituent is deposited on the surfaces to form adhesive layers on the surfaces of the varnish coating layers, and allow for detachable bonding between the varnish composition surfaces.

The bonding strength is able to be appropriately adjusted by the selection of the physical conditions and the blending proportion of the constituent as described previously, and the respective changes in glass transition temperature and average molecular weight, and moderate detachability can be provided to be lower than the bonding strength between printed surface and the varnish surface, without damaging the surfaces during detachment.

The viscosity of the ultraviolet curable composition and ultraviolet curable pressure-sensitive composition is not particularly limited, which can be selected appropriately for any purpose, but the viscosity at 25° C. is preferably 10 mPa·s to 800 mPa·s. The viscosity less than 10 mPa·s, or in excess of 800 mPa·s may make it difficult to control the applied thickness.

The viscosity can be measured by, for example, a B-type viscometer (from Toyo Seiki Seisaku-sho, Ltd.).

While the ultraviolet curable composition and the ultraviolet curable pressure-sensitive composition can be created even from oily compositions with the use of a solvents, the case of ultraviolet curable (photo-curable) compositions with the use of UV is preferred in terms of ensuring safety, environmental protection, energy conservation, and high productivity.

<Folding Step and Pressure Bonding Step and Folding Unit and Pressure Bonding Unit>

In the case of using the ultraviolet curable pressure-sensitive composition, after the applying and curing step, cutting into a desired size, if necessary, is followed by a folding step of applying, for example, double folding (V folding) or triple folding (Z folding) to attach the worked surfaces of the ultraviolet curable pressure-sensitive composition to each other. The surfaces of the ultraviolet curable pressure-sensitive composition are attached to each other by pressure bonding with a roller to provide a bonded product with detachability. The amount of pressure for pressure bonding typically falls within the range of 50 N/cm$^2$ to 1000 N/cm$^2$.

As just described, when one sheet is folded and subjected to pressure bonding, the productivity is increased.

It is to be noted that the ultraviolet curable pressure-sensitive composition is preferably not applied to folded section, because the folded section is not damaged when detachment is carried out.

<Heating and Pressing Step and Heating and Pressing Unit>

The heating and pressing step in an embodiment of the present invention is carried out as the next step after the step of applying and curing the ultraviolet curable composition. In the case of the ultraviolet curable pressure-sensitive composition, the heating and pressing step may be carried out as the next step after the step of applying and curing the ultraviolet curable pressure-sensitive composition, or as the next step after the folding step or the pressure bonding step. In the next step after the folding step, the worked surfaces of the ultraviolet curable pressure-sensitive composition are not damaged or contaminated because the component parts for the heating and pressing step are not brought into contact with the worked surfaces. In addition, when the worked surfaces of the ultraviolet curable pressure-sensitive composition are provided with tackiness, there is a possibility of decreased conveying performance, but the decrease can be prevented. In the next step after the pressure bonding step, the worked surfaces of the ultraviolet curable pressure-sensitive composition are bonded, thus allowing for conveying in any direction of the recording medium, and further making the conveying easier to be designed.

The fixing step and the fixing unit may be also used for the heating and pressing step and the heating and pressing unit. The heating and pressing can be carried out with the use of the same fixing unit, for example, by after the fixing step, repeating again the fixing step in such a manner as in place of printing on a white paper sheet (however, no phenomenon is caused such as fixing the toner or the like, because of going through no new development step or the like). Alternatively, a fixing step in such an image forming process as addressing rather than printing on a white paper sheet may be used in place of the heating and pressing step.

In addition, the function of the heating and pressing unit may be added to the pressure bonding step and the pressure bonding unit.

However, there is a need to set the heating temperature and the welding pressure more easily than the fixing step and the fixing unit, because of conveying after the folding step. In addition, in the case of adding the function of the heating and pressing unit to the pressure bonding step and the pressure bonding unit, there is a need to set a balance between the welding pressure and the heating temperature, because the welding pressure is significantly higher than in the fixing step and the fixing unit.

When the heating and pressing step is carried out as the same time in the pressure bonding step, the productivity is improved dramatically, while the volume expansion of a pressure bonding roller in the pressure bonding apparatus on heating may become problematic because of the extremely high pressure in the pressure bonding step, and the maintenance of the apparatus is likely to be complicated.

In the case of carrying out the heating and pressing step after the pressure bonding step described previously, the apparatus is small in size, low in cost, and also high in durability, because of the lower pressure than in the pressure bonding step.

When the ultraviolet curable composition is the ultraviolet curable pressure-sensitive composition, it is preferable to carry out pressure bonding while applying a temperature equal to or higher than the softening temperature of the toner, or to apply a temperature equal to or higher than the softening temperature of the toner after pressure bonding, because the increased strength between the toner image layer and the loading material of paper, as well as the increased strength of the loading material layer of paper allow detachment in a favorable manner.

It is to be noted that the application of the temperature equal to or higher than the softening temperature of the toner after pressure bonding can be achieved by providing the heating and pressing unit downstream of the pressure bonding unit, and applying the temperature equal to or higher than the softening temperature of the toner.

Figure 6:
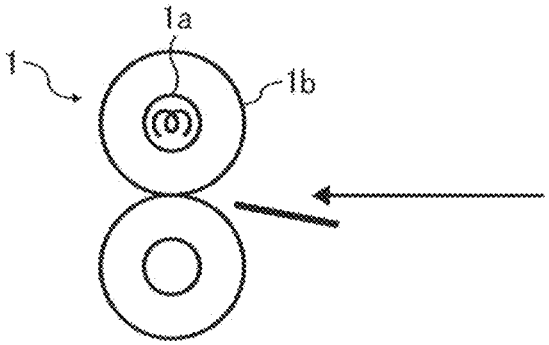
FIG. 6 is a schematic view of an example of a heating and pressing device for use in an apparatus for producing a detachable information sheet according to an embodiment of the present invention.

FIG. 6 shows a configuration example of a heating and pressing device which is applicable to an apparatus for producing a detachable information sheet according to an embodiment of the present invention.

In FIG. 6, the heating and pressing device serving as a heating and pressing unit is driven, for example, with the recording medium or the folded or bent recording medium sandwiched between a pair of hating and pressing rolls driven at constant speed.

Figure 7:
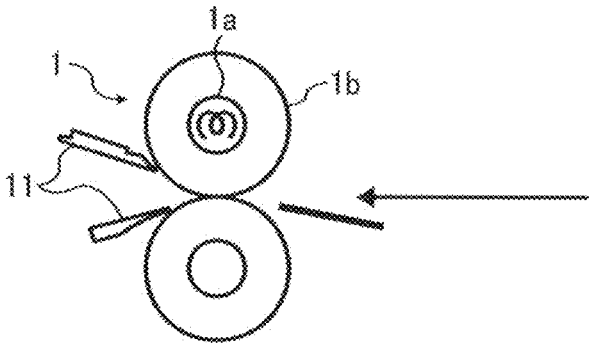
FIG. 7 is a schematic view of another example of a heating and pressing device for use in an apparatus for producing a detachable information sheet according to an embodiment of the present invention.

In this case, one or both of the hating and pressing rolls are, for example, an equipment provided therein with a heat source, the surface thereof is heated to a temperature at which the toner is melted, and the two hating and pressing rolls are subjected to pressure welding. Preferably, one or both of the hating and pressing rolls have a surface provided with a silicon rubber or fluorine-containing rubber layer, and the length of the region heated and pressed preferably falls within the range on the order of 1 mm to 8 mm. In addition, as shown in FIG. 7, separation claws may be provided, which can suppress the phenomenon of following the heating and pressing rolls.

In addition, the toner particles preferably fall within the range of $10^3$ Pa·s or more and $10^6$ Pa·s or less through the heating and pressing.

In the case of the viscosity less than $10^3$ Pa·s, due to the excessively melted toner particles, the toner particles may move in the ultraviolet curable composition to disturb the image in some cases. In addition, in the case of the viscosity in excess of $10^6$ Pa·s, due to the insufficiently melted toner, and the ultraviolet curable composition released insufficiently from the toner, the adhesion the toner and paper may be insufficient in some cases.

It is to be noted that the viscosity can be measured at an angular velocity of 1 rad/sec with the use of a rotational plate-type rheometer (from Rheometric: RDA II).

In the measuring instrument, the toner is softened and melted for the measurement, with the actual equipment assumed for the setting of the temperature and pressure. In embodiments of the present invention, the viscosity of the toner in the process of melting is measured because the toner moves in the ultraviolet curable composition to disturb the image.

As for the setting of the actual equipment assumed, more specifically, the heating temperature preferably falls within a range in which the toner is not completely melted, whereas the pressure for pressing preferably falls within a range in which the toner is not spread because the excessively high pressure spreads the toner, and the heating temperature is 80° C. to 230 C, whereas the pressure for pressing is 5 N/cm$^2$ to 200 N/cm$^2$.

<Relationship Between Wax and Present Invention>

Furthermore, the inventors have explored in detail the phenomenon of the energy-ray curable precursor spreading on the toner image subjected to oilless fixing, and found that the area where the energy-ray curable precursor is likely to spread is not uniformly present, but a solid area where there is the toner image and where the toner image has a large area. Thus, a cross section of the solid area of the toner image subjected to oilless fixing has been observed under an electron microscope to find that the wax in the toner covers most of the toner image surface.

Furthermore, in the case of the energy-ray curable pressure-sensitive adhesive layer provided on the toner image subjected to oilless fixing, an area where the energy-ray curable pressure-sensitive adhesive layer is likely to be peeled is an area with the toner image, and in particular, in a solid area (in particular, red, blue, and green areas) with large amounts of toner adhesion, the layer is most likely to be peeled.

Thus, the inventors have observed, with an electron microscope, the energy-ray curable pressure-sensitive adhesive layer provided on the solid area of the toner image subjected to oilless fixing, and an interface of the energy-ray curable pressure-sensitive adhesive layer. Then, the inventors have found that there is an area with the wax present at the interface of the energy-ray curable pressure-sensitive adhesive layer, and that the energy-ray curable pressure-sensitive adhesive layer is slightly floated in the area with the wax present. More specifically, it has been found that with the increased number of areas with the wax in contact with the energy-ray curable pressure-sensitive adhesive layer, the adhesion is decreased between the energy-ray curable pressure-sensitive adhesive and the oilless fixed image.

From the foregoing, it is determined the presence of the wax over a large area on the toner image subjected to oilless fixing disturbs adhesion with the energy-ray curable pressure-sensitive adhesive layer, and it has been found that it is not possible to provide any highly durable energy-ray curable pressure-sensitive adhesive layer unless the oilless fixed toner image has a small amount of wax on the toner image surface.

The inventors have, based on whether or not an oilless fixed image can be specified where the energy-ray curable pressure-sensitive adhesive layer can be provided in a preferred fashion, measured the surface of the oilless fixed toner image by an ATR method, and explored the measured IR spectrum in detail. Then, the inventors have found that the ratio Ab/Aa between the peak area Aa from 2896 cm$^{-1}$ to 2943 cm$^{-1}$ and the peak area Ab from 2946 cm$^{-1}$ to 2979 cm$^{-1}$ can specify an oilless fixed toner image where the energy-ray curable pressure-sensitive adhesive layer can be provided in a preferred fashion, thereby achieving the present invention.

Figure 8:
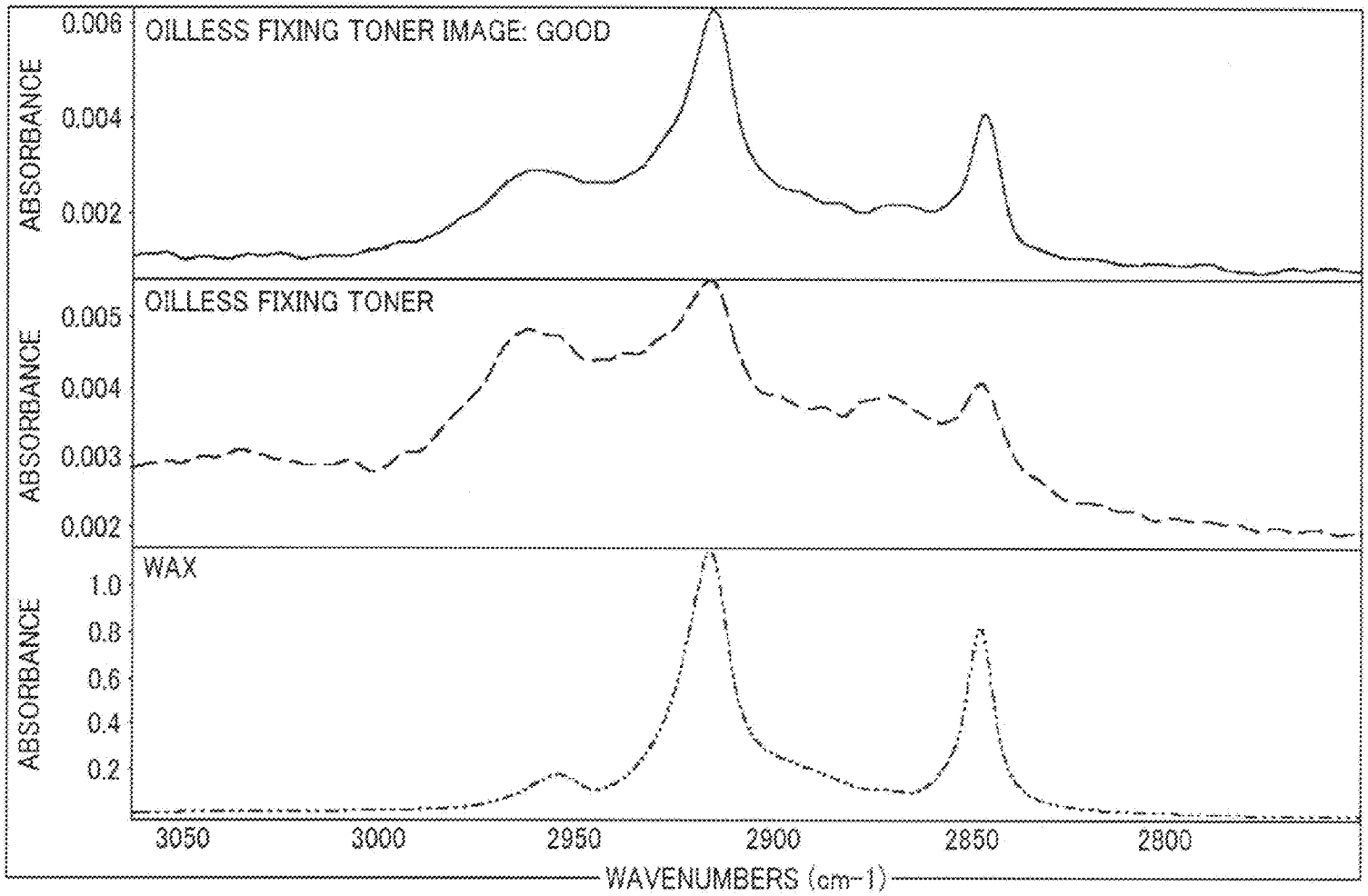
FIG. 8 is a chart of spectra obtained by an attenuated total reflectance (ATR) method for an oilless fixed toner image, a toner for oilless fixing, and a wax for use in the toner for oilless fixing.

FIG. 8 is a chart of spectra obtained by an ATR method (crystal: Ge, incident angle: 45°, single reflection) for an oilless fixed toner image, a toner for oilless fixing, and a wax for use in the toner for oilless fixing.

In FIG. 8, the toner for oilless fixing and the wax both have the peak from 2896 cm$^{-1}$ to 2943 cm$^{-1}$ and the peak from 2946 cm$^{-1}$ to 2979 cm$^{-1}$. However, as for the wax, the peak from 2896 cm$^{-1}$ to 2943 cm$^{-1}$ is extremely strong, whereas the peak from 2946 cm$^{-1}$ to 2979 cm$^{-1}$ is extremely small. On the other hand, as for the toner for oilless fixing, the peak from 2896 cm$^{-1}$ to 2943 cm$^{-1}$ is not particularly high as compared with the peak from 2946 cm$^{-1}$ to 2979 cm$^{-1}$.

Figure 9:
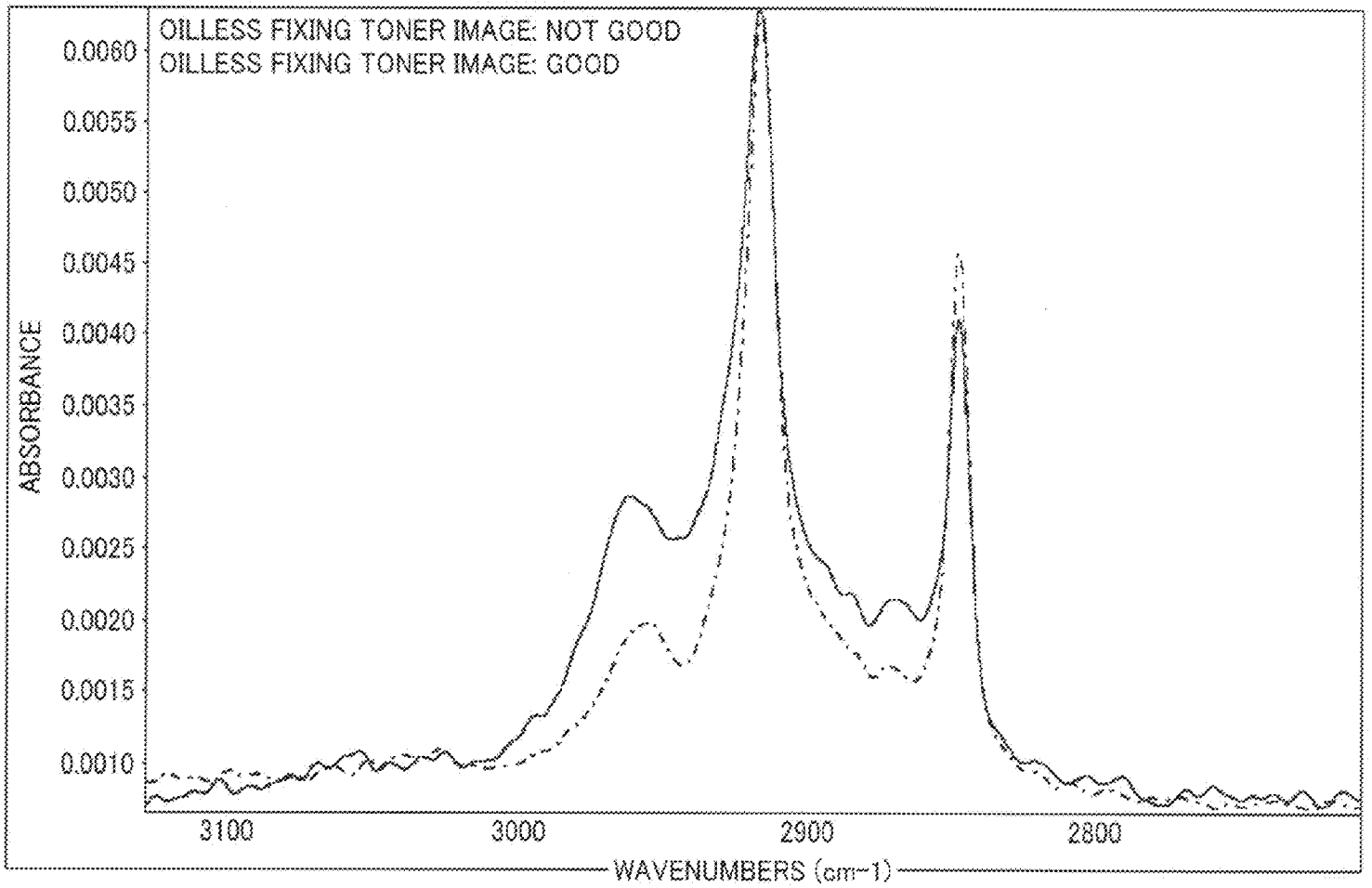
FIG. 9 is a chart of an infrared spectroscopy (IR) spectrum in a case in which good adhesion is obtained between a toner image and an energy-ray curable pressure-sensitive adhesive layer in an oilless fixed toner image, and an IR spectrum in a case in which good adhesion is not obtained therebetween.

FIG. 9 is a chart of an IR spectrum (solid line) in a case in which good adhesion is obtained between a toner image and an energy-ray curable pressure-sensitive adhesive layer in an oilless fixed toner image, and an IR spectrum (dashed line) in a case in which good adhesion is not obtained therebetween. More specifically, FIG. 9 is a chart of IR spectrum for the oilless fixed toner image with favorable adhesion to the energy-ray curable pressure-sensitive adhesive layer, and for a solid area of the oilless fixed toner image with poor adhesion thereto.

It is determined that the peak from 2896 cm$^{-1}$ to 2943 cm$^{-1}$ is relatively higher as compared with the peak from 2946 cm$^{-1}$ to 2979 cm$^{-1}$ in the oilless fixed toner image with poor adhesion to the energy-ray curable pressure-sensitive adhesive layer.

In embodiments of the present invention, the ratio Ab/Aa between the peak area Aa from 2896 cm$^{-1}$ to 2943 cm$^{-1}$ and the peak area Ab from 2946 cm$^{-1}$ to 2979 cm$^{-1}$ is regarded as an indicator of the wax amount on the toner image surface, and the ratio Ab/Aa is preferably 3.0 to 7.0, and further preferably 3.3 to 6.6. As the ratio Ab/Aa has a larger value, the wax amount is increased, and the ratio Ab/Aa is preferably higher for the original purpose of oilless fixing itself. However, in embodiments of the present invention, the ratio Ab/Aa higher than 7.0 results in poor adhesion between the energy-ray curable pressure-sensitive adhesive layer and the oilless fixed toner image, and just lightly rubbing the energy-ray curable pressure-sensitive adhesive layer unfavorably peels the energy-ray curable pressure-sensitive adhesive layer from the oilless fixed toner image. The ratio Ab/Aa lower than 3.0 unfavorably results in a poor mold release property between the fixing roller and the image, thereby failing to obtain a high-quality image.

In addition, the inventors have, based on whether or not an oilless fixed image can be specified where the energy-ray curable pressure-sensitive adhesive layer can be provided in a preferred fashion, measured the surface of the oilless fixed image, the toner, and the wax for use in oilless fixing by an ATR method (crystal: Ge, incident angle: 45°, single reflection), and explored the measured IR spectra in detail. Then, it has been determined that the peak from 2834 cm$^{-1}$ to 2862 cm$^{-1}$, detected from the oilless fixed toner image, is a main peak for the wax, and only slightly detected from the toner.

Figure 10:
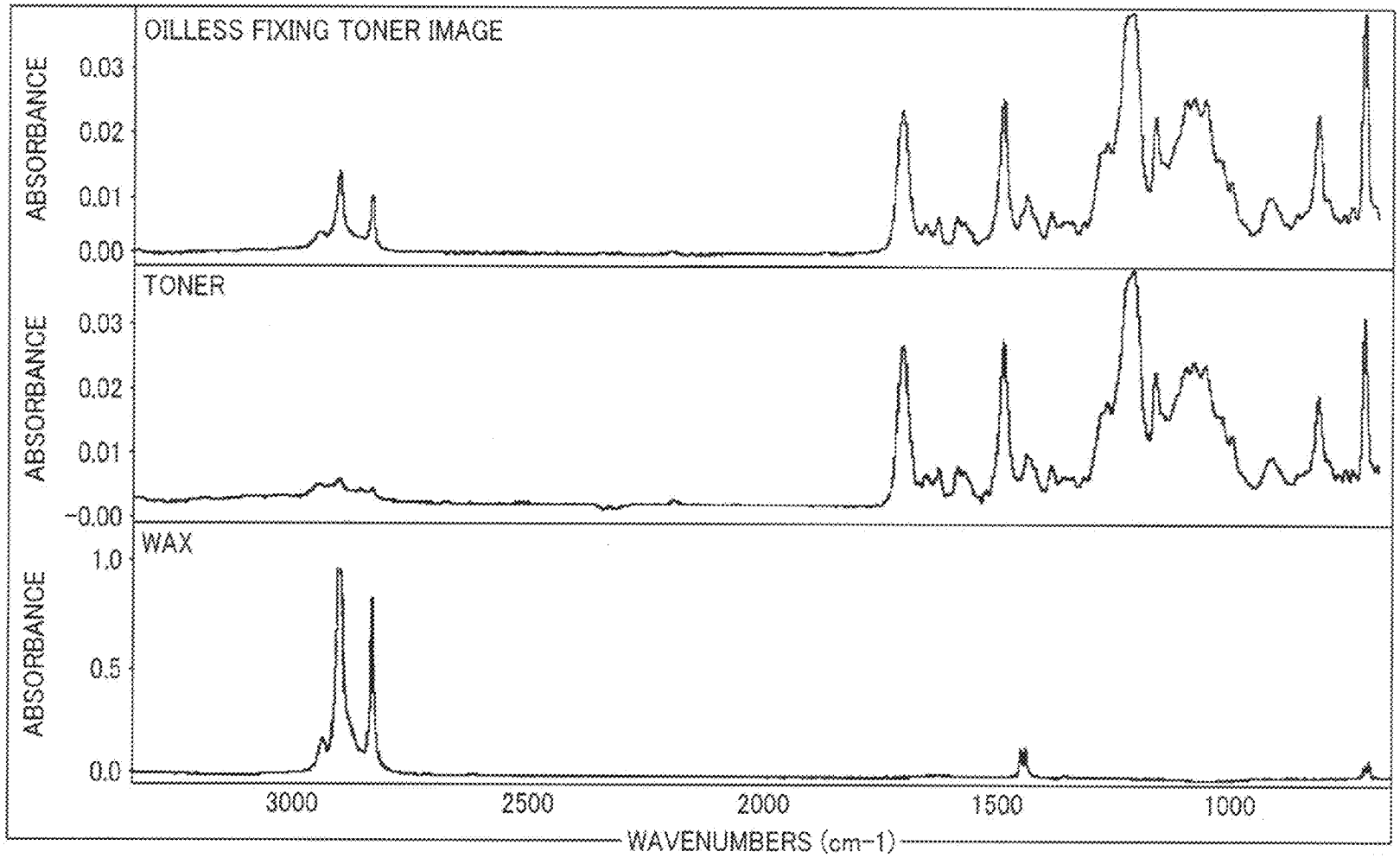
FIG. 10 is a chart of spectra obtained by an ATR method for an oilless fixed toner image, a toner for oilless fixing, and a wax for use in the toner for oilless fixing.

FIG. 10 is a chart of spectra obtained by an ATR method (crystal: Ge, incident angle: 45°, single reflection) for an oilless fixed toner image, a toner for oilless fixing, a wax for use in the toner for oilless fixing.

In the ATR method, with the high refractive-index Ge in close contact with a measurement sample, an evanescent wave is used to make the measurements. Therefore, the measurement region (depth) is different for each substance, and the measurement depth is shallower with the increase in wave number, and deeper with the decrease in wave number.

Due to the fact that the spectrum for the oilless fixed toner image on the lower wave number side is approximately the same as the spectrum for the toner, it has been determined the wax is dispersed and diluted in the state of the toner, but eccentrically located on the image surface in the case of the oilless fixed image. Accordingly, it has been found that the normalization of the peak from 2834 $cm^{-1}$ to 2862 $cm^{-1}$ can specify the amount of the wax on the surface of the oilless fixed toner image.

While any peak on the lower wave number side may be used for the peak for the normalization of the peak from 2834 $cm^{-1}$ to 2862 $cm^{-1}$, silica, titanium oxide, and metal soap as external additives for the toner may vary in adhesion amount for each oilless fixed toner image, depending on the conditions of the photoreceptor, charging roller, cleaning blade, etc. With a peak close to the peak of such a substance, the peak from 2834 $cm^{-1}$ to 2862 $cm^{-1}$ is not able to be normalized stably. The peak from 791 $cm^{-1}$ to 860 $cm^{-1}$ is a peak for a polyester that is commonly used as a matrix resin for toner, not a peak for the external additives. Furthermore, the peak from 791 $cm^{-1}$ to 860 $cm^{-1}$ is measured down to a depth region as described previously, and thus an appropriate peak for normalizing the peak from 2834 $cm^{-1}$ to 2862 $cm^{-1}$ for the wax present only on the surface of the oilless fixed toner image. The inventors have found that these findings can actually specify an oilless fixed toner image where the energy-ray curable pressure-sensitive adhesive layer can be provided in a preferred fashion, thereby achieving the present invention.

Figure 11:
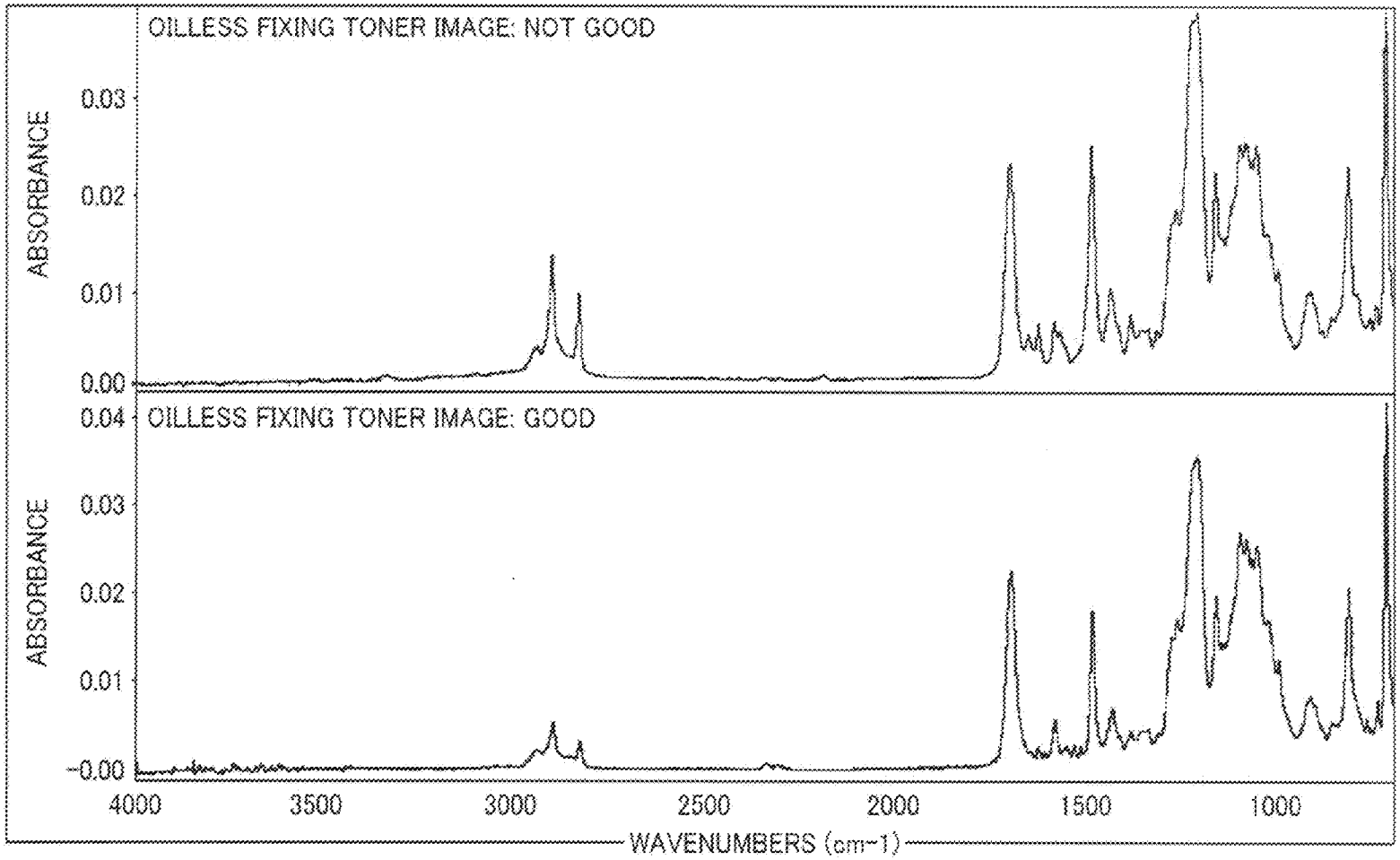
FIG. 11 is a chart of an IR spectrum in a case in which good adhesion is obtained between a toner image and an energy-ray curable pressure-sensitive adhesive layer in an oilless fixed toner image, and an IR spectrum in a case in which good adhesion is not obtained therebetween.

FIG. 11 is a chart of an IR spectrum in a case in which good adhesion is obtained between a toner image and an energy-ray curable pressure-sensitive adhesive layer in an oilless fixed toner image, and an IR spectrum in a case in which good adhesion is not obtained therebetween. More specifically, FIG. 11 is a chart of IR spectrum for the oilless fixed toner image with favorable adhesion to the energy-ray curable pressure-sensitive adhesive layer, and for a solid area of the oilless fixed toner image with poor adhesion thereto.

It is determined that the peak from 2834 $cm^{-1}$ to 2862 $cm^{-1}$ for the oilless fixed image with poor adhesion to the energy-ray curable pressure-sensitive adhesive layer is larger as compared with the oilless fixed toner image with favorable adhesion thereto.

In embodiments of the present invention, the ratio Ab'/Aa' between the peak area Aa' from 791 $cm^{-1}$ to 860 $cm^{-1}$ and the peak area Ab' from 2834 $cm^{-1}$ to 2862 $cm^{-1}$ is regarded as an indicator of the wax amount on the toner image surface, and the ratio Ab'/Aa' is 0.0040 to 0.0140, and further preferably 0.0045 to 0.0120. As the ratio Ab'/Aa' has a larger value, the wax amount is increased, and the ratio Ab'/Aa' is preferably higher for the original purpose of oilless fixing itself. However, in embodiments of the present invention, the ratio Ab'/Aa' higher than 0.0140 results in poor adhesion between the energy-ray curable pressure-sensitive adhesive layer and the oilless fixed toner image, and just lightly rubbing the energy-ray curable pressure-sensitive adhesive layer unfavorably peels the energy-ray curable pressure-sensitive adhesive layer from the oilless fixed toner image. The ratio Ab'/Aa' lower than 0.0040 unfavorably results in a poor mold release property between the fixation and the image, thereby failing to obtain a high-quality image.

In this disclosure, the ratio Ab/Aa or Ab'/Aa' is specified in the area with the largest amount of toner adhesion in the oilless fixed toner image for the following reason.

The wax which decreases the adhesion between the energy-ray curable pressure-sensitive adhesive layer and the oilless fixed toner image is supplied only from the toner. Therefore, the area with the largest amount of wax in the oilless fixed toner image is an area with the largest amount of toner adhesion, that is, the solid area of the toner image.

In general, four colors of black, magenta, cyan, and yellow are used for toners for use in electrophotography, and various colors are duplicated while using the respective toners. Therefore, even in the solid area in the toner image, the colors are created from two colors of toners in the areas of red, blue, and green, which are areas with the largest amounts of toners, and also with the large amounts of wax.

In this disclosure, as long as the ISO/IEC 15775:1999 compliant test chart No. 4 is formed by electrophotography as a sample toner image, which is an oilless fixed toner image formed through an image forming apparatus, where a maximum value among three values of Ab/Aa is 3.0 to 7.0 or a maximum value among three values of Ab'/Aa' is 0.0040 to 0.0140 in areas having highest toner densities for red, blue, and green in the sample toner image, an excellent image can be provided which looks high-class.

The ratios Ab/Aa and Ab'/Aa' of the oilless fixed toner image vary depending on the wax amount in the toner, the distribution state, and the type of the wax. The ratios Ab/Aa and Ab'/Aa' are decreased with the decrease in the amount of the wax in the toner, whereas the ratios Ab/Aa and Ab'/Aa' are increased with the increase in the amount of the wax in the toner near the surface of the toner. In addition, the use of the wax which is lower in melting point and higher in fluidity increases the ratios Ab/Aa and Ab'/Aa'.

The ratios Ab/Aa and Ab'/Aa' of the oilless fixed toner image also vary depending on the amount of toner adhesion, and the smaller amount of toner adhesion decreases the ratios Ab/Aa and Ab'/Aa'. The image with the energy-ray curable pressure-sensitive layer provided has a flat image surface, the density of the image thus looks higher than normal, and the amount of toner adhesion can be reduced to lower the ratios Ab/Aa and Ab'/Aa'.

In addition, the ratios Ab/Aa and Ab'/Aa' of the oilless fixed toner image also vary depending on the conditions for fixing. Obviously, the increased fixing temperature, the lengthened time of heating by the fixing roller, and the increased pressure of the fixing roller increase the amount of the wax weeping from the toner, thus increasing the ratios Ab/Aa and Ab'/Aa' of the oilless fixed toner image.

As just described, there are various factors that vary the ratios Ab/Aa and Ab'/Aa' of the oilless fixed toner image. However, as long as the respective conditions are defined, it is easy to adjust the ratios Ab/Aa and Ab'/Aa' of the oilless fixed toner image to almost constant values, and the energy-ray curable pressure-sensitive adhesive layer can be provided to provide a beautiful image which has high durability and looks high-class.

In embodiments of the present invention, as described previously, the IR spectra are measured by the ATR method (crystal: Ge, incident angle: 45°, single reflection). The ATR method can measure the IR spectra with the high refractive-index Ge pressed against the sample, thus measure the spectra in an extremely simple way, and also measure the spectra without cutting the image as long as the measurement space has sufficient space.

In the ATR method, the measurement region in the depth direction of the sample varies depending on the wave number of infrared light measured. Therefore, when the indicator is created from the ration between two peak areas substantially away from each other in terms of wave number, the measurement regions (depths) for each substance are different from each other, and thus, when there is a slight gap between the Ge and the sample, the area ratio between the peaks produces a significant error. The two peaks used for obtaining the ratios Ab/Aa and Ab'/Aa' according to embodiments of the present invention are close in wave number, and thus measured in almost the same region (depth) for each substance. Therefore, reproducible values of Ab/Aa and Ab'/Aa' can be measured according to embodiments of the present invention.

Figure 12:
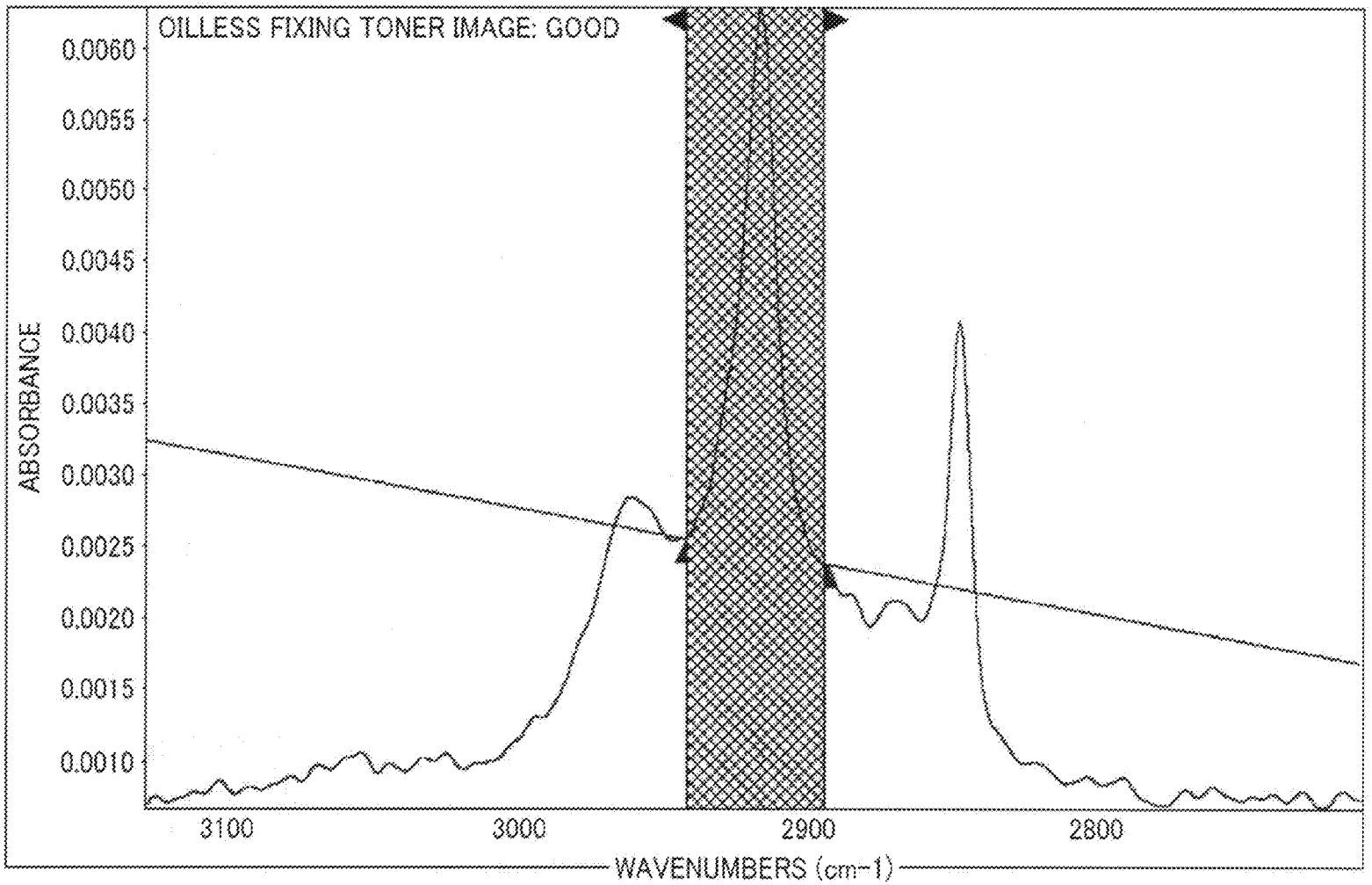
FIG. 12 is a chart showing a baseline of a peak area Aa from 2896 $cm^{-1}$ to 2943 $cm^{-1}$.
Figure 13:
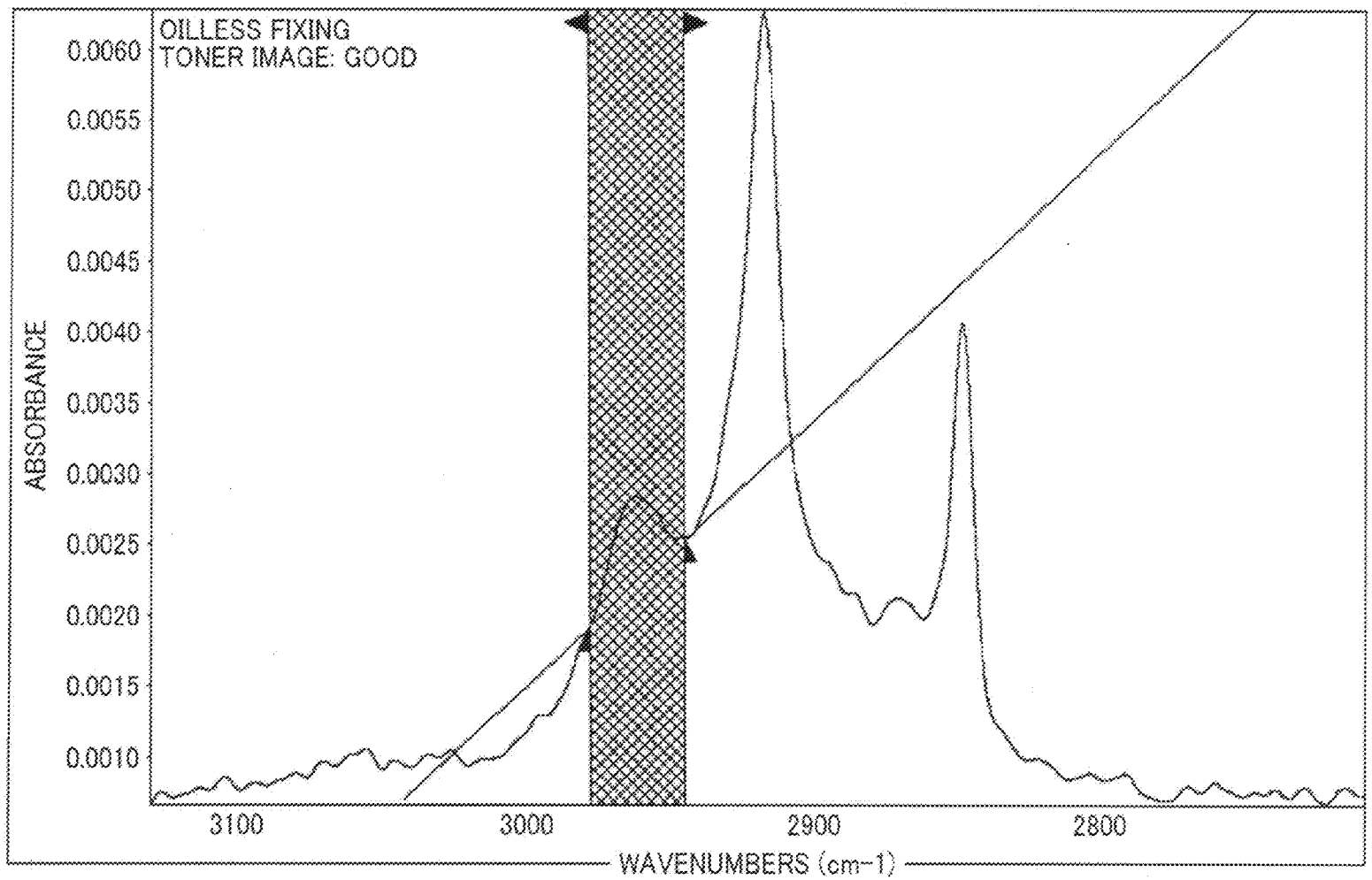
FIG. 13 is a chart showing a baseline of a peak area Ab from 2946 $cm^{-1}$ to 2979 $cm^{-1}$.

For the peak area Aa from 2896 $cm^{-1}$ to 2943 $cm^{-1}$, with a line connecting 2896 $cm^{-1}$ with 2943 $cm^{-1}$ in the spectrum as a base line, the area above the base line between 2896 $cm^{-1}$ to 2943 $cm^{-1}$ is measured as shown in FIG. 12. The peak area Ab from 2946 $cm^{-1}$ to 2979 $cm^{-1}$ can be also measured in the same way as shown in FIG. 13.

The value of Ab/Aa can be measured by figuring out the ratio between the respective areas thus measured.

Figure 14:
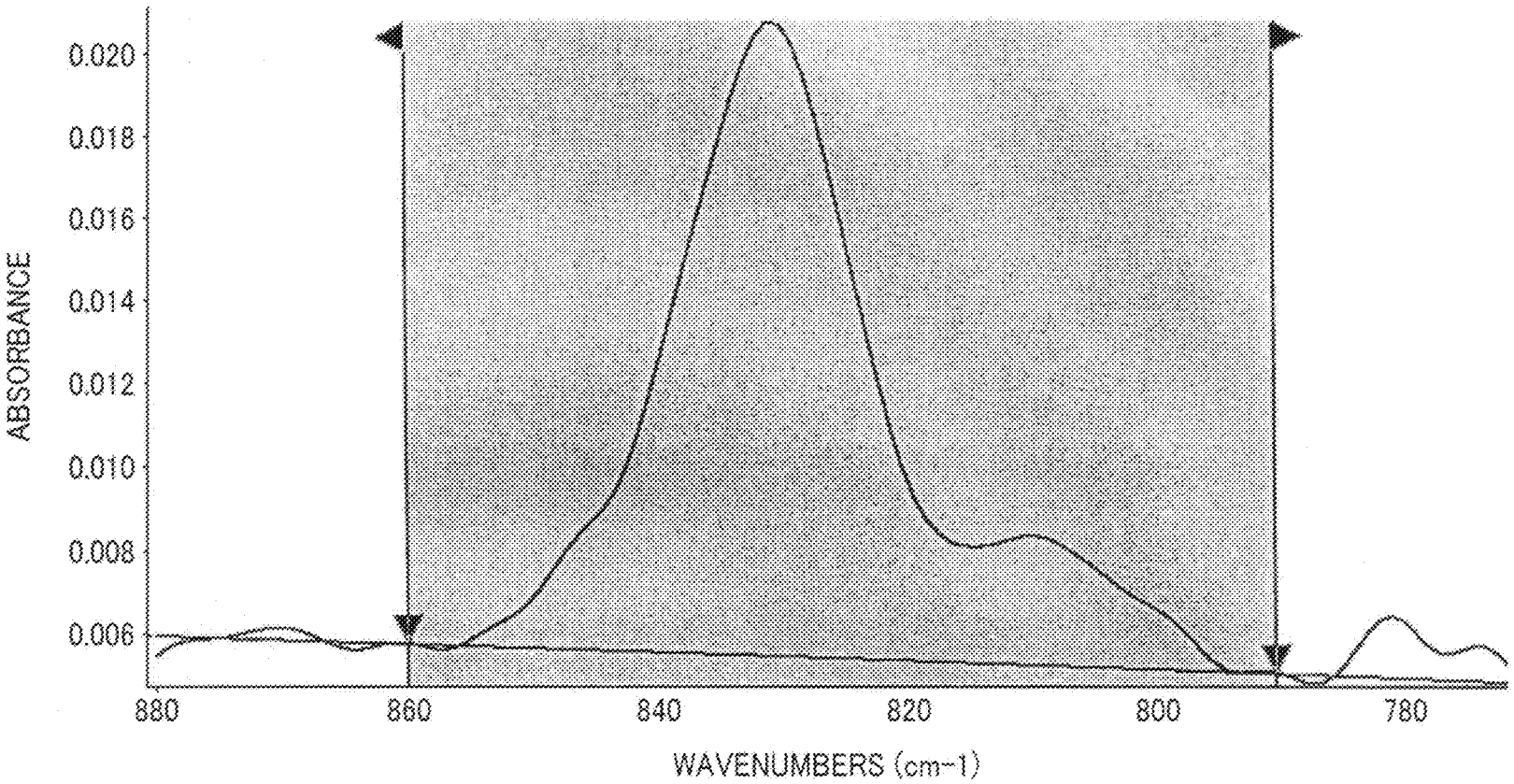
FIG. 14 is a chart showing a baseline of a peak area Aa' from 791 $cm^{-1}$ to 860 $cm^{-1}$.
Figure 15:
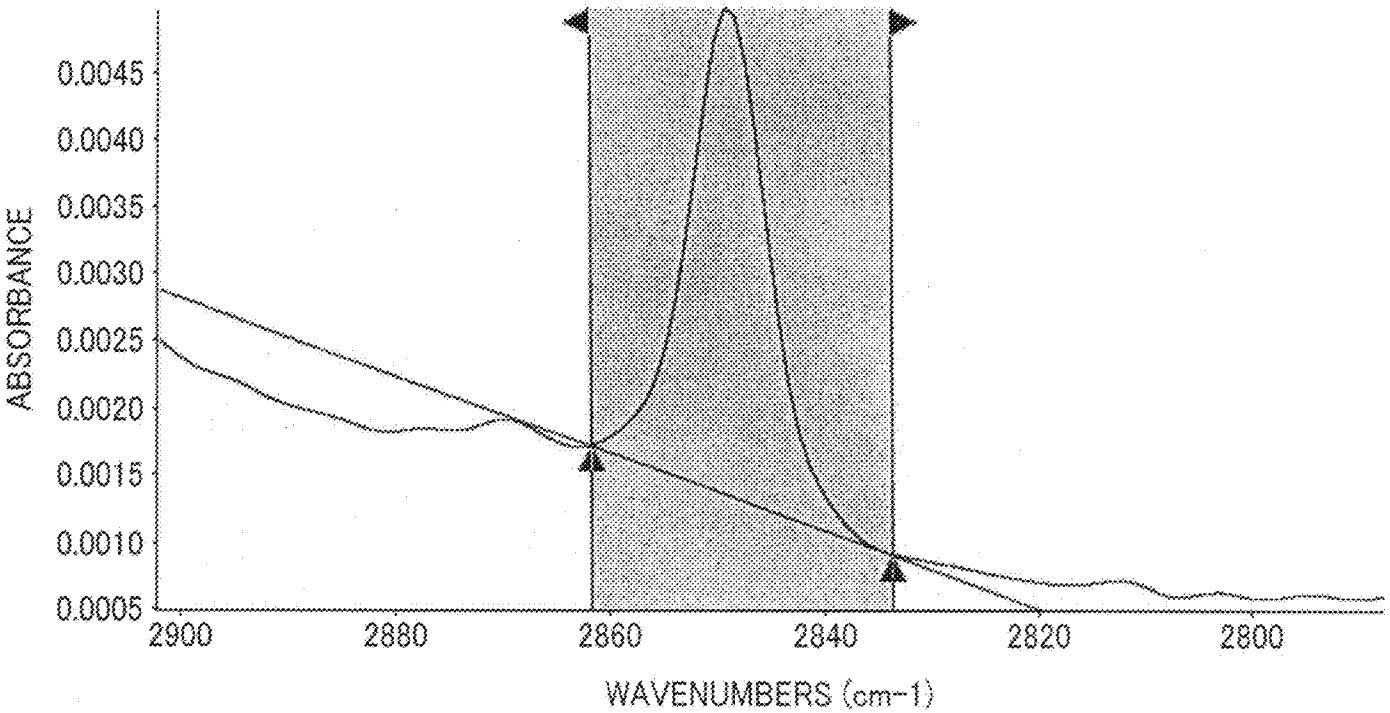
FIG. 15 is a chart showing a baseline of a peak area Ab' from 2834 $cm^{-1}$ to 2862 $cm^{-1}$.

For the peak area Aa' from 791 $cm^{-1}$ to 860 $cm^{-1}$, with a line connecting 791 $cm^{-1}$ with 860 $cm^{-1}$ in the spectrum as a base line, the area above the base line between 791 $cm^{-1}$ to 860 $cm^{-1}$ is measured as shown in FIG. 14. The peak area Ab' from 2834 $cm^{-1}$ to 2862 $cm^{-1}$ can be also measured in the same way as shown in FIG. 15.

The value of Ab'/Aa' can be measured by figuring out the ratio between the respective areas thus measured.

In addition, the inventors also have carried out studies from yet another perspective. More specifically, the wax associated with the adhesion between the energy-ray curable pressure-sensitive adhesive and the oilless fixing image is distributed at the surface of the oilless fixed image, and the wax in the image is not associated therewith. Thus, studies have been carried out, based on whether or not an oilless fixed image where the energy-ray curable pressure-sensitive adhesive can be provided in a preferred fashion can be specified form the distribution state of the wax at the surface of the oilless fixed image.

In this case, as an approach for observing the structure in the polymer, a section of the polymer is treated with osmium tetroxide (K. Kato: Polym. Eng. Sci., 7, 38), ruthenium tetroxide (J. S Trentetal.: Macromolecules, 16, 589), ruthenium tetroxide (K. Hessetal.: Kalloid-Z, 168, 37), or the like in transmission electron microscope (TEM) observation.

This approach is commonly adopted as an approach for enhancing contrast on TEM images, due to the fact that the chemically modified condition varies depending on respective polymers, and that the chemically modifying substance has a heavy metal, and thus makes electron transmission less likely, thereby resulting in the chemically modified polymer observed as darkness and the chemically unmodified polymer observed as brightness. Among these substances, the ruthenium tetroxide is preferred in terms of applicability to many polymer materials.

With attention focused on the fact that toner matrix particles containing a binder resin such as polyester and polystyrene are likely to be chemically modified with ruthenium tetroxide, whereas the wax is overwhelmingly less likely to be chemically modified with ruthenium tetroxide than the toner matrix particles, studies have been carried out, based on whether or not the area with the wax present and the area with no wax present can be distinguish from each other in a scanning electron microscopical image (SEM image) when the oilless fixed image is chemically modified with ruthenium tetroxide. More specifically, the number of reflection electrons or secondary electrons from a sample, which is characteristically increased with the increase in atomic number of element, can be utilized in a SEM image, because Ru as a constituent element of ruthenium tetroxide has a higher atomic number as compared with hydrogen, carbon, nitrogen, and oxygen as constituent elements of the oilless fixed image.

In addition, due to the fact that the ruthenium tetroxide modifies only the surface of the sample, there is a need for the region at the depth observed in a scanning electron microscope (SEM) at the surface as much as possible.

In general, it is known that the observed depth depends on the accelerating voltage in the SEM observation, and only information at a depth equal to or less than several tens of nanometers can be seen at an accelerating voltage of 1 kV.

Based on these findings, the treatment of the oilless fixed image with a vapor of ruthenium tetroxide, and then the observation of the fixed image surface with reflection electrons at an accelerating voltage of 0.8 kV in a SEM have found that the area with the wax present is observed as darkness, whereas the area with no wax present is observed as brightness.

Furthermore, it has been found that the area ratio of the dark area in this SEM image (reflection electron image) can be treated as the wax coverage at the surface of the oilless fixed image, and the wax coverage at the surface of the oilless fixed image can specify an oilless fixed image where the energy-ray curable pressure-sensitive adhesive can be provided in a preferred fashion.

Therefore, according to embodiments of the present invention, with the use of ISO/IEC 15775:1999 compliant test chart No. 4, a fixed solid image in at least any of red, green, and blue, which is formed from at least two types of toners, is exposed to a saturated vapor of a ruthenium tetroxide aqueous solution, and then irradiated with electron beams at an accelerating voltage of 0.8 kV, the obtained reflection electron image is converted into a binarized image composed of a black area and a white area, and the area ratio of the black area to the entire area of the binarized image (which may be referred to as a "wax coverage") is preferably 40% to 70%, and more preferably 42% to 65%. The wax coverage less than 40% may deteriorate the mold release property between the fixing roller and the image to fail to obtain any high-quality image, whereas the wax coverage in excess of 70% may deteriorate the adhesion of the energy-ray curable pressure-sensitive adhesive.

Further, as in the case of a black-and-white image formed in the image forming apparatus for forming toner images, the wax coverage of the black-and-white image is also preferably 40% to 70%.

—Chemical Modification Treatment—

In the method for measuring the wax coverage, the concentration of ruthenium tetroxide in the exposure of the oilless fixed image surface to a saturated vapor of the ruthenium tetroxide aqueous solution may be any concentration as long as the chemical modification with ruthenium tetroxide can be carried out in a safe and reproducible manner, and for example, an aqueous solution of 5 mass % ruthenium tetroxide (for example, from TABB (Great Britain)) is preferably used because the chemical modification with ruthenium tetroxide can be stably carried out.

When the aqueous solution of ruthenium tetroxide is placed in a hermetically-sealed space, the ruthenium tetroxide is volatilized to become a saturated vapor. Thus, the oilless fixed image can be easily subjected to the chemical modification with ruthenium tetroxide by placing the oilless fixed image in the hermetically-sealed space.

In this case, the temperature of the exposure to a saturated vapor of the ruthenium tetroxide aqueous solution may be normal room temperature, for example, which is preferably 15° C. to 35° C., and more preferably 18° C. to 30° C.

The time of the exposure to a saturated vapor of the ruthenium tetroxide aqueous solution is not particularly limited as long as the oilless fixed image is chemically modified with certainty, and can be definitely separated from the release agent for the SEM observation, but preferably 3 minutes to 8 minutes, and more preferably 4 minutes to 6 minutes.

The time of the exposure less than 3 minutes may result in an insufficient chemical modification of the oilless fixed image in some cases, which unfavorably makes it difficult to definitely separate the release agent from the fixed image. On the other hand, the time of the exposure in excess of 8 minutes may result in adhesion of ruthenium tetroxide even on the surface of the mold release property, thereby increasing the ratio of the dark area observed in the SEM image, or producing an ill-defined border between the area with the release agent present and the area with no release agent present.

—SEM Observation—

When the oilless fixed image surface treated with ruthenium tetroxide is observed with a scanning electron microscope (SEM), the area with the wax present is observed as darkness, whereas the area with no wax present is observed as brightness. The accelerating voltage in this case is preferably 0.3 kV to 1.0 kV, and more preferably 0.5 kV to 0.9 kV.

The accelerating voltage in excess of 1.0 kV results in detection of information from a deep area of the oilless fixed image. Therefore, with thin adhesion of the wax, the transmission through the wax will also pick up information on the surface of the oilless fixed image chemically modified with ruthenium tetroxide. According to embodiments of the present invention, the accelerating voltage of 0.8 kV can be used to reproducibly observe the region with the wax present at the surface.

In the case of observing, with a SEM, the oilless fixed image treated with ruthenium tetroxide, regardless of a secondary electron image or a reflection electron image, the area with the wax present is observed as darkness, whereas the area with no wax present is observed as brightness, and in the case of a reflection electron image, the area with the wax present can be distinguished more definitely from the area with no wax present.

This is because larger numbers of both reflection electrons and secondary electrons are generated with the increase in atomic number of element, while the dependence of the generation on the atomic number is higher in the case of reflection electrons than secondary electrons. Therefore, the reflection electron image is preferred because the area with the wax present and the area with no wax present are respectively darker and brighter such that information on asperity of the oilless fixed image can be eliminated.

Figure 16A:
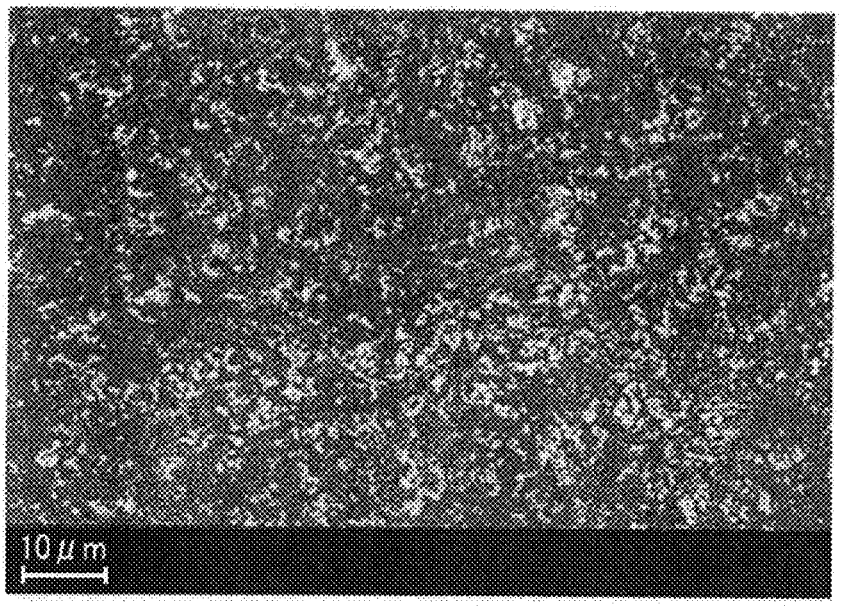
FIG. 16A is a photographic image of an oilless fixed image with poor adhesion to an ultraviolet curable pressure-sensitive composition.
Figure 16B:
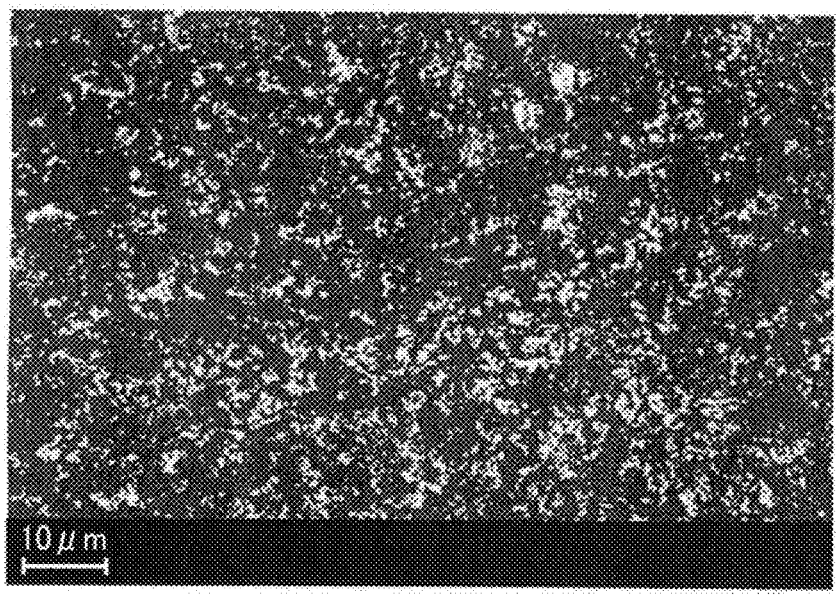
FIG. 16B is a photographic image of an oilless fixed image with favorable adhesion to an ultraviolet curable pressure-sensitive composition.

In this regard, FIG. 16A shows an oilless fixed image with poor adhesion to an energy-ray curable pressure-sensitive adhesive, whereas FIG. 16B shows an oilless fixed image with favorable adhesion to an energy-ray curable pressure-sensitive adhesive.

As seen in the reflection electron image obtained when the oilless fixed image is chemically modified with ruthenium tetroxide, and then subjected to the SEM observation at the accelerating voltage of 0.8 kV, it is determined that the oilless fixed image with poor adhesion in FIG. 16A is entirely dark with a very small bright area. On the other hand, it is determined that the oilless fixed image with favorable adhesion in FIG. 16B is entirely brought with a very small dark area.

The magnification for making the reflection electron image is selected appropriately depending on the presence of the wax, and may be any magnification as long as the area with the toner present is photographed, but preferably 100- to 2,000-fold magnification.

—Binarization Process—

Figure 17A:
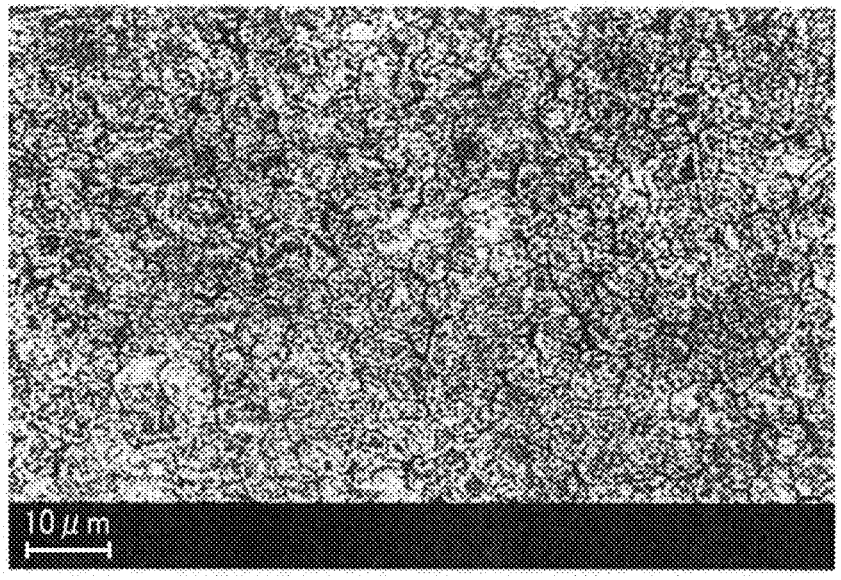
FIG. 17A is a binarized image of FIG. 16A.
Figure 17B:
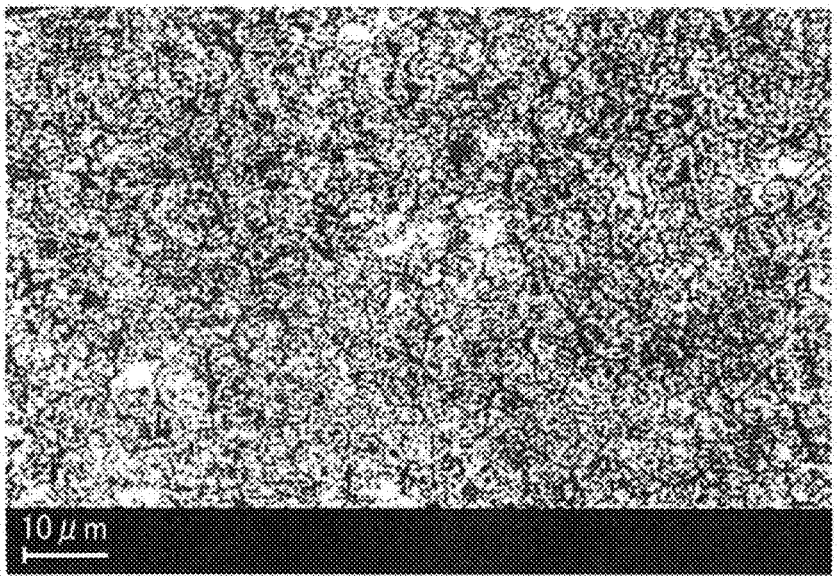
FIG. 17B is a binarized image of FIG. 16B.

The respective pixels (or a predetermined number of pixel units) constituting the obtained reflection electron image (image data) are subjected to image processing (binarization) for dividing the pixels into any one of a blackish area (black area) and a whitish area (white area), thereby providing a binarized image. FIG. 17A shows a binarized image of FIG. 16A. FIG. 17B shows a binarized image of FIG. 16B.

For the binarization, for example, when the brightness figured out for each pixel is equal to or more than a certain value (threshold value), the pixel may be regarded as the white area, while the pixel may be regarded as the black area when the brightness is less than the certain value. In addition, the threshold value is set by reference to a brightness histogram, and as can be understood by comparing FIG. 16A with FIG. 17A, and FIG. 16B with FIG. 17B, the images (FIGS. 16(*a*) and 16(*b*)) before the binarization are almost binarized images, it is thus not hard to set the threshold value, and the binarized image is not substantially affected even when the threshold value is somewhat increased or decreased.

—Calculation of Area Ratio of Black Area—

Next, the area ratio of the black area to the entire binarized image is calculated on the basis of the reflection electron image. For example, the area ratio may be calculated by arithmetic processing of figuring out the areas of the entire binarized image and black area, and dividing the black area by the entire area of the binarized area, or by arithmetic processing of dividing the number of pixels (number of dots) in the black area by the number of pixels in the entire binarized image.

In this case, the area ratio of the black area to the entire binarized image can be considered as the wax coverage, because the area with the wax present and the area with no wax present look black and white respectively in the reflection electron image.

In the oilless fixed image, it is preferable to specify the wax coverage in the area with the largest amount of toner adhesion.

In the image forming method employing the oilless fixing method according to embodiments of the present invention, the wax which decreases the adhesion between the energy-ray curable pressure-sensitive adhesive and the oilless fixed image is supplied only from the toner. Therefore, the area with the largest amount of wax in the oilless fixed toner image is an area with the largest amount of toner adhesion, that is, the solid area of the toner image.

In the electrophotographic image formation, toners in four colors of black, magenta, cyan, and yellow are used to reproduce various colors. Therefore, among solid images of the oilless fixed image, the areas in red, blue, and green are areas with larger amounts of toner adhesion as compared with black, and also with higher wax contents.

According to embodiments of the present invention, with the use of ISO/IEC 15775:1999 compliant test chart No. 4, a fixed solid image in at least any of red, green, and blue, which is formed from at least two types of toners, is exposed to a saturated vapor of a ruthenium tetroxide aqueous solution, and then irradiated with electron beams at an accelerating voltage of 0.8 kV, the obtained reflection electron image is converted into a binarized image composed of a black area and a white area, and the area ratio of the black area to the entire area of the binarized image (wax coverage) is 40% to 70%. Thus, the favorable adhesion to the energy-ray curable pressure-sensitive adhesive achieves a detachable information sheet with a beautiful image which has high durability and looks high-class after detachment is carried out.

The wax coverage varies depending on the wax amount in the toner, the distribution state, and the type of the wax The wax coverage is decreased with the decrease in the content of the wax in the toner, whereas the wax coverage is increased with the increase in the amount of the wax in the toner near the surface of the toner. In addition, the use of the wax which is lower in melting point and higher in fluidity increases the wax coverage of the oilless fixed image.

The wax coverage of the oilless fixed image also varies depending on the amount of toner adhesion, and the smaller amount of toner adhesion decreases the wax coverage. The image with the energy-ray curable pressure-sensitive layer provided has a flat image surface, the density of the image thus looks higher than normal, and the amount of toner adhesion can be reduced to lower the wax coverage.

In addition, the wax coverage of the oilless fixed image also varies depending on the conditions for fixing. Obviously, the increased fixing temperature, the lengthened time of heating by the fixing roller, and the increased pressure of the fixing roller increase the wax coverage of the oilless fixed image.

As just described, there are various factors that vary the wax coverage of the oilless fixed image. However, as long as the respective conditions are defined, it is easy to adjust the wax coverage of the oilless fixed image to an almost constant value, and detachable information sheet the energy-ray curable pressure-sensitive adhesive provided and pressure-bonded thereto can provide a beautiful image which has high durability and looks high-class when detachment is carried out.

<Relationship Between Peeling Strength and Present Invention>

Furthermore, the inventors have explored in detail why the peeling strength is changed when a sheet with toner is subjected to pressure bonding with the ultraviolet curable pressure-sensitive composition. In particular, in regard to the change in peeling strength with the passage of time, the examination on a layer of the ultraviolet curable composition has found that the toner component is slightly dissolved in the ultraviolet curable composition. In general, toner contains polyester or polystyrene as its main constituent, and these low-molecular-weight components are likely to be dissolved in the monomer or oligomer having an acryloyl group as the ultraviolet curable component (A). In addition, it has been determined that the dissolved component serve similarly to the (meth)acrylic copolymer (B), but entirely differ in molecular size from the (meth)acrylic copolymer (B), thus disturbing the action of the (meth)acrylic copolymer (B) to bring a substantial change in peeling strength.

The inventors have found that not only the ultraviolet curable pressure-sensitive composition but also the combination with the toner is extremely important, in order to prepare an information sheet from a sheet with toner. When an energy-ray curable precursor (after treatment) with a toner component partially dissolved through immersion of a toner image in an energy-ray curable precursor (before treatment) was formed into a film on a sheet without any image, and subjected to pressure bonding, and to a measurement of the peeling strength, the inventors found that there is almost no change between a case of using the energy-ray curable precursor (after treatment) and a case of using the energy-ray curable precursor (before treatment) when the bondability is favorable and there is no problem in the detachment. On the other hand, the inventors found that a case of using the energy-ray curable precursor (after treatment) substantially differs from a case of using an energy-ray curable precursor (before treatment) when the bondability is poor and there is a problem in the detachment, thereby achieving the present invention.

More specifically, at least one embodiment of the present invention provides a method for producing a detachable information sheet, which is characterized by using a toner and an energy-ray curable precursor for use in a detachable information sheet obtained by forming an energy-ray curable precursor layer on a sheet with an image formed thereon with the use of the toner, curing the energy-ray curable precursor through energy-ray irradiation, and then attaching and pressure-bonding the surface with the energy-ray curable precursor cured, where the toner and the energy-ray curable precursor to be used have the peeling strength of 80% to 130% that is obtained in such a way that the energy-ray curable precursor (after treatment) obtained by leaving a solid image of 5 $cm^2$ immersed in 100 g of the energy-ray curable precursor (before treatment), in a dark place at 40° C. for 24 hours, followed by filtration is applied onto a sheet with no toner image, irradiated with energy rays to cure the energy-ray curable precursor, and the surface with the energy-ray curable precursor cured is attached and subjected to pressure bonding, compared to the peeling strength of the energy-ray curable precursor (before treatment).

The peeling strength of the energy-ray curable precursor (after treatment) is 80% to 130%, and preferably 80% to 125% of the peeling strength of the energy-ray curable precursor (before treatment). The low peeling strength of lower than 80% is unfavorably likely to cause peeling by vibrations at the time of transportation due to the low bonding strength. The strength of higher than 130% unfavorably results in breakage of one image, or in a failure to obtain a smooth peeled surface, when detachment is carried out.

When the toner image for the measurement of the peeling strength is intended for colors, the measurement of the strength is preferably made for all of the colors. However, it is the resin component in the toner that changes the peeling strength, but it is not the pigments or additives, and thus, the measurement for the toner image in one color is sufficient as long as there is the same resin component in the toner.

The peeling strength is regarded as the tensile loading in the case of peeling a pressure-bonded paper sheet of 150 mm in width at 6 cm/sec with the use of Digital Force Gauge ZTS (from IMADA CO., LTD.) and Force-Recorder that is graph drawing software for ZT series (from IMADA CO., LTD.).

EXAMPLES

While examples according to embodiments of the present invention are described below, the present invention is not to be considered limited to these examples in any way.

Embodiment 1

—Developer—

(Toner 1)

Specific preparation examples of the toner are described.

The toner for use in embodiments of the present invention is not to be considered limited to these examples.

[Toner Formulation]

Polyester Resin 89 parts by mass (weight average molecular weight: 68200, glass transition temperature (Tg): 65.5° C.)

Petroleum-derived Wax 5 parts by mass

Carbon Black 5 parts by mass (from Mitsubishi Chemical Corporation: #44)

Charge Controlling Agent 1 part by mass (Spiron Black TR-H: Hodogaya Chemical Co., Ltd.)

The formulation mentioned above was kneaded at 120° C. with the use of a biaxial extruder, then subjected to grinding and classification with an airflow grinding mill to a mass average particle size of 11.0 μm, and then mixed with 2.2 mass % of silica (R-972: Nippon Aerosil Co., Ltd.) with the use of a Henschel mixer to obtain a mixed toner.

The obtained toner was 0.90 in toner circularity, and 8 μm in volume average particle size.

With the use of, as a carrier, magnetite particles of 50 μm in average particle size, which were coated with a silicone resin (film thickness: 0.5 μm), the particles were mixed with the toner for a toner 1 concentration of 5.0 mass % to obtain a developer 1.

—Ultraviolet Curable Composition—

(Ultraviolet Curable Composition 1)

In a beaker, 30 parts by mass of pentaerythritol tetraacrylate, 66 parts by mass of trimethylolpropane triacrylate, and further 0.3 parts by mass of hydroquinone as a polymerization inhibitor were put, and heated to 120° C. while agitation, and a diallyl phthalate prepolymer was dissolved therein. Furthermore, 2 parts by mass of aluminum isopropylate dispersed in 2 parts by mass of toluene was gradually added thereto, and agitated at 110° C. for 20 minutes. During this period, the toluene added as a solvent was removed to the outside of the system to obtain an intended photo-curable varnish-based agent.

Furthermore, 75 parts by mass of the photo-curable varnish-based agent, 10 parts by mass of benzophenone as a sensitizer, 5 parts by mass of P-dimethylaminoacetophenone, and 10 parts by mass of phenyl glycol monoacrylate as an ink viscosity modifier were mixed, and subjected to ink milling with a three-roll mill to obtain an ultraviolet curable composition 1.

—Heating and Pressing Device—

(Heating and Pressing Device 1)

As a heat source, a halogen lamp was provided on the image side of the pair of heating and pressing rolls in the heating and pressing device in FIG. 6. In addition, the surface pressure on the pair of heating and pressing rolls was set to 40 $N/cm^2$, and the roll surface of the heating and pressing device 1 was set to meet 100 mm/sec. The temperature of the heating and pressing roll surface was adjusted so that the viscosity of toner particles just after the outlets of the rolls fell within the range of $10^3$ Pa·s or more and $10^6$ Pa·s or less, thereby achieving the heating and pressing device 1. In this experiment, the temperature was 160° C.

(Heating and Pressing Device 1A)

As a heat source, a halogen lamp was provided on the image side of the pair of heating and pressing rolls in the heating and pressing device in FIG. 6. In addition, the surface pressure on the pair of heating and pressing rolls was set to 41 $N/cm^2$, and the roll surface of the heating and pressing device 1A was set to meet 110 mm/sec. The temperature of the heating and pressing roll surface was adjusted so that the viscosity of toner particles just after the outlets of the rolls fell within the range of $10^3$ Pa·s or more and $10^6$ Pa·s or less, thereby achieving the heating and pressing device 1. In this experiment, the temperature was 160° C.

Example 1

The developer 1 was loaded on MFP imagio Neo 750 from Ricoh Co., Ltd. to print a checkered pattern on A4-size OK topcoat 110 kg paper sheet.

One side of the print was coated with the ultraviolet curable composition 1 of 5 $g/cm^2$ to 6 $g/cm^2$ in film thickness with the use of an UV varnish coater (SAC-18E) from HIROSE IRON WORKS CO., LTD. The ultraviolet curable composition 1 was cured by the coater.

Next, the print surface-treated with the ultraviolet curable composition 1 was passed through the heating and pressing device 1, the ultraviolet curable composition 1 on a toner image of the print after the passage was cut with a cutter knife into a 100-square grid pattern at intervals of 1 mm in accordance with JIS K5400, and taken off with an adhesive cellophane tape, and the number of the squares left was counted while looking through a magnifying glass.

Evaluation criteria are shown below. (hereinafter, referred to as an adhesion evaluation)

<Adhesion Evaluation Criteria>

Very good: 100/100

Good: 80 to 99/100

Not good: 40 to 79/100

Bad: 0 to 39/100

Example 1A

The adhesion evaluation was made by passing through the heating and pressing device 1A in place of the heating and pressing device 1 in Example 1.

Comparative Example 1

The adhesion evaluation was made without passing through the heating and pressing device 1 in Example 1.

Embodiment 2

—Developer—

(Toner 2)

Specific preparation examples of the toner are described.

The toner for use in embodiments of the present invention is not to be considered limited to these examples.

[Preparation of Dissolution or Dispersion of Toner Material]

—Synthesis of Unmodified Polyester (Low-Molecular-Weight Polyester)—

In a reaction tank with a cooling tube, an agitator, and a nitrogen introduction tube, 67 parts by mass of bisphenol A—2 mol ethylene oxide adduct, 84 parts by mass of bisphenol A—3 mol propione oxide adduct, 274 parts by mass of terephthalic acid, and 2 parts by mass of dibutyltin oxide were put, and reacted for 8 hours at 230° C. under ordinary pressure.

Then, the reaction liquid was reacted for 5 hours under a reduced pressure of 10 mmHg to 15 mmHg to synthesize an unmodified polyester.

The unmodified polyester obtained was 2,100 in number average molecular weight (Mn), 5,600 in weight average molecular weight (Mw), and 55° C. in glass transition temperature (Tg).

—Preparation of Masterbatch (MB)—

With the use of a Henschel mixer (from Mitsui Mining Co., Ltd.), 1000 parts by mass of water, 540 parts by mass of carbon black "Printex 35" from Degussa (DBP oil absorption=42 ml/100 g, pH=9.5), and 1200 parts by mass of the unmodified polyester were mixed.

The mixture was kneaded at 150° C. for 30 minutes with a two-roll mill, then subjected to rolling cooling, and subjected to grinding with a pulverizer (from Hosokawa Micron Corporation) to prepare a masterbatch.

—Synthesis of Prepolymer—

In a reaction tank with a cooling tube, an agitator, and a nitrogen introduction tube, 682 parts by mass of bisphenol A—2 mol ethylene oxide adduct, 81 parts by mass of bisphenol A—2 mol propylene oxide adduct, 283 parts by mass of terephthalic acid, 22 parts by mass of trimellitic anhydride, and 2 parts by mass of dibutyltin oxide were put, and reacted for 8 hours at 230° C. under ordinary pressure.

Then, the liquid was reacted for 5 hours under a reduced pressure of 10 mmHg to 15 mmHg to synthesize an intermediate polyester.

The intermediate polyester obtained was 2,100 in number average molecular weight (Mn), 9,600 in weight average molecular weight (Mw), 55° C. in glass transition temperature (Tg), 0.5 in acid value, and 49 in hydroxyl value.

Next, in a reaction container with a cooling tube, an agitator, and a nitrogen introduction tube, 411 parts by mass of the intermediate polyester, 89 parts by mass of isophorone diisocyanate, and 500 parts by mass of ethyl acetate were put, and reacted for 5 hours at 100° C. to synthesize a prepolymer (a polymer capable of reacting with the compound containing the active hydrogen group).

The free isocyanate content of the obtained prepolymer was 1.60 mass %, and the solid content concentration (after leaving at 150° C. for 45 minutes) of the prepolymer was 50 mass %.

—Synthesis of Ketimine (Compound Containing Active Hydrogen Group)—

In a reaction container set with an agitation bar and a thermometer, 30 parts by mass of isophoronediamine and 70 parts by mass of methyl ethyl ketone were put, and reacted for 5 hours at 50° C. to synthesize a ketimine compound (the compound containing an active hydrogen group).

The obtained ketimine compound (the compound containing an active hydrogen group) was 423 in amine value.

—Synthesis of Styrene-Acrylic Copolymer Resin—

In a reaction tank with a cooling tube, an agitator, and a nitrogen introduction tube, with 300 parts by mass of ethyl acetate put therein, 300 parts by mass of styrene-acrylic monomer mixture (styrene/acrylic acid 2-ethylhexyl/acrylic acid/acrylic acid 2-hydroxyethyl=75/15/5/5) and 10 g of azobisisobutylnitrile were put, and reacted for 15 hours at 60° C. under a nitrogen atmosphere at ordinary pressure.

Then, the styrene acrylic copolymer resin was synthesized by adding 200 parts by mass of methanol to the reaction liquid, removing the supernatant after agitation for 1 hour, and drying under reduced pressure.

In a beaker, 10 parts by mass of the prepolymer, 60 parts by mass of the unmodified polyester, 130 parts by mass of ethyl acetate, and 30 parts by mass of the styrene-acrylic copolymer were agitated, and dissolved.

Then, 10 parts by mass of petroleum-derived wax (15 mass % of cycloparaffin, average molecular weight=650) and 10 parts by mass of the masterbatch were put to prepare a raw material dissolution by 3 passes under the conditions of liquid feeding rate: 1 kg/hr; disc peripheral speed: 6 m/s; and filling with 80 volume % of 0.5 mm zirconia beads, with the use of a beads mill ("Ultra Visco Mill" from Imex Co., Ltd.), and 2.7 parts by mass of the ketimine was added thereto, and dissolved therein to prepare a dissolution or dispersion of the toner material.

[Preparation of Aqueous Medium Phase]

An aqueous medium phase was prepared by mixing and agitating 306 parts by mass of ion-exchange water, 265 parts by mass of a suspension of 10 mass % tricalcium phosphate, and 0.2 parts by mass of sodium dodecylbenzene sulfonate for uniform dissolution.

[Preparation of Emulsified Liquid or Dispersion]

In a container, 150 parts by mass of the aqueous medium phase was put, agitated at a revolution speed of 12,000 rpm with the use of a TK-type homomixer (from Tokushukika Kogyo Co., Ltd.), and with the addition of 100 parts by mass of the dissolution or dispersion of the toner material thereto, mixed for 10 minutes to prepare an emulsified liquid or a dispersion (emulsified slurry).

[Removal of Organic Solvent]

In a flask set with an agitator and a thermometer, 100 parts by mass of the emulsified slurry was put, and subjected to solvent removal for 12 hours at 30° C. while agitating at an agitation peripheral speed of 20 m/min.

[Cleaning and Drying]

After applying filtration under reduced pressure to 100 parts by mass of the dispersion slurry, the filter cake was, with the addition of 100 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

The obtained filter cake was, with the addition of 20 parts by mass of 10 mass % sodium hydroxide aqueous solution thereto, mixed with a TK-type homomixer (for 30 minutes at a revolution speed of 12,000 rpm), and then subjected to filtration under reduced pressure.

The obtained filter cake was, with the addition of 300 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

Moreover, the obtained filter cake was, with the addition of 20 parts by mass of 10 mass % hydrochloric acid thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration, thereby providing a final filter cake.

The obtained final filter cake was dried for 48 hours at 45° C. in an air circulation dryer, and passed through a sieve of 75 μm mesh to obtain toner matrix particles.

[Treatment of External Addition]

Furthermore, 100 parts by weight of the toner matrix particles were mixed with 0.6 parts by weight of hydrophobic silica of 100 nm in average particle size, 1.0 parts by weight of titanium oxide of 20 nm in average particle size, and 0.8 parts by weight of hydrophobic silica fine powder of 15 nm in average particle size in a Henschel mixer to obtain a toner.

The toner was 5.7 μm in weight average particle size, and 0.940 in the average circularity.

<Carrier>

Specific preparation examples of the carrier used for the evaluation are described.

The carrier for use in the present invention is not to be considered limited to these examples.

—Preparation of Carrier—

[Formulation of Solution for Carrier Coating Film Formation]

| | |
|---|---|
| Acrylic Resin Solution (Solid Content: 50 wt %) | 21.0 parts by mass |
| Guanamine Solution (Solid Content: 70 wt %) | 6.4 parts by mass |
| Alumina Particle | 7.6 parts by mass |

[0.3 μm, Specific Resistance: $10^{14}$ (Ω·cm)]

| | |
|---|---|
| Silicone Resin Solution | 65.0 parts by mass |

[Solid Content: 23 wt % (SR2410: from Dow Corning Toray Silicone Co., Ltd.)]

| | |
|---|---|
| Aminosilane | 1.0 parts by mass |

[Solid Content: 100 wt % (SH6020: from Dow Corning Toray Silicone Co., Ltd.)]

| | |
|---|---|
| Toluene | 60 parts by mass |
| Butylcellosolve | 60 parts by mass |

The formulation mentioned above was dispersed for 10 minutes with a homomixer to obtain a solution for forming a coating film of a blend of an acrylic resin including alumina particles and a silicone resin.

With the use of a fired ferrite powder [$(MgO)_{1.8}(MnO)_{49.5}(Fe_2O_3)_{48.0}$: Average Particle Size; 35 μm] as a core material, the solution for forming a coating film was applied with a spiro coater (from OKADA SEIKO CO., LTD.) to the surface of the core material so as to reach a film thickness of 0.15 μm, and dried.

The obtained carrier was subjected to firing by leaving for 1 hour at 150° C. in an electric furnace.

After cooling, the ferrite powder bulk was sorted with the use of a sieve of 106 μm mesh to obtain a carrier of 35 μm in weight average particle size.

With a ratio of 7 parts by weight of the toner 2 to 100 parts by weight of the carrier, a Turbula mixer of an agitation type by tumbling a container was used for homogeneous mixing and charging, thereby preparing a developer.

—Ultraviolet Curable Composition—

The ultraviolet curable composition 1 was directly used.

—Heating and Pressing Device—

The heating and pressing device 1, 1A was directly used.

Example 2

The developer 2 was loaded on Color MFP RICOH Pro C751 from Ricoh Co., Ltd. to print an image of 20% in image area ratio on A4-size OK topcoat 110 kg paper sheet.

One side of the print was coated with the ultraviolet curable composition 1 of 5 g/cm$^2$ in film thickness with the use of an UV varnish coater (SAC-18E) from HIROSE IRON WORKS CO., LTD. The ultraviolet curable composition 1 was cured by the coater.

Next, the print surface-treated with the ultraviolet curable composition 1 was passed through the heating and pressing device 1, and the ultraviolet curable composition 1 on the toner image of the print after the passage was subjected to the adhesion evaluation.

Example 2A

The adhesion evaluation was made by passing through the heating and pressing device 1A in place of the heating and pressing device 1 in Example 2.

Comparative Example 2

The adhesion evaluation was made without passing through the heating and pressing device 1 in Example 2.

Embodiment 3

—Developer—

The developer 2 was directly used.

—Ultraviolet Curable Pressure-Sensitive Composition—

(Ultraviolet Curable Pressure-Sensitive Composition 1)

[Monomer Composition of (Meth)Acrylic Copolymer]

A monomer composition A of a (meth)acrylic copolymer was obtained by agitating and mixing 10 parts by mass of 2-ethylhexyl acrylate, 30 parts by mass of 2-hydroxyethyl acrylate, 50 parts by mass of butyl methacrylate, and 10 parts by mass of acrylic acid.

Production Example of Intermediate Product

An intermediate product A was obtained by agitating and mixing 40 parts by mass of LIPOXY SP-1509 (epoxy acrylate oligomer from Showa HighPolymer Co., Ltd.), 40 parts by mass of tripropylene glycol diacrylate, 20 parts by mass of ARONIX M-400 (dipentaerythritol hexaacrylate from TOAGOSEI CO., LTD.), 5 parts by mass of IRGACURE 184 (hydroxycyclohexyl phenyl ketone from Nihon Ciba-Geigy K.K.), and 0.1 parts by weight of methoquinone.

Into a 500 ml reaction container provided with an agitator, a nitrogen gas introduction port, a thermometer, and a reflux capacitor, 100 parts by mass in total of monomers associated with the monomer composition A, 100 parts by mass of isopropyl alcohol as a polymerization solvent, and 1 part by mass of azobisisobutylnitrile as a polymerization initiator were added, and subjected to polymerization for 6 hours at 82° C. under reflux of isopropyl alcohol to obtain a resin solution containing 50 weight % of a transparent and viscous resin component.

Next, 60 parts by mass (solid content: 30 parts by mass) of this resin solution was blended with respect to 105.1 parts by mass (ultraviolet curable monomer and oligomer having a (meth)acryloyl group: 100 parts by mass) of the intermediate product A to obtain an ultraviolet curable pressure-sensitive composition 1 in a transparent solution state.

—Heating and Pressing Device—

The heating and pressing device 1, 1A was directly used.

Example 3

The developer 2 was loaded on Color MFP RICOH Pro C751 from Ricoh Co., Ltd. to print an image of 20% in image area ratio on A4-size OK topcoat 110 kg paper sheet.

One side of the print was coated with the ultraviolet curable pressure-sensitive composition 1 of 5 g/cm$^2$ to 6 g/cm$^2$ in film thickness with the use of an UV varnish coater (SAC-18E) from HIROSE IRON WORKS CO., LTD. The ultraviolet curable pressure-sensitive composition 1 was cured by the coater.

Next, the print surface-treated with the ultraviolet curable pressure-sensitive composition 1 was passed through the heating and pressing device 1.

Next, samples were created by cutting into 150 mm in width and 150 mm in length. The surfaces of the two sheets of samples were attached to each other, which were surface-treated with the ultraviolet curable pressure-sensitive composition 1, and subjected to pressure bonding by applying a load at a gauge pressure of 100 N/cm$^2$ with a desk super calender from YURI ROLL CO., LTD., and the tensile load was measured in the case of peeling the pressure-bonded paper sheet of 150 mm in width at 6 cm/sec (hereinafter, referred to as a peeling load test). In addition, the print side after the peeling was observed and evaluated on the basis of the following criteria (hereinafter, referred to as a peeling fixation test).

Example 3A

The adhesion evaluation was made by passing through the heating and pressing device 1A in place of the heating and pressing device 1 in Example 3.

<Criteria for Peeling Fixation Test>

Good: no toner peeling at all

Not good: toner image peeled into fine dots

Bad: toner image substantially peeled off

Example 4

After curing the ultraviolet curable pressure-sensitive composition 1 according to Example 3, samples were created by cutting into 150 mm in width and 150 mm in length, the surfaces of the samples were attached to each other, which were surface-treated with the ultraviolet curable pressure-sensitive composition 1, passed through the heating and pressing device 1, then subjected to pressure bonding under the same pressure-bonding condition as in Example 3, and subjected to a peeling load test and a peeling fixation test. However, the roll surface temperature of the heating and pressing device 1 was set to 200° C. in the case of the two sheets stacked.

Example 4A

After curing the ultraviolet curable pressure-sensitive composition 1 according to Example 3A, samples were created by cutting into 150 mm in width and 150 mm in length, the surfaces of the samples were attached to each other, which were surface-treated with the ultraviolet curable pressure-sensitive composition 1, passed through the heating and pressing device 1, then subjected to pressure bonding under the same pressure-bonding condition as in Example 3A, and subjected to a peeling load test and a peeling fixation test. However, the roll surface temperature of the heating and pressing device 1 was set to 198° C. in the case of the two sheets stacked.

Example 5

After curing the ultraviolet curable pressure-sensitive composition 1 according to Example 3, samples were created by cutting into 150 mm in width and 150 mm in length, the surfaces of the samples were attached to each other, which were surface-treated with the ultraviolet curable pressure-sensitive composition 1, subjected to pressure bonding under the same pressure-bonding condition as in Example 3, then passed through the heating and pressing device 1 (roll surface temperature: 200° C.), and subjected to a peeling load test and a peeling fixation test.

Example 5A

After curing the ultraviolet curable pressure-sensitive composition 1 according to Example 3A, samples were created by cutting into 150 mm in width and 150 mm in length, the surfaces of the samples were attached to each other, which were surface-treated with the ultraviolet curable pressure-sensitive composition 1, subjected to pressure bonding under the same pressure-bonding condition as in Example 3A, then passed through the heating and pressing device 1A (roll surface temperature: 198° C.), and subjected to a peeling load test and a peeling fixation test.

Example 6

Without passing through the heating and pressing device 1 in Example 3, the surface of a desk super calender from YURI ROLL CO., LTD. was heated with a heater to set the temperature so that the viscosity of toner particles immediately after super calendering fell within the range of $10^3$ Pa·s or more $10^6$ Pa·s or less. In this experiment, the temperature was 170° C.

Example 6A

Without passing through the heating and pressing device 1A in Example 3A, the surface of a desk super calender from YURI ROLL CO., LTD. was heated with a heater to set the temperature so that the viscosity of toner particles immediately after super calendering fell within the range of $10^3$ Pa·s or more $10^6$ Pa·s or less. In this experiment, the temperature was 175° C.

Comparative Example 3

Without passing through the heating and pressing device 1 after the curing in Example 3, the cutting and pressure bonding were carried out to carry out a peeling load test and a peeling fixation test.

Table 1 shows the results of Examples 1 to 6 and 1A to 6A as well as Comparative Examples 1 to 3.

TABLE 1

| | Adhesion | Peeling load (g) | Peeling fixation |
|---|---|---|---|
| Example 1 | Very good | — | — |
| Example 1A | Very good | — | — |
| Example 2 | Very good | — | — |
| Example 2A | Very good | — | — |
| Example 3 | — | 195 | Good |
| Example 3A | — | 195 | Good |
| Example 4 | — | 182 | Good |
| Example 4A | — | 182 | Good |
| Example 5 | — | 188 | Good |
| Example 5A | — | 188 | Good |
| Example 6 | — | 201 | Good |
| Example 6A | — | 201 | Good |
| Cpmparative Example 1 | Not good | — | — |
| Cpmparative Example 2 | Bad | — | — |
| Cpmparative Example 3 | — | 330 | Bad |

In the case of the ultraviolet curable pressure-sensitive compositions subjected to pressure bonding to each other without any toner image according to Example 3 and Example 3A, the peeling load was 180 g to 190 g, and the peeling fixation was regarded as "good".

In addition, according to Example 3, the fixation can be also prevented from being decreased by permeation of the ultraviolet curable pressure-sensitive composition, and toner peeling can be prevented in the case of peeling.

According to Example 4 and Example 4A, because of passing through the heating and pressing device after the fold, the worked surfaces of the ultraviolet curable pressure-sensitive composition were not brought into direct contact with the heating and pressing device, and can be thus prevented from being damaged and contaminated. In addition, although the worked surfaces of the ultraviolet curable pressure-sensitive composition may make the conveyance difficult due to the tackiness in conventional cases, the recording medium surfaces can be used for the conveyance, so that simplification is possible.

According to Example 5 and Example 5A, the conveyance is possible in any direction because of the conveyance after the pressure bonding.

In Example 6 and Example 6A, there was a case in which the sample adhered to the heating and pressing roll side because of heating with the high welding pressure in the heating and pressing device, and thus, the addition of claws (separation claws) for the passage as shown in FIG. 7 succeeded in preventing the adhesion as a result.

Embodiment 3

<Method of Weight Average Molecular Weight Measurement>

THF solutions were prepared so that the solid content was 10 mg/ml for each sample, and each measured with an injection amount of 100 ul.

Measurement Condition

GPC Measurement System: SHODEX SYSTEM 11 from Showa Denko K.K.

Column: Four of SHODEX KF-800P, KF-805, KF-803, and KF-801 Series Moving Bed

THF Flow Rate: 1 ml/min

Column Temperature: 45° C.

Detector: RI

Conversion: polystyrene

In addition, in regard to examples, the isoparaffin in mass % and the average molecular weight for the waxes according to the following examples were measured by a FD (Field Desorption) method with the use of JMS-T100GC "AccuTOF GC".

<Resin Solution A>

In a 500 ml reaction container provided with an agitator, a nitrogen gas introduction port, a thermometer, and a reflux capacitor, 100 parts in total of monomer (10 parts of 2-ethylhexyl acrylate, 30 parts of 2-hydroxyl actylate, 50 parts of butyl methacrylate, and 10 parts of acrylic acid), 100 parts of isopropyl alcohol as a polymerization solvent, and 1 part of azobisisobutylnitrile as a polymerization initiator were added, and polymerized for 6 hours at 82° C. under reflux with isopropyl alcohol in a stream of nitrogen gas to obtain a resin solution containing 50 weight % of a transparent and viscid resin component ((meth)acrylic copolymer for use in embodiments of the present invention).

This resin obtained was 50,000 in weight average molecular weight. In addition, the glass transition temperature was −0.1° C.

<Intermediate Precursor A>

An intermediate product A was obtained by agitating and mixing 40 parts of LIPOXY SP-1509 (epoxy acrylate oligomer from Showa HighPolymer Co., Ltd.), 40 parts of tetraethylene glycol diacrylate, 20 parts of ARONIX M-400 (dipentaerythritol hexaacrylate from TOAGOSEI CO., LTD.), 5 parts of 2-hydroxy-2-methyl-1-phenyl-propane-1-on (from BASF), and 0.1 parts of methoquinone.

<Intermediate Precursor B>

An intermediate precursor B was obtained by agitating and mixing 10 parts of KAYARAD UX-2031 (urethane acrylate oligomer from Nippon Kayaku Co., Ltd.), 40 parts of ARONIX M-309 (trimethylolpropane triacrylate from TOAGOSEI CO., LTD.), 50 parts of tetraethylene glycol diacrylate, 5 parts of 2-hydroxy-2-methyl-1-phenyl-propane-1-on (from BASF), and 0.1 parts of methoquinone.

<Ultraviolet Curable Precursor 11>

With respect to 105.1 parts of the intermediate product A, 60 parts of the resin solution A was blended to obtain an ultraviolet curable precursor 11 in a transparent solution state.

<Ultraviolet Curable Precursor 12>

With respect to 105.1 parts of the intermediate product B, 60 parts of the resin solution A was blended to obtain an ultraviolet curable precursor 12 in a transparent solution state.

Example 11

<Preparation of Toner 11 and Developer 11>

| -Formulation- | |
|---|---|
| Polyester Resin | 89.5 parts by mass (weight average molecular weight (MW): 68,500, glass transition temperature (Tg): 65.9° C.) |

-continued

| -Formulation- | |
|---|---|
| Microcrystalline Wax<br>Isoparaffin: 15 mass %<br>Average Molecular Weight: 650 | 5 parts by mass |
| Carbon Black (from Mitsubishi Chemical Corporation, #44) | 5 parts by mass |
| Charge Controlling Agent (Spiron Black TR-H from Hodogaya Chemical Co., Ltd.) | 1 part by mass |

The formulation mentioned above was mixed, kneaded at 120° C. with the use of a biaxial extruder (BCTA type from Buhler), then subjected to grinding and classification with an airflow grinding mill (a jet mill from NISSHIN ENGINEERING INC.) for 8.0 μm in volume average particle size, and then mixed with 2.2 mass % of silica (R-972: Nippon Aerosil Co., Ltd.) with the use of a Henschel mixer (FM type, from Mitsui Miike Machinery Co., Ltd.) to obtain a toner 11 for black.

Likewise, as colorants, Pigment Yellow 17, Pigment Red 57, and Pigment Blue 15 were respectively used in place of carbon black to obtain a toner 11 for yellow, a toner 11 for magenta, and a toner 11 for cyan. The obtained toner was 0.90 in toner circularity, and 8.0 μm in volume average particle size.

With the use of, as a carrier, magnetite particles of 50 μm in average particle size, which were coated with a silicone resin (thickness: 0.5 μm), the particles were mixed with the toner for each color at a toner concentration of 5.0 mass % to obtain a developer 11.

—Preparation of Print—

Onto A4-size OK topcoat 110 kg paper sheet as a recording medium, the ISO/IEC 15775:1999 compliant test chart No. 4 was output under the condition of the adhesion amount of 0.4 mg/cm$^2$ in a solid area with imagio MP C7500 from Ricoh Co., Ltd. through the use of the developer 11, thereby providing a print.

—Measurement of Ab/Aa—

Red, green, and blue solid areas of the print were subjected to an IR measurement by an ATR method. The IR measurement was made at a pressure of 2.3 kg with the use of an infrared spectrometer (FT/IR-6100, from JASCO Corporation, Ge 45°). From the measured IR spectra, Aa and Ab were figured out on the following condition to calculate Ab/Aa. Three values were calculated for the red, green, and blue solid areas, and among these values, the highest value was regarded as the Ab/Aa of the print. The result is shown in Table 2 below.

[FT-IR Measurement Condition by ATR method]

Crystal: Ge

Incident Angle: 45°

Reflection: Single Reflection

Aa Baseline, Aa Region: 2896 cm$^{-1}$ to 2943 cm$^{-1}$

Ab Baseline, Ab Region: 2946 cm$^{-1}$ to 2979 cm$^{-1}$

Aa' Baseline, Aa' Region: 791 cm$^{-1}$ to 860 cm$^{-1}$

Ab' Baseline, Ab' Region: 2834 cm$^{-1}$ to 2862 cm$^{-1}$

One side of the print was coated with the ultraviolet curable precursor 11 of 5 g/cm$^2$ to 6 g/cm$^2$ in film thickness with the use of an UV varnish coater (SAC-18E) from HIROSE IRON WORKS CO., LTD, and the precursor was subjected to ultraviolet curing.

Next, the sample was cut into 150 mm in width and 150 mm in length. The surfaces of the two sheets of samples were attached to each other, which were surface-treated with the ultraviolet curable precursor 11, and subjected to pressure bonding by applying a load at a gauge pressure of 100 N/cm$^2$ with a desk super calender from YURI ROLL CO., LTD.

Next, as a heat source, a halogen lamp was provided on the image side of the pair of heating and pressing rolls in the heating and pressing device in FIG. 6. In addition, the surface pressure on the pair of heating and pressing rolls was set to 40 $N/cm^2$, and the roll surface of the heating and pressing device 1 was set to meet 100 mm/sec. The pressure-bonded sample was passed through the heating and pressing device 1 to prepare a detachable information sheet.

The tensile load was measured in the case of peeling the pressure-bonded paper sheet of 150 mm in width, of the detachable information sheet, at 6 cm/sec (hereinafter, referred to as a peeling load test).

Example 12

<Preparation of Toner 12 and Developer 12>

Except that the microcrystalline wax in Example 11 was replaced by a mixed wax of a microcrystalline wax and a paraffin wax (isoparaffin: 9 mass %, average molecular weight: 520), a toner 12 and a developer 12 were obtained in the same way as in Example 11.

The obtained toner was 0.90 in toner circularity, and 7 μm in volume average particle size. Except for the use of the developer, a detachable information sheet was prepared to carry out a peeling load test in the same way as in Example 11.

Example 13

<Preparation of Toner 13 and Developer 13>

Except that the microcrystalline wax in Example 11 was replaced by a mixed wax of a microcrystalline wax and a paraffin wax (isoparaffin: 4 mass %, average molecular weight: 550), a toner 13 and a developer 13 were obtained in the same way as in Example 11.

Except for the use of the developer, and for the use of the ultraviolet curable precursor 12 in place of the ultraviolet curable precursor 11, a detachable information sheet was prepared to carry out a peeling load test in the same way as in Example 11.

Example 14

<Preparation of Toner 14 and Developer 14>

Except that the microcrystalline wax in Example 13 was replaced by a paraffin wax (average molecular weight: 500), a toner 14 and a developer 14 were obtained in the same way as in Example 13.

Except for the use of the developer, a detachable information sheet was prepared to carry out a peeling load test in the same way as in Example 13.

Reference Example 11

Except that the imagio MP C7500 from Ricoh Co., Ltd. in Example 14 was modified to slow the printing speed for the print by 20% and print the print, a detachable information sheet was prepared to carry out a peeling load test in the same way as in Example 14.

Reference Example 12

Except that the imagio MP C7500 from Ricoh Co., Ltd. in Example 12 was modified to slow the printing speed for the print by 25% and print the print with the adhesion amount of 0.5 $mg/cm^2$ in the solid areas, a detachable information sheet was prepared to carry out a peeling load test in the same way as in Example 12.

Reference Example 13

<Preparation of Toner 15 and Developer 15>

Except that the 5 parts by weight of microcrystalline wax in Example 11 was replaced by 1.8 parts by weight of a paraffin wax (average molecular weight: 500), a toner 15 and a developer 15 were obtained in the same way as in Example 11.

Except for the use of the developer, a detachable information sheet was prepared to carry out a peeling load test in the same way as in Example 11.

Example 15

<Preparation of Toner 16 and Developer 16>

Except that the microcrystalline wax in Example 11 was replaced by a mixed wax of a microcrystalline wax and a paraffin wax (isoparaffin: 11 mass %, average molecular weight: 480), a toner 16 and a developer 16 were obtained in the same way as in Example 11.

The obtained toner was 0.91 in toner circularity, and 7.8 μm in volume average particle size.

Except for the use of the developer, a detachable information sheet was prepared to carry out a peeling load test in the same way as in Example 11.

Example 19

<Production of Toner 17 and Developer 17>

<<Production of Toner 17>>

—Preparation of Dissolution or Dispersion of Toner Material—

—Synthesis of Unmodified Polyester (Low-Molecular-Weight Polyester)—

In a reaction tank with a cooling tube, an agitator, and a nitrogen introduction tube, 67 parts by mass of bisphenol A—2 mol ethylene oxide adduct, 84 parts by mass of bisphenol A—3 mol propione oxide adduct, 274 parts by mass of terephthalic acid, and 2 parts by mass of dibutyltin oxide were put, and reacted for 8 hours at 230° C. under ordinary pressure.

Then, the obtained reaction liquid was reacted for 6 hours under a reduced pressure of 10 mmHg to 15 mmHg to synthesize an unmodified polyester.

The unmodified polyester obtained was 2,200 in number average molecular weight (Mn), 5,700 in weight average molecular weight (Mw), and 56° C. in glass transition temperature (Tg).

—Preparation of Masterbatch (MB)—

With the use of a Henschel mixer (from Mitsui Mining Co., Ltd.), 1000 parts by mass of water, 540 parts by mass of carbon black (Printex 35, from Degussa, DBP oil absorption=42 ml/100 g, pH=9.5), and 1200 parts by mass of the unmodified polyester were mixed.

The obtained mixture was kneaded at 150° C. for 30 minutes with a two-roll mill, then subjected to rolling cooling, and subjected to grinding with a pulverizer (from Hosokawa Micron Corporation) to prepare a masterbatch.

—Synthesis of Prepolymer—

In a reaction tank with a cooling tube, an agitator, and a nitrogen introduction tube, 682 parts by mass of bisphenol A—2 mol ethylene oxide adduct, 81 parts by mass of bisphenol A—2 mol propylene oxide adduct, 283 parts by mass of terephthalic acid, 22 parts by mass of trimellitic anhydride, and 2 parts by mass of dibutyltin oxide were put, and reacted for 8 hours at 230° C. under ordinary pressure.

Then, the liquid was reacted for 5 hours under a reduced pressure of 10 mmHg to 15 mmHg to synthesize an intermediate polyester.

The intermediate polyester obtained was 2,100 in number average molecular weight (Mn), 9,600 in weight average molecular weight (Mw), 55° C. in glass transition temperature (Tg), 0.5 in acid value, and 49 in hydroxyl value.

Next, in a reaction container with a cooling tube, an agitator, and a nitrogen introduction tube, 411 parts by mass of the intermediate polyester, 89 parts by mass of isophorone diisocyanate, and 500 parts by mass of ethyl acetate were put, and reacted for 5 hours at 100° C. to synthesize a prepolymer (a modified polyester capable of reacting with the compound containing an active hydrogen group).

The free isocyanate content of the obtained prepolymer was 1.60 mass %, and the solid content concentration (after leaving at 150° C. for 45 minutes) of the prepolymer was 50 mass %.

—Synthesis of Ketimine (Compound Containing Active Hydrogen Group)—

In a reaction container set with an agitation bar and a thermometer, 30 parts by mass of isophoronediamine and 70 parts by mass of methyl ethyl ketone were put, and reacted for 5 hours at 50° C. to synthesize a ketimine compound (the compound containing an active hydrogen group).

The obtained ketimine compound (the compound containing an active hydrogen group) was 423 in amine value.

—Synthesis of Styrene-Acrylic Copolymer Resin—

In a reaction tank with a cooling tube, an agitator, and a nitrogen introduction tube, with 300 parts by mass of ethyl acetate put therein, 300 parts by mass of styrene-acrylic monomer mixture (styrene/acrylic acid 2-ethylhexyl/acrylic acid/acrylic acid 2-hydroxyethyl=75/15/5/5) and 10 parts by mass of azobisisobutylnitrile were put, and reacted for 15 hours at 60° C. under a nitrogen atmosphere at ordinary pressure.

Then, the styrene acrylic copolymer resin was synthesized by adding 200 parts by mass of methanol to the reaction liquid, removing the supernatant after agitation for 1 hour, and drying under reduced pressure.

—Preparation of Dissolution or Dispersion of Toner Material—

In a beaker, 10 parts by mass of the prepolymer, 60 parts by mass of the unmodified polyester, 130 parts by mass of ethyl acetate, and 30 parts by mass of the styrene-acrylic copolymer were put, and agitated and dissolved.

Then, 10 parts by mass of microcrystalline wax (15 mass % of isoparaffin, average molecular weight=650) and 10 parts by mass of the masterbatch were put to prepare a raw material dissolution by 3 passes under the conditions of liquid feeding rate: 1 kg/hr; disc peripheral speed: 6 m/s; and filling with 80 volume % of 0.5 mm zirconia beads, with the use of a beads mill ("Ultra Visco Mill" from Imex Co., Ltd.), and 2.7 parts by mass of the ketimine was added thereto, and dissolved therein to prepare a dissolution or dispersion of the toner material.

—Preparation of Aqueous Medium Phase—

An aqueous medium phase was prepared by mixing and agitating 306 parts by mass of ion-exchange water, 265 parts by mass of a suspension of 10 mass % tricalcium phosphate, and 0.2 parts by mass of sodium dodecylbenzene sulfonate for uniform dissolution.

—Preparation of Emulsified Liquid or Dispersion—

In a container, 150 parts by mass of the aqueous medium phase was put, agitated at a revolution speed of 12,000 rpm with the use of a TK-type homomixer (from Tokushukika Kogyo Co., Ltd.), and with the addition of 100 parts by mass of the dissolution or dispersion of the toner material thereto, mixed for 10 minutes to prepare an emulsified liquid or a dispersion (emulsified slurry).

—Removal of Organic Solvent—

In a flask set with an agitator and a thermometer, 100 parts by mass of the emulsified slurry was put, and subjected to solvent removal for 12 hours at 30° C. while agitating at an agitation peripheral speed of 20 m/min, thereby providing a dispersion slurry.

—Cleaning and Drying—

After applying filtration under reduced pressure to 100 parts by mass of the dispersion slurry, the filter cake was, with the addition of 100 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

The obtained filter cake was, with the addition of 20 parts by mass of 10 mass % sodium hydroxide aqueous solution thereto, mixed with a TK-type homomixer (for 30 minutes at a revolution speed of 12,000 rpm), and then subjected to filtration under reduced pressure.

The operation was carried out three times, in which the obtained filter cake was, with the addition of 300 parts by mass of ion-exchange water thereto, mixed with a TK-type homomixer (for 10 minutes at a revolution speed of 12,000 rpm), and then subjected to filtration.

Moreover, the obtained filter cake was, with the addition of 20 parts by mass of 10 mass % hydrochloric acid thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration, thereby providing a final filter cake.

The obtained final filter cake was dried for 48 hours at 45° C. in an air circulation dryer, and passed through a sieve of 75 μm mesh to obtain toner matrix particles.

—Treatment of External Addition—

Furthermore, 100 parts by weight of the toner matrix particles were mixed with 0.6 parts by weight of hydrophobic silica of 100 nm in average particle size, 1.0 parts by weight of titanium oxide of 20 nm in average particle size, and 0.8 parts by weight of hydrophobic silica fine powder of 15 nm in average particle size in a Henschel mixer to obtain a toner 7 for black.

The obtained toner was 0.940 in the average circularity, and 5.7 μm in volume average particle size.

Likewise, as colorants, Pigment Yellow 17, Pigment Red 57, and Pigment Blue 15 were respectively used in place of carbon black to obtain a toner 7 for yellow, a toner 7 for magenta, and a toner 7 for cyan.

<<Production of Developer 17>>

—Production of Carrier—

A solution for forming a coating film of an acrylic resin including alumina particles and a silicone resin was obtained by dispersing, for 10 minutes with a homomixer, 21.0 parts by mass of an acrylic resin solution (a toluene solution of a copolymer with cyclohexyl methacrylate/methyl methacrylate=80/20 (mass ratio), synthesized from a monomer from Mitsubishi Rayon Co., Ltd., solid content: 50 mass %), 6.4 parts by mass of a Guanamine solution (SUPER BECKA- MINE TD-126, from DIC, solid content: 70 mass %), 7.6 parts by mass of alumina particles (SUMICORUNDUM AA-03, from Sumitomo Chemical Co., Ltd., 0.3 μm, specific resistance value: 1014 (Ω·cm), molecular weight Mw 55000), 65.0 parts by mass of a silicone resin solution (SR2410, from Dow Corning Toray Silicone Co., Ltd., solid content: 23 mass %), 1.0 parts by mass of aminosilane (SH6020, Dow Corning Toray Silicone Co., Ltd., solid content: 100 mass %), 60 parts by mass of toluene, and 60 parts by mass of butylcellosolve.

With the use of a fired ferrite powder [(MgO)1.8(MnO) 49.5(Fe2O3)48.0: Average Particle Size; 35 μm] as a core material, the solution for forming a coating film was applied with a spiro coater (from OKADA SEIKO CO., LTD.) to the surface of the core material so as to reach a film thickness of 0.15 μm, and dried, and the product was then subjected to firing by leaving the product for 1 hour at 150° C. in an electric furnace. After cooling, the product was sorted with the use of a sieve of 106 μm mesh to obtain a carrier of 35 μm in weight average particle size.

—Production of Developer—

A Turbula mixer of an agitation type by tumbling a container was used for homogeneous mixing and charging 7 parts by mass of the toner with respect to 100 parts by weight of the carrier, thereby providing a developer 17.

<Evaluation>

Except that the developer in Example 11 was replaced by the developer 17 obtained above, a detachable information sheet was prepared to carry out a peeling load test in the same way as in Example 11.

Example 20

Except that the imagio MP C7500 from Ricoh Co., Ltd. in Example 19 was modified to slow the printing speed for the print by 20% and print the print, a detachable information sheet was prepared to carry out a peeling load test in the same way as in Example 19.

TABLE 2

| | Ab/Aa in solid area | Bondability | Peeling load (g) | Detach-ability | Comments |
|---|---|---|---|---|---|
| Example 11 | 3.8 | Very good | 185 | Good | |
| Example 12 | 5.5 | Very good | 183 | Good | |
| Example 13 | 6.6 | Very good | 184 | Good | |
| Example 14 | 6.9 | Good | 187 | Good | |
| Reference Example 11 | 7.2 | Not good | 192 | Not good | |
| Reference Example 12 | 7.7 | Bad | 225 | Not good | |
| Reference Example 13 | 2.8 | Very good | 180 | Good | Image heavily disturbed |
| Example 15 | 3.3 | Good | 186 | Good | |
| Example 19 | 4.6 | Very good | 184 | Good | |
| Example 20 | 5.9 | Good | 190 | Good | |

When, in Example 13, ultraviolet curable pressure-sensitive compositions are pressure bonded to each other without a toner image, the peeling load shows a value from 180 g to 190 g.

Example 22

<Preparation of Toner 22 and Developer 22>

Except that the microcrystalline wax in Example 11 was replaced by a mixed wax of a microcrystalline wax and a paraffin wax (isoparaffin: 9 mass %, average molecular weight: 520), a toner 22 and a developer 22 were obtained in the same way as in Example 11.

The obtained toner was 0.91 in toner circularity, and 7 μm in volume average particle size.

Except for the use of the developer, a detachable information sheet was prepared to carry out a peeling load test in the same way as in Example 11.

Example 23

<Preparation of Toner 23 and Developer 23>

Except that the microcrystalline wax in Example 22 was replaced by a mixed wax of a microcrystalline wax and a paraffin wax (isoparaffin: 4 mass %, average molecular weight: 550), a toner 23 and a developer 23 were obtained in the same way as in Example 22.

Except for the use of the developer, a detachable information sheet was prepared to carry out a peeling load test in the same way as in Example 11.

Example 24

<Preparation of Toner 24 and Developer 24>

Except that the microcrystalline wax in Example 22 was replaced by a paraffin wax (average molecular weight: 500), a toner 24 and a developer 24 were obtained in the same way as in Example 22.

Except for the use of the developer, a detachable information sheet was prepared to carry out a peeling load test in the same way as in Example 11.

Reference Example 21

Except that the imagio MP C7500 from Ricoh Co., Ltd. in Example 24 was modified to slow the printing speed for the print by 20% and print the print, a detachable information sheet was prepared to carry out a peeling load test in the same way as in Example 24.

Reference Example 22

Except that the imagio MP C7500 from Ricoh Co., Ltd. in Example 22 was modified to slow the printing speed for the print by 25% and print the print with the adhesion amount of 0.5 mg/cm$^2$ in the solid areas, a detachable information sheet was prepared to carry out a peeling load test in the same way as in Example 24.

Reference Example 23

<Preparation of Toner 25 and Developer 25>

Except that the 5 parts by weight of microcrystalline wax in Example 11 was replaced by 1.8 parts by weight of a paraffin wax (average molecular weight: 500), a toner 25 and a developer 25 were obtained in the same way as in Example 11.

Except for the use of the developer, a detachable information sheet was prepared to carry out a peeling load test in the same way as in Example 11.

Example 25

<Preparation of Toner 26 and Developer 26>

Except that the microcrystalline wax in Example 11 was replaced by a mixed wax of a microcrystalline wax and a paraffin wax (isoparaffin: 11 mass %, average molecular weight: 480), a toner 26 and a developer 26 were obtained in the same way as in Example 11.

The obtained toner was 0.91 in toner circularity, and 7.8 μm in volume average particle size.

Except for the use of the developer, a detachable information sheet was prepared to carry out a peeling load test in the same way as in Example 11.

Example 29

<Evaluation>

Except that the developer in Example 11 was replaced by the developer 17, a detachable information sheet was prepared to carry out a peeling load test in the same way as in Example 11.

Example 30

Except that the imagio MPC7500 from Ricoh Co., Ltd. in Example 29 was modified to slow the printing speed for the print by 20% and print the print, a detachable information sheet was prepared to carry out a peeling load test in the same way as in Example 29.

TABLE 3

| | Ab'/Aa in solid area | Bondability | Peeling load (g) | Detach-ability | Comments |
|---|---|---|---|---|---|
| Example 22 | 0.0091 | Very good | 186 | Good | |
| Example 23 | 0.0115 | Very good | 182 | Good | |
| Example 24 | 0.0135 | Very good | 185 | Good | |
| Reference Example 21 | 0.0144 | Not good | 195 | Not good | |
| Reference Example 22 | 0.0159 | Bad | 220 | Not good | |
| Reference Example 23 | 0.0036 | Very good | 187 | Good | Image heavily disturbed |
| Example 25 | 0.0042 | Good | 184 | Good | |
| Example 29 | 0.0075 | Very good | 186 | Good | |
| Example 30 | 0.0097 | Good | 190 | Good | |

When, in Example 23, ultraviolet curable pressure-sensitive compositions are pressure bonded to each other without a toner image, the peeling load shows a value from 180 g to 190 g.

Embodiment 4

<Method of Weight Average Molecular Weight>

THF solutions were prepared so that the solid content was 10 mg/ml for each sample, and each measured with an injection amount of 100 ul.

Measurement Condition

GPC Measurement System: SHODEX SYSTEM 11 from Showa Denko K.K.

Column: Four of SHODEX KF-800P, KF-805, KF-803, and KF-801 Series Moving Bed

THF Flow Rate: 1 ml/min

Column Temperature: 45° C.

Detector: RI

Conversion: polystyrene

In addition, in regard to examples, the isoparaffin in mass % and the average molecular weight for the waxes according to the following examples were measured by a FD (Field Desorption) method with the use of JMS-T100GC "AccuTOFGC".

<Resin Solution 3A>

In a 500 ml reaction container provided with an agitator, a nitrogen gas introduction port, a thermometer, and a reflux capacitor, 100 parts in total of monomer (10 parts of 2-ethylhexyl acrylate, 30 parts of 2-hydroxyl actylate, 50 parts of butyl methacrylate, and 10 parts of acrylic acid), 100 parts of isopropyl alcohol as a polymerization solvent, and 1 part of azobisisobutylnitrile as a polymerization initiator were added, and polymerized for 6 hours at 82° C. under reflux with isopropyl alcohol in a stream of nitrogen gas to obtain a resin solution 3A containing 50 weight % of a transparent and viscid resin component ((meth)acrylic copolymer for use in embodiments of the present invention).

This resin obtained was 50,000 in weight average molecular weight. In addition, the glass transition temperature was −0.1° C.

<Resin Solution 3B>

In a 500 ml reaction container provided with an agitator, a nitrogen gas introduction port, a thermometer, and a reflux capacitor, 100 parts in total of monomer (50 parts of butyl methacrylate, 40 parts of 2-ethylhexyl methacrylate, and 10 parts of acrylic acid), 100 parts of isopropyl alcohol as a polymerization solvent, and 1 part of azobisisobutylnitrile as a polymerization initiator were added, and polymerized for 6 hours at 82° C. under reflux with isopropyl alcohol in a stream of nitrogen gas to obtain a resin solution 3B containing 50 weight % of a transparent and viscid resin component ((meth) acrylic copolymer for use in embodiments of the present invention).

This resin obtained was 45,000 in weight average molecular weight. In addition, the glass transition temperature was −5.5° C.

<Intermediate Precursor 3A>

An intermediate product 3A was obtained by agitating and mixing 39 parts of LIPOXY SP-1509 (epoxy acrylate oligomer from Showa HighPolymer Co., Ltd.), 41 parts of tetraethylene glycol diacrylate, 20 parts of ARONIX M-400 (dipentaerythritol hexaacrylate from TOAGOSEI CO., LTD.), 5 parts of 2-hydroxy-2-methyl-1-phenyl-propane-1-on (from BASF), and 0.1 parts of methoquinone.

<Intermediate Precursor 3B>

An intermediate precursor 3B was obtained by agitating and mixing 10 parts of KAYARADUX-2031 (urethane acrylate oligomer from Nippon Kayaku Co., Ltd.), 38 parts of ARONIX M-309 (trimethylolpropane triacrylate from TOAGOSEI CO., LTD.), 52 parts of tetraethylene glycol diacrylate, 5 parts of 2-hydroxy-2-methyl-1-phenyl-propane-1-on (from BASF), and 0.1 parts of methoquinone.

<Intermediate Precursor 3C>

An intermediate product 3C was obtained by agitating and mixing 20 parts of LIPOXY SP-1509 (epoxy acrylate oligomer from Showa HighPolymer Co., Ltd.), 20 parts of tetrahydrofurfuryl acrylate, 40 parts of tetraethylene glycol diacrylate, 20 parts of ARONIX M-400 (dipentaerythritol hexaacrylate from TOAGOSEI CO., LTD.), 5 parts of 2-hydroxy-2-methyl-1-phenyl-propane-1-on (from BASF), and 0.1 parts of methoquinone.

<Intermediate Precursor 3D>

An intermediate product 3D was obtained by agitating and mixing 20 parts of LIPOXY SP-1509 (epoxy acrylate oligomer from Showa HighPolymer Co., Ltd.), 20 parts of ethylcarbitol acrylate, 40 parts of tetraethylene glycol diacrylate, 20 parts of ARONIX M-400 (dipentaerythritol hexaacrylate from TOAGOSEI CO., LTD.), 5 parts of 2-hydroxy-2-methyl-1-phenyl-1-propane-1-on (from BASF), and 0.1 parts of methoquinone.

<Intermediate Precursor 3E>

An intermediate product 3E was obtained by agitating and mixing 25 parts of LIPOXY SP-1509 (epoxy acrylate oligomer from Showa HighPolymer Co., Ltd.), 15 parts of isostearyl acrylate, 40 parts of ARONIX M-309 (trimethylolpropane acrylate from TOAGOSEI CO., LTD.), 20 parts of ARONIX M-400 (dipentaerythritol hexaacrylate from TOAGOSEI CO., LTD.), 5 parts of 2-hydroxy-2-methyl-1-phenylpropane-1-on (from BASF), and 0.1 parts of methoquinone.

<Energy-Ray Curable Precursor 31>

With respect to 105.1 parts of the intermediate product 3A, 60 parts of the resin solution 3A was blended to obtain an energy-ray curable precursor 31 in a transparent solution state.

<Energy-Ray Curable Precursor 32>

With respect to 105.1 parts of the intermediate product 3B, 60 parts of the resin solution 3A was blended to obtain an energy-ray curable precursor 32 in a transparent solution state.

<Energy-Ray Curable Precursor 33>

With respect to 105.1 parts of the intermediate product 3A, 60 parts of the resin solution 3B was blended to obtain an energy-ray curable precursor 33 in a transparent solution state.

<Energy-Ray Curable Precursor 34>

With respect to 105.1 parts of the intermediate product 3B, 60 parts of the resin solution 3B was blended to obtain an energy-ray curable precursor 34 in a transparent solution state.

<Energy-Ray Curable Precursor 35>

With respect to 105.1 parts of the intermediate product 3C, 60 parts of the resin solution 3A was blended to obtain an energy-ray curable precursor 35 in a transparent solution state.

<Energy-Ray Curable Precursor 36>

With respect to 105.1 parts of the intermediate product 3D, 60 parts of the resin solution 3B was blended to obtain an energy-ray curable precursor 36 in a transparent solution state.

<Energy-Ray Curable Precursor 37>

With respect to 105.1 parts of the intermediate product 3E, 60 parts of the resin solution 3B was blended to obtain an energy-ray curable precursor 37 in a transparent solution state.

—Developer—

(Toner 1)

Specific preparation examples of the toner are described. The toner for use in the present invention is not to be considered limited to these examples.

| | |
|---|---|
| Polyester Resin | 89 parts by mass (weight average molecular weight: 68200, glass transition temperature (Tg): 65.5° C.) |
| Petroleum-derived Wax | 5 parts by mass |
| Carbon Black (from Mitsubishi Chemical Corporation: #44) | 5 parts by mass |
| Charge Controlling Agent (Spiron Black TR-H: Hodogaya Chemical Co., Ltd.) | 1 part by mass |

The formulation mentioned above was kneaded at 120° C. with the use of a biaxial extruder, then subjected to grinding and classification with an airflow grinding mill to a mass average particle size of 11.0 μm, and then mixed with 2.2 mass % of silica (R-972: Nippon Aerosil Co., Ltd.) with the use of a Henschel mixer to obtain a mixed toner.

The obtained toner was 0.90 in toner circularity, and 8 μm in volume average particle size.

With the use of, as a carrier, magnetite particles of 50 μm in average particle size, which were coated with a silicone resin (film thickness: 0.5 μm), the particles were mixed with the toner for a toner 1 concentration of 5.0 mass % to obtain a developer 41.

—Heating and Pressing Device—

(Heating and Pressing Device 1)

As a heat source, a halogen lamp was provided on the image side of the pair of heating and pressing rolls in the heating and pressing device in FIG. 6. In addition, the surface pressure on the pair of heating and pressing rolls was set to 40 N/cm$^2$, and the roll surface of the heating and pressing device 1 was set to meet 100 mm/sec. The temperature of the heating and pressing roll surface was adjusted so that the viscosity of toner particles just after the outlets of the rolls fell within the range of $10^3$ Pa·s or more and $10^6$ Pa·s or less, thereby achieving the heating and pressing device 1. In this experiment, the temperature was 160° C.

Example 31

The developer 31 was loaded on MFP imagio Neo 750 from Ricoh Co., Ltd. to print a black solid image on A4-size OK topcoat 110 kg paper sheet.

The black solid image was cut out in a size of 5 cm$^2$, immersed in 100 g of the energy-ray curable precursor 31, and left for 24 hours in a dark place at 40° C. The energy-ray curable precursor 1 in which the image was immersed was subjected to filtration through filter paper Type 5A specified in JIS P3801 [Filter Paper (for Chemical Analysis)], one side of OK topcoat 110 kg paper sheet was coated with the ultraviolet curable pressure-sensitive composition 31 of 5 g/cm$^2$ to 6 g/cm$^2$ in film thickness with the use of an UV varnish coater (SAC-18E) from HIROSE IRON WORKS CO., LTD, and the composition was subjected to curing.

Next, samples were created by cutting into 150 mm in width and 150 mm in length. The surfaces of the two sheets of samples were attached to each other, which were surface-treated with the ultraviolet curable pressure-sensitive composition 31, and subjected to pressure bonding by applying a load at a gauge pressure of 100 N/cm$^2$ with a desk super calender from YURI ROLL CO., LTD., and the sheets were then passed through the heating and pressing device 1.

After 24 hours, the tensile load was measured in the case of peeling the pressure-bonded paper sheet of 150 mm in width at 6 cm/sec (hereinafter, referred to as a peeling load test). In addition, the print side after the peeling was observed and evaluated to measure the ratio of the tensile load after storage to before storage.

The ultraviolet curable pressure-sensitive composition 31 in which the black solid image was immersed was also subjected to the same test and the same measurement.

Onto A4-size OK topcoat 110 kg paper sheet as a recording medium, the ISO/IEC 15775:1999 compliant test chart No. 4 was output under the condition of the adhesion amount of 0.4 mg/cm$^2$ in a solid area with imagio MP C7500 from Ricoh Co., Ltd. through the use of the developer 31, thereby providing a print.

One side of the print was coated with the ultraviolet curable pressure-sensitive composition 1 of 5 g/cm$^2$ to 6 g/cm$^2$ in film thickness with the use of an UV varnish coater (SAC-18E) from HIROSE IRON WORKS CO., LTD, and the composition was subjected to curing.

Next, samples were created by cutting into 150 mm in width and 150 mm in length. The surfaces of the two sheets of samples were attached to each other, which were surface-treated with the ultraviolet curable pressure-sensitive composition 31, and subjected to pressure bonding by applying a load at a gauge pressure of 100 N/cm$^2$ with a desk super calender from YURI ROLL CO., LTD., and the sheets were then passed through the heating and pressing device 1.

The bondability and detachability were evaluated after leaving the sheets at room temperature for 12 hours.

Example 32

Except for the use of the energy-ray curable precursor 32 in place of the energy-ray curable precursor 31 in Example 31, the ratio of the tensile load after storage to before storage, bondability, and detachability were evaluated in the same way as in Example 31.

Example 33

Except for the use of the energy-ray curable precursor 33 in place of the energy-ray curable precursor 31 in Example 31, the ratio of the tensile load after storage to before storage, bondability, and detachability were evaluated in the same way as in Example 31.

Example 34

Except for the use of the energy-ray curable precursor 34 in place of the energy-ray curable precursor 31 in Example 31, the ratio of the tensile load after storage to before storage, bondability, and detachability were evaluated in the same way as in Example 31.

Reference Example 31

Except for the use of the energy-ray curable precursor 35 in place of the energy-ray curable precursor 31 in Example 31, the ratio of the tensile load after storage to before storage, bondability, and detachability were evaluated in the same way as in Example 31.

Reference Example 32

Except for the use of the energy-ray curable precursor 36 in place of the energy-ray curable precursor 31 in Example 31, the ratio of the tensile load after storage to before storage, bondability, and detachability were evaluated in the same way as in Example 31.

Example 35

Except that 30 parts of the energy-ray curable precursor 33 and 70 parts of the energy-ray curable precursor 35 were used in place of the energy-ray curable precursor 31 in Example 31, the rate of change in tensile load in the peeling load test, bondability, and detachability were evaluated in the same way as in Example 31.

Example 36

Except that 50 parts of the energy-ray curable precursor 33 and 50 parts of the energy-ray curable precursor 35 were used in place of the energy-ray curable precursor 31 in Example 31, the rate of change in tensile load in the peeling load test, bondability, and detachability were evaluated in the same way as in Example 31.

Embodiment 4

—Developer—

(Toner 32)

Specific preparation examples of the toner are described.

The toner for use in the present invention is not to be considered limited to these examples.

[Preparation of Dissolution or Dispersion of Toner Material]

—Synthesis of Unmodified Polyester (Low-Molecular-Weight Polyester)—

In a reaction tank with a cooling tube, an agitator, and a nitrogen introduction tube, 67 parts by mass of bisphenol A—2 mol ethylene oxide adduct, 84 parts by mass of bisphenol A—3 mol propione oxide adduct, 274 parts by mass of terephthalic acid, and 2 parts by mass of dibutyltin oxide were put, and reacted for 8 hours at 230° C. under ordinary pressure.

Then, the reaction liquid was reacted for 5 hours under a reduced pressure of 10 mmHg to 15 mmHg to synthesize an unmodified polyester.

The unmodified polyester obtained was 2,100 in number average molecular weight (Mn), 5,600 in weight average molecular weight (Mw), and 55° C. in glass transition temperature (Tg).

—Preparation of Masterbatch (MB)—

With the use of a Henschel mixer (from Mitsui Mining Co., Ltd.), 1000 parts by mass of water, 540 parts by mass of carbon black "Printex 35" from Degussa (DBP oil absorption=42 ml/100 g, pH=9.5), and 1200 parts by mass of the unmodified polyester were mixed.

The mixture was kneaded at 150° C. for 30 minutes with a two-roll mill, then subjected to rolling cooling, and subjected to grinding with a pulverizer (from Hosokawa Micron Corporation) to prepare a masterbatch.

—Synthesis of Prepolymer—

In a reaction tank with a cooling tube, an agitator, and a nitrogen introduction tube, 682 parts by mass of bisphenol A—2 mol ethylene oxide adduct, 81 parts by mass of bisphenol A—2 mol propylene oxide adduct, 283 parts by mass of terephthalic acid, 22 parts by mass of trimellitic anhydride, and 2 parts by mass of dibutyltin oxide were put, and reacted for 8 hours at 230° C. under ordinary pressure.

Then, the liquid was reacted for 5 hours under a reduced pressure of 10 mmHg to 15 mmHg to synthesize an intermediate polyester.

The intermediate polyester obtained was 2,100 in number average molecular weight (Mn), 9,600 in weight average molecular weight (Mw), 55° C. in glass transition temperature (Tg), 0.5 in acid value, and 49 in hydroxyl value.

Next, in a reaction container with a cooling tube, an agitator, and a nitrogen introduction tube, 411 parts by mass of the intermediate polyester, 89 parts by mass of isophorone diisocyanate, and 500 parts by mass of ethyl acetate were put, and reacted for 5 hours at 100 C to synthesize a prepolymer (a polymer capable of reacting with the compound containing the active hydrogen group).

The free isocyanate content of the obtained prepolymer was 1.60 mass %, and the solid content concentration (after leaving at 150° C. for 45 minutes) of the prepolymer was 50 mass %.

—Synthesis of Ketimine (Compound Containing Active Hydrogen Group)—

In a reaction container set with an agitation bar and a thermometer, 30 parts by mass of isophoronediamine and 70 parts by mass of methyl ethyl ketone were put, and reacted for 5 hours at 50 C to a ketimine compound (the compound containing an active hydrogen group).

The obtained ketimine compound (the compound containing an active hydrogen group) was 423 in amine value.

—Synthesis of Styrene-Acrylic Copolymer Resin—

In a reaction tank with a cooling tube, an agitator, and a nitrogen introduction tube, with 300 parts by mass of ethyl acetate put therein, 300 parts by mass of styrene-acrylic monomer mixture (styrene/acrylic acid 2-ethylhexyl/acrylic acid/acrylic acid 2-hydroxyethyl=75/15/5/5) and 10 g of azobisisobutylnitrile were put, and reacted for 15 hours at 60° C. under a nitrogen atmosphere at ordinary pressure.

Then, the styrene acrylic copolymer resin was synthesized by adding 200 parts by mass of methanol to the reaction liquid, removing the supernatant after agitation for 1 hour, and drying under reduced pressure.

In a beaker, 10 parts by mass of the prepolymer, 60 parts by mass of the unmodified polyester, 130 parts by mass of ethyl acetate, and 30 parts by mass of the styrene-acrylic copolymer were agitated, and dissolved.

Then, 10 parts by mass of petroleum-derived wax (15 mass % of cycloparaffin, average molecular weight=650) and 10 parts by mass of the masterbatch were put to prepare a raw material dissolution by 3 passes under the conditions of liquid feeding rate: 1 kg/hr; disc peripheral speed: 6 m/s; and filling with 80 volume % of 0.5 mm zirconia beads, with the use of a beads mill ("Ultra Visco Mill" from Imex Co., Ltd.), and 2.7 parts by mass of the ketimine was added thereto, and dissolved therein to prepare a dissolution or dispersion of the toner material.

[Preparation of Aqueous Medium Phase]

An aqueous medium phase was prepared by mixing and agitating 306 parts by mass of ion-exchange water, 265 parts by mass of a suspension of 10 mass % tricalcium phosphate, and 0.2 parts by mass of sodium dodecylbenzene sulfonate for uniform dissolution.

[Preparation of Emulsified Liquid or Dispersion]

In a container, 150 parts by mass of the aqueous medium phase was put, agitated at a revolution speed of 12,000 rpm with the use of a TK-type homomixer (from Tokushukika Kogyo Co., Ltd.), and with the addition of 100 parts by mass of the dissolution or dispersion of the toner material thereto, mixed for 10 minutes to prepare an emulsified liquid or a dispersion (emulsified slurry).

[Removal of Organic Solvent]

In a flask set with an agitator and a thermometer, 100 parts by mass of the emulsified slurry was put, and subjected to solvent removal for 12 hours at 30° C. while agitating at an agitation peripheral speed of 20 m/min.

[Cleaning and Drying]

After applying filtration under reduced pressure to 100 parts by mass of the dispersion slurry, the filter cake was, with the addition of 100 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

The obtained filter cake was, with the addition of 20 parts by mass of 10 mass % sodium hydroxide aqueous solution thereto, mixed with a TK-type homomixer (for 30 minutes at a revolution speed of 12,000 rpm), and then subjected to filtration under reduced pressure.

The obtained filter cake was, with the addition of 300 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

Moreover, the obtained filter cake was, with the addition of 20 parts by mass of 10 mass % hydrochloric acid thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration, thereby providing a final filter cake.

The obtained final filter cake was dried for 48 hours at 45° C. in an air circulation dryer, and passed through a sieve of 75 μm mesh to obtain toner matrix particles.

[Treatment of External Addition]

Furthermore, 100 parts by weight of the toner matrix particles were mixed with 0.6 parts by weight of hydrophobic silica of 100 nm in average particle size, 1.0 parts by weight of titanium oxide of 20 nm in average particle size, and 0.8 parts by weight of hydrophobic silica fine powder of 15 nm in average particle size in a Henschel mixer to obtain a toner.

The toner was 5.7 μm in weight average particle size, and 0.940 in the average circularity.

<Carrier>

Specific preparation examples of the carrier used for the evaluation are described.

The carrier for use in the present invention is not to be considered limited to these examples.

—Preparation of Carrier—

Acrylic Resin Solution (Solid Content: 50 wt %) 21.0 parts

Guanamine Solution (Solid Content: 70 wt %) 6.4 parts

Alumina Particle [0.3 μm, Specific Resistance: 1014 (Ω·cm)] 7.6 parts

Silicone Resin Solution 65.0 parts [Solid Content: 23 wt % (SR2410: from Dow Corning Toray Silicone Co., Ltd.)]

Aminosilane 1.0 part [Solid Content: 100 wt % (SH6020: from Dow Corning Toray Silicone Co., Ltd.)]

Toluene 60 parts

Butylcellosolve 60 parts

The raw materials mentioned above were dispersed for 10 minutes with a homomixer to obtain a solution for forming a coating film of a blend of an acrylic resin including alumina particles and a silicone resin.

With the use of a fired ferrite powder [(MgO)1.8(MnO)49.5(Fe2O3)48.0: Average Particle Size; 35 μm] as a core material, the solution for forming a coating film was applied with a spiro coater (from OKADA SEIKO CO., LTD.) to the surface of the core material so as to reach a film thickness of 0.15 μm, and dried.

The obtained carrier was subjected to firing by leaving for 1 hour at 150° C. in an electric furnace.

After cooling, the ferrite powder bulk was sorted with the use of a sieve of 106 μm mesh to obtain a carrier of 35 μm in weight average particle size.

A Turbula mixer of an agitation type by tumbling a container was used for homogeneous mixing and charging 7 parts by weight of the toner 32 with respect to 100 parts by weight of the carrier, thereby preparing a developer.

—Ultraviolet Curable Composition—

The ultraviolet curable composition 31 was directly used.

—Heating and Pressing Device—

The heating and pressing device 1 was directly used.

Example 37

The developer 32 was loaded on Color MFP RICOH Pro C751 from Ricoh Co., Ltd. to print a black solid image on A4-size OK topcoat 110 kg paper sheet.

The rate of change in tensile load in the peeling load test was measured in the same way as in Example 31.

The developer 32 was loaded on Color MFP RICOH Pro C751 from Ricoh Co., Ltd. to print a full-color image of 20% in image area ratio on A4-size OK topcoat 110 kg paper sheet.

One side of the print was coated with the ultraviolet curable composition 1 of 5 g/cm$^2$ in film thickness with the use of an UV varnish coater (SAC-18E) from HIROSE IRON WORKS CO., LTD. The ultraviolet curable composition 1 was cured by the coater.

Next, the print surface-treated with the ultraviolet curable composition 31 was passed through the heating and pressing device 1, then left for 10 hours in a constant-temperature bath at 40° C., and then evaluated for bondability and detachability.

Example 38

Except for the use of the energy-ray curable precursor 34 in place of the energy-ray curable precursor 31 in Example 37, the ratio of the tensile load after storage to before storage, bondability, and detachability were evaluated in the same way as in Example 37.

Example 39

Except for that the amount of the petroleum-derived wax used in the toner production was 1.7 times as large as in Example 38 to prepare a toner, and that the energy-ray curable precursor 37 was used in place of the energy-ray curable precursor 1, the ratio of the tensile load after storage to before storage, bondability, and detachability were evaluated in the same way as in Example 38.

Reference Example 33

Except for that the amount of the petroleum-derived wax used in the toner production was 3.6 times as large as in Example 38 to prepare a toner, and that the energy-ray curable precursor 37 was used in place of the energy-ray curable precursor 31, the ratio of the tensile load after storage to before storage, bondability, and detachability were evaluated in the same way as in Example 38.

The results are shown in Table 4 below.

TABLE 4

| | Ratio of tensile load after storage to before storage | Bondability | Detach-ability | Condition of peeled surface |
|---|---|---|---|---|
| Example 31 | 111 | Good | Very good | Very smooth |
| Example 32 | 130 | Good | Good | Smooth |
| Example 33 | 127 | Good | Very good | Very smooth |
| Example 34 | 113 | Good | Very good | Very smooth |
| Reference Example 31 | 139 | Good | Bad | Partially peeled image |
| Reference Example 32 | 159 | Good | Bad | Peeled image |
| Example 35 | 104 | Good | Very good | Very smooth |
| Example 36 | 109 | Good | Very good | Very smooth |
| Example 37 | 106 | Good | Very good | Very smooth |
| Example 38 | 80 | Good | Very good | Smooth |
| Reference Example 33 | 73 | Bad | Very good | Uneven image reflectivity |

Embodiment 5

In the following examples and comparative examples, the weight average molecular weight of the resin, the glass transition temperature of the resin, the isoparaffin content in the wax, and the weight average molecular weight of the wax were analyzed by using the methods described below.

<<Weight Average Molecular Weight>>

The weight average molecular weight of the resin was measured by gel permeation chromatography (GPC). In a heat chamber at 40° C., a column was stabilized. The measurement was made by flowing tetrahydrofurane (THF) as a solvent at a flow rate of 1 mL per minute into, and injecting 50 μL to 200 μL of a THF sample solution of a resin adjusted to 0.05 mass % to 0.6 mass % as a sample concentration into the column stabilized at this temperature.

For measuring the molecular weight of the sample, the molecular weight distribution of the sample was calculated from the relationship between the logarithmic value and number of counts on a calibration curve created with several types of monodisperse polystyrene standard samples. As the polystyrene standard samples for the creation of the calibration curve, it is appropriate to use samples of 6×102, 2.1×103, 4×103, 1.75×104, 5.1×104, 1.1×105, 3.9×105, 8.6×105, 2×106, and 4.48×106 in molecular weight from Pressure Chemical Co. or TOSOH CORPORATION, and use standard polystyrene samples for on the order of at least 10 points. Further, an RI (refractive index) detector was used for the detector.

<<Glass Transition Temperature>>

The glass transition temperature of the resin was measured from a DSC curve obtained by differential scanning calorimetry (DSC). The DSC curve was measured under the following conditions with the use of TA-60WS and DSC-60 (from Shimadzu Corporation).

[Measurement Condition]

Sample Container: aluminum sample pan (with a lid)
Sample Amount: 5 mg
Reference: aluminum sample pan (alumina 10 mg)
Atmosphere: Nitrogen (Flow Rate: 50 mL/min)
Temperature Condition
Start Temperature: 20° C.
Rate of Temperature Increase: 10° C./min
End Temperature: 150° C.
Holding Time: No
Rate of Temperature Decrease: 10° C./min
End Temperature: 20° C.
Holding Time: No
Rate of Temperature Increase: 10° C./min
End Temperature: 150° C.

The measurement results were analyzed with the use of software for data analysis TA-60, Version 1.52 (from Shimadzu Corporation).

In the analysis of the measurement results, the range of ±5° C. was specified around the maximum peak of the DrDSC curve as a differential curve for the second temperature increase, and the peak analysis function of the software for data analysis was used to figure out the peak temperature. Next, in the range between +5° C. and −5° C. around the peak temperature of the DSC curve, the peak analysis function of the software for data analysis was used to figure out the maximum endotherm temperature of the DSC curve. This temperature corresponds to the melting point.

In regard to the endothermic peak as a main peak in the temperature range of 40° C. to 100° C., which was obtained in the process of the temperature increase, the point at the intersection of the differential calorimetry curve with a line through the midpoint of the baseline between before and after the endothermic peak was regarded as the glass transition temperature (Tg).

<<Isoparaffin Content in Wax and Weight Average Molecular Weight of Wax>>

The isoparaffin content (mass %) in the wax and the weight average molecular weight of the wax were measured by a FD (Field Desorption) method with the use of JMS-T100GC "AccuTOFGC" (from JEOL Ltd.) as a gas chromatograph TOF-type mass spectrometer.

<Resin Solution 4A>

In a 500 ml reaction container provided with an agitator, a nitrogen gas introduction port, a thermometer, and a reflux capacitor, 100 parts in total of monomer (10 parts of 2-ethylhexyl acrylate, 30 parts of 2-hydroxyl actylate, 50 parts of butyl methacrylate, and 10 parts of acrylic acid), 100 parts of isopropyl alcohol as a polymerization solvent, and 1 part of azobisisobutylnitrile as a polymerization initiator were added, and polymerized for 6 hours at 82° C. under reflux with isopropyl alcohol in a stream of nitrogen gas to obtain a resin solution 4A containing 50 weight % of a transparent and viscid resin component ((meth)acrylic copolymer for use in embodiments of the present invention).

This resin obtained was 50,000 in weight average molecular weight. In addition, the glass transition temperature was −0.1° C.

<Intermediate Precursor 4A>

An intermediate product 4A was obtained by agitating and mixing 40 parts of LIPOXY SP-1509 (epoxy acrylate oligomer from Showa HighPolymer Co., Ltd.), 40 parts of tetraethylene glycol diacrylate, 20 parts of ARONIX M-400 (dipentaerythritol hexaacrylate from TOAGOSEI CO., LTD.), 5 parts of 2-hydroxy-2-methyl-1-phenyl-propane-1-on (from BASF), and 0.1 parts of methoquinone.

<Intermediate Precursor 4B>

An intermediate precursor 4B was obtained by agitating and mixing 10 parts of KAYARADUX-2031 (urethane acrylate oligomer from Nippon Kayaku Co., Ltd.), 40 parts of ARONIX M-309 (trimethylolpropane triacrylate from TOAGOSEI CO., LTD.), 50 parts of tetraethylene glycol diacrylate, 5 parts of 2-hydroxy-2-methyl-1-phenyl-propane-1-on (from BASF), and 0.1 parts of methoquinone.

<Energy-Ray Curable Precursor 41>

With respect to 105.1 parts of the intermediate product 4A, 60 parts of the resin solution 4A was blended to obtain an energy-ray curable precursor 41 in a transparent solution state.

<Energy-Ray Curable Precursor 42>

With respect to 105.1 parts of the intermediate product 4B, 60 parts of the resin solution 4A was blended to obtain an energy-ray curable precursor 42 in a transparent solution state.

Example 41

<Preparation of Toner 41>

[Formulation]

- Polyester Resin (weight average molecular weight Mw: 68,500, glass transition temperature Tg: 65.9° C.)—89.5 parts by mass
- Microcrystalline Wax (isoparaffin content: 15 mass %, weight average molecular weight Mw: 645)—5 parts by mass
- Carbon Black (from Mitsubishi Chemical Corporation, #44)—5 parts by mass
- Charge Controlling Agent (Spiron Black TR-H from Hodogaya Chemical Co., Ltd.)—1 part by mass The formulation mentioned above was mixed, kneaded at 120° C. with the use of a biaxial extruder (BCTA type from Buhler), then subjected to grinding and classification with an airflow grinding mill (a jet mill from NISSHIN ENGINEERING INC.) for 11.0 μm in weight average particle size, and then mixed with 2.2 mass % of silica (R-972: Nippon Aerosil Co., Ltd.) with the use of a Henschel mixer (FM type, from Mitsui Miike Machinery Co., Ltd.) to obtain a black toner 41.

Except for the use of C.I. Pigment Yellow 17 in place of the carbon black in the production of the black toner 41, a yellow toner 41 was prepared in the same way as in the production of the black toner 41.

Except for the use of C.I. Pigment Red 57 in place of the carbon black in the production of the black toner 41, a magenta toner 41 was prepared in the same way as in the production of the black toner 41.

Except for the use of C.I. Pigment Blue 15 in place of the carbon black in the production of the black toner 41, a cyan toner 41 was prepared in the same way as in the production of the black toner 41.

For the toners 41 obtained for each color of black, yellow, magenta, and cyan, the average circularity and the volume average particle size Dv were respectively 0.90 and 8.0 μm, which were measured in the following way.

<Preparation of Developer 41>

With the use of a carrier obtained by coating magnetite particles of 50 μm in volume average particle size with a silicone resin so as to reach an average thickness of 0.5 μm, the carrier was mixed with the toners 41 for each color so that the toner concentrations were 5.0 mass %, thereby preparing developers 41 for each color of black, yellow, magenta, and cyan.

<Preparation of Print>

Onto A4-size OK topcoat 110 kg paper sheet as a recording medium, the ISO/IEC 15775:1999 compliant test chart No. 4 was output under the condition of the adhesion amount of 0.4 mg/cm$^2$ in a solid area with imagio MP C7500 from Ricoh Co., Ltd. through the use of the developer 41, thereby providing a print.

<Measurement of Wax Coverage>

With the use of ISO/IEC 15775:1999 compliant test chart No. 4, a fixed solid image in red, green, and blue, which was formed from at least two types of toners, was cut out, and chemically modified with ruthenium tetroxide by expose to a saturated vapor of a 5 mass % ruthenium tetroxide aqueous solution (from TABB) for 5 minutes.

Then, from the image surface of the chemically modified print, a reflection image SEM image was obtained at an accelerating voltage of 0.8 kV and a 1.000-fold magnification with the use of a transmission electron microscope/scanning electron microscope (from GarlZeiss, ULTRA55).

The pixels constituting the obtained reflection electron SEM image were subjected to image processing for dividing the pixels into a black area and a white area (binarization) with Photoshop (from Adobe), thereby providing a binarized image. The area ratio of the black area (wax coverage) was measured in the entire area of the binarized image. The result is shown in Table 5. It is to be noted the maximum value is shown among the wax coverages figured out from the fixed solid images for each color of red, green, and blue.

One side of the print was coated with the ultraviolet curable precursor 1 of 5 g/cm$^2$ to 6 g/cm$^2$ in film thickness with the use of an UV varnish coater (SAC-18E) from HIROSE IRON WORKS CO., LTD, and the precursor was subjected to ultraviolet curing.

Next, the sample was cut into 150 mm in width and 150 mm in length. The surfaces of the two sheets of samples were attached to each other, which were surface-treated with the ultraviolet curable precursor 1, and subjected to pressure bonding by applying a load at a gauge pressure of 100 N/cm$^2$ with a desk super calender from YURI ROLL CO., LTD.

Next, as a heat source, a halogen lamp was provided on the image side of the pair of heating and pressing rolls in the heating and pressing device in the figure. In addition, the surface pressure on the pair of heating and pressing rolls was set to 40 N/cm$^2$, and the roll surface of the heating and pressing device 1 was set to meet 100 mm/sec. The pressure-bonded sample was passed through the heating and pressing device 1 to prepare a detachable information sheet.

The tensile load was measured in the case of peeling the pressure-bonded paper sheet of 150 mm in width, of the detachable information sheet, at 6 cm/sec (hereinafter, referred to as a peeling load test).

Example 42

<Preparation of Toner 42>

Except that the microcrystalline wax in Example 41 was replaced by a mixed wax of a microcrystalline wax and a paraffin wax (isoparaffin content: 9 mass %, weight average molecular weight Mw: 520), toners 42 for each color of black, yellow, magenta, and cyan were prepared in the same way as in Example 41.

For the obtained toners 42 for each color, the average circularity and the volume average particle size Dv were respectively 0.91 and 6.8 μm, which were measured in the same way as in Example 1.

<Preparation of Developer 42>

With the use of a carrier obtained by coating magnetite particles of 50 μm in volume average particle size with a silicone resin so as to reach an average thickness of 0.5 μm, the carrier was mixed with the toners 42 for each color so that the toner concentrations were 5.0 mass %, thereby preparing developers 42 for each color.

Except for the use of this developer, a detachable information sheet was prepared to measure the peeling strength in the same way as in Example 41.

Example 43

<Preparation of Toner 43>

Except that the microcrystalline wax in Example 41 was replaced by a mixed wax of a microcrystalline wax and a paraffin wax (isoparaffin content: 4.1 mass %, weight average molecular weight Mw: 550), toners 43 for each color of black, yellow, magenta, and cyan were prepared in the same way as in Example 41.

For the obtained toners 43 for each color, the average circularity and the volume average particle size Dv were respectively 0.91 and 7.9 μm, which were measured in the same way as in Example 41.

<Preparation of Developer 43>

With the use of a carrier obtained by coating magnetite particles of 50 μm in volume average particle size with a silicone resin so as to reach an average thickness of 0.5 μm, the carrier was mixed with the toners 43 for each color so that the toner concentrations were 5.0 mass %, thereby preparing developers 43 for each color.

Except for the use of this developer, a detachable information sheet was prepared to measure the peeling strength in the same way as in Example 41.

Example 44

<Preparation of Toner 44>

Except that the microcrystalline wax in Example 41 was replaced by a paraffin wax (weight average molecular weight Mw: 500), toners 44 for each color of black, yellow, magenta, and cyan were prepared in the same way as in Example 41.

For the obtained toners 44 for each color, the average circularity and the volume average particle size Dv were respectively 0.89 and 8.0 μm, which were measured in the same way as in Example 41.

<Preparation of Developer 44

With the use of a carrier obtained by coating magnetite particles of 50 μm in volume average particle size with a silicone resin so as to reach an average thickness of 0.5 μm, the carrier was mixed with the toners 44 for each color so that the toner concentrations were 5.0 mass %, thereby preparing developers 44 for each color.

Except for the use of this developer, a detachable information sheet was prepared to measure the peeling strength in the same way as in Example 41.

Reference Example 45

<Preparation of Toner 45>

Except that 5 parts by mass of the microcrystalline wax in Example 41 was replaced by 1.4 parts by mass of a paraffin wax (weight average molecular weight Mw: 500), toners 45 for each color of black, yellow, magenta, and cyan were prepared in the same way as in Example 41.

For the obtained toners 45 for each color, the average circularity and the volume average particle size Dv were respectively 0.90 and 7.8 μm, which were measured in the same way as in Example 41.

<Preparation of Developer 45>

With the use of a carrier obtained by coating magnetite particles of 50 μm in volume average particle size with a silicone resin so as to reach an average thickness of 0.5 μm, the carrier was mixed with the toners 45 for each color so that the toner concentrations were 5.0 mass %, thereby preparing developers 45 for each color.

<Evaluation>

Except that the developer 41 and the energy-ray curable precursor 41 in Example 41 were replaced by the developer 45 and the energy-ray curable precursor 42, a detachable information sheet was prepared to measure the peeling strength in the same way as in Example 41.

Example 46

<Preparation of Toner 46>

Except that the microcrystalline wax in Example 41 was replaced by a mixed wax of a microcrystalline wax and a paraffin wax (isoparaffin content: 11.3 mass %, weight average molecular weight Mw: 480), toners 46 for each color of black, yellow, magenta, and cyan were prepared in the same way as in Example 41.

For the obtained toners 46 for each color, the average circularity and the volume average particle size Dv were respectively 0.91 and 7.8 μm, which were measured in the same way as in Example 41.

<Preparation of Developer 46>

With the use of a carrier obtained by coating magnetite particles of 50 μm in volume average particle size with a silicone resin so as to reach an average thickness of 0.5 μm, the carrier was mixed with the toners 46 for each color so that the toner concentrations were 5.0 mass %, thereby preparing developers 46 for each color.

<Preparation of Intermediate Precursor 4C>

An intermediate precursor 4C was prepared by mixing 10 parts by mass of an urethane acrylate oligomer (EBECRYL 5129, from DAICEL-CYTEC Company, Ltd., weight average molecular weight Mw: 800), 41 parts by mass of 1,6-hexanediol diacrylate as a polymerizable unsaturated compound, 10 parts by mass of cyclohexyl acrylate as a polymerizable unsaturated compound, 80 parts by mass of ethylcarbitol acrylate as a polymerizable unsaturated compound, 2.5 parts by mass of ethoxydiethylene glycol acrylate as a polymerizable unsaturated compound, 0.3 parts by mass of hydroquinone monomethyl ether as a polymerization inhibitor, and 6 parts by mass of benzyl(1,2-diphenylethanedione) as a photopolymerization initiator, and agitating the mixture for 20 minutes at 60° C.

Except for the use of the developer 46 in place of the developer 41 and the intermediate precursor 4C in place of the intermediate precursor 4A, a detachable information sheet was prepared to measure the peeling strength in the same way as in Example 41.

Example 47

<Preparation of Intermediate Precursor 4D>

An intermediate precursor 4D was prepared by mixing 60 parts by mass of a polyester acrylate oligomer (EBECRYL 1830, from DAICEL-CYTEC Company, Ltd., weight average molecular weight Mw: 1,500), 30 parts by mass of bisphenol A—ethylene oxide adduct diacrylate (V#700, from Osaka Organic Chemical Industry Ltd.) as a polymerizable unsaturated compound, 5 parts by mass of 2-ethylhexyl acrylate as a polymerizable unsaturated compound, 20 parts by mass of 1,6-hexanediol acrylate as a polymerizable unsaturated compound, 2.5 parts by mass of ethoxydiethylene glycol acrylate as a polymerizable unsaturated compound, 0.4 parts by mass of 2,6-ditert-butyl-p-cresol (BHT) as a polymerization inhibitor, and 9 parts by mass of IRGACURE 184 (from Ciba Specialty Chemicals Corporation) as a photopolymerization initiator, and agitating the mixture for 20 minutes at 60° C.

Except for the use of the intermediate precursor 4D in place of the intermediate precursor 4A, a detachable information sheet was prepared to measure the peeling strength in the same way as in Example 41.

Example 48

<Preparation of Intermediate Precursor 4E>

In a beaker, 9 parts by mass of pentaerythritol tetraacrylate as a polymerizable unsaturated compound, 2.5 parts by mass of ethoxydiethylene glycol acrylate as a polymerizable unsaturated compound, 30 parts by mass of trimethylolpropane triacrylate as a polymerizable unsaturated compound, and 0.3 parts by mass of hydroquinone as a polymerization initiator were put, and heated up to 120° C. while agitation, and 50 parts by mass of a diallyl phthalate prepolymer (DAISO TAP 100, from DAISO INDUSTRIES CO., LTD.) was further dissolved therein. Furthermore, 2 parts by mass of aluminum isopropylate dispersed in 2 parts by mass of toluene was gradually added thereto, and agitated at 110° C. for 20 minutes. During this period, the toluene added as a solvent was removed to the outside of the system to obtain a photo-curable varnish-based agent.

Next, an intermediate precursor 4E was obtained by mixing 70 parts by mass of the photo-curable varnish-based agent, 60 parts by mass of 1,6-hexanediol diacrylate as a polymerizable unsaturated compound, 10 parts by mass of benzophenone as a photopolymerization initiator, 5 parts by mass of p-dimethylaminoacetophenone, 10 parts by mass of phenyl glycol monoacrylate as a viscosity modifier, and 4.5 parts by mass of polyoxyethylene glycol alkylether as a surfactant, and sufficiently kneading the mixture with a three-roll mill.

Except for the use of the intermediate precursor 4E in place of the intermediate precursor 4A, a detachable information sheet was prepared to measure the peeling strength in the same way as in Example 41.

Example 49

<Preparation of Intermediate Precursor 4F>

An intermediate precursor 4F was prepared by mixing 60 parts by mass of a polyester acrylate oligomer (EBECRYL 1830, from DAICEL-CYTEC Company, Ltd., weight average molecular weight Mw: 1,500), 30 parts by mass of bisphenol A—ethylene oxide adduct diacrylate (V#700, from Osaka Organic Chemical Industry Ltd.) as a polymerizable unsaturated compound, 3 parts by mass of 2-ethylhexyl acrylate as a polymerizable unsaturated compound, 20 parts by mass of 1,6-hexanediol acrylate as a polymerizable unsaturated compound, 2.5 parts by mass of ethoxydiethylene glycol acrylate as a polymerizable unsaturated compound, 0.4 parts by mass of 2,6-ditert-butyl-p-cresol (BHT) as a polymerization inhibitor, 9 parts by mass of IRGACURE 184 (from Ciba Specialty Chemicals Corporation) as a photopolymerization initiator, and 2 parts by mass of sodium dialkylsulfosuccinate as an anionic surfactant, and agitating the mixture for 20 minutes at 60° C.

Except for the use of the intermediate precursor 4F in place of the intermediate precursor 4A, a detachable information sheet was prepared to measure the peeling strength in the same way as in Example 41.

Example 50

<Production of Toner 47>

—Synthesis of Unmodified Polyester (Low-Molecular-Weight Polyester)—

In a reaction tank with a cooling tube, an agitator, and a nitrogen introduction tube, 67 parts by mass of bisphenol A—2 mol ethylene oxide adduct, 84 parts by mass of bisphenol A—3 mol propylene oxide adduct, 274 parts by mass of terephthalic acid, and 2 parts by mass of dibutyltin oxide were put, and reacted for 8 hours at 230° C. under ordinary pressure.

Then, the obtained reaction liquid was reacted for 6 hours under a reduced pressure of 10 mmHg to 15 mmHg to synthesize an unmodified polyester.

The unmodified polyester obtained was 2,200 in number average molecular weight (Mn), 5,700 in weight average molecular weight Mw, and 56° C. in glass transition temperature Tg.

—Preparation of Masterbatch (MB)—

With the use of a Henschel mixer (from Mitsui Mining Co., Ltd.), 1000 parts by mass of water, 540 parts by mass of carbon black (Printex 35, from Degussa, DBP oil absorption=42 ml/100 g, pH=9.5), and 1200 parts by mass of the unmodified polyester were mixed.

The obtained mixture was kneaded at 150° C. for 30 minutes with a two-roll mill, then subjected to rolling cooling, and subjected to grinding with a pulverizer (from Hosokawa Micron Corporation) to prepare a masterbatch.

—Synthesis of Prepolymer—

In a reaction tank with a cooling tube, an agitator, and a nitrogen introduction tube, 682 parts by mass of bisphenol A—2 mol ethylene oxide adduct, 81 parts by mass of bisphenol A—2 mol propylene oxide adduct, 283 parts by mass of terephthalic acid, 22 parts by mass of trimellitic anhydride, and 2 parts by mass of dibutyltin oxide were put, and reacted for 8 hours at 230° C. under ordinary pressure.

Then, the liquid was reacted for 5 hours under a reduced pressure of 10 mmHg to 15 mmHg to synthesize an intermediate polyester.

The intermediate polyester obtained was 2,100 in number average molecular weight Mn, 9,600 in weight average molecular weight Mw, 55° C. in glass transition temperature Tg, 0.5 mg KOH/g in acid value, and 49 mg KOH/g in hydroxyl value.

Next, in a reaction container with a cooling tube, an agitator, and a nitrogen introduction tube, 411 parts by mass of the intermediate polyester, 89 parts by mass of isophorone diisocyanate, and 500 parts by mass of ethyl acetate were put, and reacted for 5 hours at 100° C. to synthesize a prepolymer (a modified polyester capable of reacting with the compound containing an active hydrogen group).

The free isocyanate content of the obtained prepolymer was 1.60 mass %, and the solid content concentration (after leaving at 150° C. for 45 minutes) of the prepolymer was 50 mass %.

—Synthesis of Ketimine (Compound Containing Active Hydrogen Group)—

In a reaction container set with an agitation bar and a thermometer, 30 parts by mass of isophoronediamine and 70 parts by mass of methyl ethyl ketone were put, and reacted for 5 hours at 50° C. to a ketimine compound (the compound containing an active hydrogen group).

The obtained ketimine compound (the compound containing an active hydrogen group) was 423 in amine value.

—Synthesis of Styrene—

Acrylic Copolymer Resin-In a reaction tank with a cooling tube, an agitator, and a nitrogen introduction tube, with 300 parts by mass of ethyl acetate put therein, 300 parts by mass of styrene-acrylic monomer mixture (styrene/acrylic acid 2-ethylhexyl/acrylic acid/acrylic acid 2-hydroxyethyl=75/15/5/5) and 10 parts by mass of azobisisobutylnitrile were put, and reacted for 15 hours at 60° C. in a nitrogen atmosphere under ordinary pressure.

Then, the styrene acrylic copolymer resin was synthesized by adding 200 parts by mass of methanol to the reaction liquid, removing the supernatant after agitation for 1 hour, and drying under reduced pressure.

—Preparation of Dissolution or Dispersion of Toner Material—

In a beaker, 10 parts by mass of the prepolymer, 60 parts by mass of the unmodified polyester, 130 parts by mass of ethyl acetate, and 30 parts by mass of the styrene-acrylic copolymer were put, and agitated, and dissolved.

Then, 10 parts by mass of microcrystalline wax (isoparaffin content: 14.5 mass %, weight average molecular weight Mw: 650) and 10 parts by mass of the masterbatch were put to prepare a raw material dissolution by 3 passes under the conditions of liquid feeding rate: 1 kg/hr; disc peripheral speed: 6 m/s; and filling with 80 volume % of 0.5 mm zirconia beads, with the use of a beads mill ("Ultra Visco Mill" from Imex Co., Ltd.), and 2.7 parts by mass of the ketimine was added thereto, and dissolved therein to prepare a dissolution or dispersion of the toner material.

—Preparation of Aqueous Medium Phase—

An aqueous medium phase was prepared by mixing and agitating 306 parts by mass of ion-exchange water, 265 parts by mass of a suspension of 10 mass % tricalcium phosphate, and 0.2 parts by mass of sodium dodecylbenzene sulfonate for uniform dissolution.

—Preparation of Emulsified Liquid or Dispersion—

In a container, 150 parts by mass of the aqueous medium phase was put, agitated at a revolution speed of 12,000 rpm with the use of a TK-type homomixer (from Tokushukika Kogyo Co., Ltd.), and with the addition of 100 parts by mass of the dissolution or dispersion of the toner material thereto, mixed for 10 minutes to prepare an emulsified liquid or a dispersion (emulsified slurry).

—Removal of Organic Solvent—

In a flask set with an agitator and a thermometer, 100 parts by mass of the emulsified slurry was put, and subjected to solvent removal for 12 hours at 30° C. while agitating at an agitation peripheral speed of 20 m/min, thereby providing a dispersion slurry.

—Cleaning and Drying—

After applying filtration under reduced pressure to 100 parts by mass of the dispersion slurry, the filter cake was, with the addition of 100 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

The obtained filter cake was, with the addition of 20 parts by mass of 10 mass % sodium hydroxide aqueous solution thereto, mixed with a TK-type homomixer (for 30 minutes at a revolution speed of 12,000 rpm), and then subjected to filtration under reduced pressure.

The obtained filter cake was, with the addition of 300 parts by mass of ion-exchange water thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration.

Moreover, the obtained filter cake was, with the addition of 20 parts by mass of 10 mass % hydrochloric acid thereto, mixed with a TK-type homomixer (for 10 minutes at a revolution speed of 12,000 rpm), and then subjected to filtration.

The operation was carried out twice, in which the obtained filter cake was, with the addition of 300 parts by mass of ion-exchange water thereto, mixed with a TK-type homomixer (for 10 minutes at a revolution speed of 12,000 rpm), and then subjected to filtration, thereby providing a final filter cake.

The obtained final filter cake was dried for 48 hours at 45° C. in an air circulation dryer, and passed through a sieve of 75 μm mesh to obtain toner matrix particles.

—Treatment of External Addition—

Furthermore, 100 parts by weight of the toner matrix particles were mixed with 0.6 parts by weight of hydrophobic silica of 100 nm in average particle size, 1.0 parts by weight of titanium oxide of 20 nm in average particle size, and 0.8 parts by weight of hydrophobic silica fine powder of 15 nm in average particle size in a Henschel mixer to obtain a black toner 47.

Except for the use of C.I. Pigment Yellow 17 in place of the carbon black in the production of the black toner 47, a yellow toner 47 was prepared in the same way as in the production of the black toner 47.

Except for the use of C.I. Pigment Red 57 in place of the carbon black in the production of the black toner 47, a magenta toner 47 was prepared in the same way as in the production of the black toner 47.

Except for the use of C.I. Pigment Blue 15 in place of the carbon black in the production of the black toner 47, a cyan toner 47 was prepared in the same way as in the production of the black toner 47.

For the toners 47 obtained for each color of black, yellow, magenta, and cyan, the average circularity and the volume average particle size Dv were respectively 0.94 and 5.7 μm, which were measured in the following way.

<Production of Developer 47>

—Production of Carrier—

A solution for forming a coating film of an acrylic resin including alumina particles and a silicone resin was obtained by dispersing, for 10 minutes with a homomixer, 21.0 parts by mass of an acrylic resin solution (a toluene solution of a copolymer with cyclohexyl methacrylate/methyl methacrylate=80/20 (mass ratio), synthesized from a monomer from Mitsubishi Rayon Co., Ltd., solid content: 50 mass %), 6.4 parts by mass of a Guanamine solution (SUPER BECKAMINE TD-126, from DIC, solid content: 70 mass %), 7.6 parts by mass of alumina particles (SUMICORUNDUM AA-03, from Sumitomo Chemical Co., Ltd., average particle size: 0.3 μm, specific resistance value: 1014 (Ω·cm)), 65.0 parts by mass of a silicone resin solution (SR2410, from Dow Corning Toray Silicone Co., Ltd., solid content: 23 mass %), 1.0 parts by mass of aminosilane (SH6020, Dow Corning Toray Silicone Co., Ltd., solid content: 100 mass %), 60 parts by mass of toluene, and 60 parts by mass of butylcellosolve.

With the use of a fired ferrite powder [(MgO)1.8(MnO)49.5(Fe2O3)48.0: Average Particle Size; 35 μm] as a core material, the solution for forming a coating film was applied with a spiro coater (from OKADA SEIKO CO., LTD.) to the surface of the core material so as to reach a film thickness of 0.15 μm, and dried, and the product was then subjected to firing by leaving the product for 1 hour at 150° C. in an electric furnace. After cooling, the product was sorted with the use of a sieve of 106 μm mesh to obtain a carrier of 35 μm in weight average particle size.

A Turbula mixer of an agitation type by tumbling a container was used for homogeneous mixing and charging 7 parts by mass of the toners 47 for each color with respect to 100 parts by weight of the carrier, thereby providing a developers 47 for each color.

Except that the developer 41 in Example 41 was replaced by the developer 47, a detachable information sheet was prepared to measure the peeling strength in the same way as in Example 41.

Example 51

Except that the image forming apparatus (imagio MP C7500 from Ricoh Co., Ltd.) in Example 50 was modified to slow the printing speed by 30% and print the print in the <Preparation of Print> described previously, the print was prepared in the same way as in Example 50, and a detachable information sheet was prepared to measure the peeling strength in the same way as in Example 50.

Example 52

In the same way except that the 80 parts by mass of ethylcarbitol acrylate and 2.5 parts by mass of ethoxydiethylene glycol acrylate in the preparation of the intermediate precursor 4D were adjusted to 25 parts by mass of ethylcarbitol acrylate, 40 parts by mass of ethoxydiethylene glycol acrylate, and 15 parts by mass of trimethylolpropane triacrylate, an intermediate precursor 4G was prepared.

Except that the intermediate precursor 4A in Example 41 was replaced by the intermediate precursor 4G, a detachable information sheet was prepared to measure the peeling strength in the same way as in Example 41.

Example 53

In the same way except that the 80 parts by mass of ethylcarbitol acrylate and 2.5 parts by mass of ethoxydiethylene glycol acrylate in the preparation of the intermediate precursor 4C were adjusted to 50 parts by mass of ethylcarbitol acrylate, 20 parts by mass of ethoxydiethylene glycol acrylate, and 10 parts by mass of trimethylolpropane triacrylate, an intermediate precursor 4H was prepared.

Except that the intermediate precursor 4A in Example 41 was replaced by the intermediate precursor 4H, a detachable information sheet was prepared to measure the peeling strength in the same way as in Example 41.

Reference Example 45

In a beaker, 10 parts by mass of pentaerythritol tetraacrylate, 30 parts by mass of trimethylolpropane triacrylate, and 0.3 parts by mass of hydroquinone as a polymerization initiator were put, and heated up to 120° C. while agitation, and 50 parts by mass of a diallyl phthalate prepolymer (DAISO TAP 100, from DAISO INDUSTRIES CO., LTD.) was further dissolved therein. Furthermore, 2 parts by mass of aluminum isopropylate dispersed in 2 parts by mass of toluene was gradually added thereto, and agitated at 110° C. for 20 minutes. During this period, the toluene added as a solvent was removed to the outside of the system to obtain an intended photo-curable varnish-based agent.

Next, an intermediate precursor 41 was prepared by mixing 75 parts by mass of the photo-curable varnish-based agent, 60 parts by mass of 1,9-nonanediol diacrylate, 10 parts by mass of benzophenone as a photopolymerization initiator, 5 parts by mass of p-dimethylaminoacetophenone, and 10 parts by mass of phenyl glycol monoacrylate as a viscosity modifier, and sufficiently kneading the mixture with a three-roll mill.

Except that, in Example 44, the intermediate precursor 4B was replaced by the intermediate precursor 41, and the image forming apparatus (imagio MP C7500 from Ricoh Co., Ltd.) was modified to slow the printing speed by 21% and print the print in the <Preparation of Print> described previously, a detachable information sheet was prepared to measure the peeling strength in the same way as in Example 44.

Reference Example 46

Except that the image forming apparatus (imagio MP C7500 from Ricoh Co., Ltd.) in Reference Example 45 was modified to slow the printing speed by 25% and print the print with the monochromatic toner adhesion amount of 0.5 mg/cm$^2$ in a solid image area in the <Preparation of Print> described previously, a detachable information sheet was prepared to measure the peeling strength in the same way as in Reference Example 45.

The results are shown in Table 5 below.

TABLE 5

| | Wax Coverage | Bondability | Peeling load (g) | Detachability | Comments |
|---|---|---|---|---|---|
| Example 41 | 44 | Very good | 185 | Good | |
| Example 42 | 50 | Very good | 186 | Good | |

TABLE 5-continued

| | Wax Coverage | Bondability | Peeling load (g) | Detachability | Comments |
|---|---|---|---|---|---|
| Example 43 | 53 | Very good | 184 | Good | |
| Example 44 | 56 | Very good | 183 | Good | |
| Reference Example 41 | 30 | Very good | 181 | Good | Image heavily disturbed |
| Example 46 | 41 | Very good | 187 | Good | |
| Example 47 | 44 | Very good | 182 | Good | |
| Example 48 | 44 | Very good | 186 | Good | |
| Example 49 | 44 | Very good | 183 | Good | |
| Example 50 | 52 | Very good | 180 | Good | |
| Example 51 | 68 | Good | 190 | Good | |
| Example 52 | 44 | Very good | 182 | Good | |
| Example 53 | 44 | Very good | 189 | Good | |
| Reference Example 45 | 71 | Not good | 220 | Not good | |
| Reference Example 46 | 73 | Bad | 235 | Not good | |

Further, without the toner image in Example 41, the peeling load was 180 g to 190 g when the surfaces were attached to each other, which were surface-treated with the energy-ray curable precursor 41.

As described above, the embodiments of the present invention can provide an apparatus for producing a detachable information sheet provided with excellent fixing and adhesion strength.

In addition, although bondability may be likely to be deteriorated depending on content embodiments when the toner contains the wax, the embodiments of the present invention with the ratio Ab/Aa from 3.0 to 7.0 or the ratio Ab'/Aa' from 0.004 to 0.014 can provide an apparatus for producing a detachable information sheet provided with excellent fixation and adhesion strength, as is clear from Examples 11 to 30 and Reference Examples 11 to 23 described above.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An apparatus for producing a detachable information sheet, the apparatus comprising:

an image forming device including an image bearing body, an electrostatic latent image forming unit to form an electrostatic latent image on the image bearing body, a development unit to develop the electrostatic latent image with a toner to form a visible toner image, a transfer unit to transfer the toner image from the image bearing body onto a recording medium, and a fixing unit to fix, on the recording medium, the toner image transferred onto the recording medium;

an applying and curing unit to apply an energy-ray curable composition precursor onto the recording medium having the toner image fixed thereon, and curing the energy-ray curable composition precursor to form an energy-ray curable composition to coat the recording medium; and a heating and pressing unit to heat and press the recording medium coated with the energy-ray curable composition.

2. The apparatus according to claim 1, further comprising:

a folding unit to fold the recording medium in two or three; and a pressure bonding unit to pressure-bond the recording medium folded in two or three by the folding unit, wherein the energy-ray curable composition is an ultraviolet curable pressure-sensitive composition, and the apparatus is arranged to operate the applying and curing unit, the heating and pressing unit, the folding unit, and the pressure bonding unit in any one of the following orders a) to c):

a) the applying and curing unit, the heating and pressing unit, the folding unit, and the pressure bonding unit;

b) the applying and curing unit, the folding unit, the heating and pressing unit, and the pressure bonding unit; and c) the applying and curing unit, the folding unit, the pressure bonding unit, and the heating and pressing unit.

3. The apparatus according to claim 2, wherein the pressure bonding unit pressure bonds the recording medium folded in two or three while applying to the recording medium a temperature equal to or higher than a softening temperature of the toner.

4. The apparatus according to claim 2, wherein, in the order c), the heating and pressing unit applies to the recording medium a temperature equal to or higher than a softening temperature of the toner.

5. The apparatus according to claim 2, wherein the applying and curing unit applies the ultraviolet curable pressure-sensitive composition to an area other than a folded section of the recording medium folded by the folding unit.

6. The apparatus according to claim 1, wherein the toner includes a release agent.

7. The apparatus according to claim 1, wherein the recording medium includes a coat layer of 1 μm or greater in thickness, the coat layer including a white pigment of 0.1 μm or greater in average particle size.

8. The apparatus according to claim 1, wherein the toner has a viscosity of 103 Pa·s or greater and 106 Pa·s or less in heating and pressing in the heating and pressing unit.

9. The apparatus according to claim 1, wherein the toner includes a wax, the fixing unit fixes the toner image on the recording medium in an oilless fixing manner without applying a release agent, and in an area having a largest amount of toner adhesion in the toner image fixed on the recording medium, a ratio Ab/Aa between a peak area Aa from 2896 $cm^{-1}$ to 2943 $cm^{-1}$ and a peak area Ab from 2946 $cm^{-1}$ to 2979 $cm^{-1}$ is 3.0 to 7.0, or a ratio Ab'/Aa' between a peak area Aa' from 791 $cm^{-1}$ to 860 $cm^{-1}$ and a peak area Ab' from 2834 $cm^{-1}$ to 2862 $cm^{-1}$ is 0.004 to 0.014 in a Fourier transform infrared spectroscopy (FT-IR) spectrum measured by an attenuated total reflection (ATR) method under the following conditions:

Crystal: Ge

Incident Angle: 45°

Reflection: Single Reflection

Aa Baseline, Aa Region: 2896 $cm^{-1}$ to 2943 $cm^{-1}$

Ab Baseline, Ab Region: 2946 $cm^{-1}$ to 2979 $cm^{-1}$

Aa' Baseline, Aa' Region: 791 $cm^{-1}$ to 860 $cm^{-1}$

Ab' Baseline, Ab' Region: 2834 $cm^{-1}$ to 2862 $cm^{-1}$.

10. The apparatus according to claim 9, wherein a maximum value among three values of the Ab/Aa is 3.0 to 7.0, or a maximum value among three values of the Ab'/Aa' is 0.004 to 0.014, the three values measured by the ATR method in areas having highest toner densities for red, blue, and green in a sample toner image of ISO/IEC 15775:1999 compliant test chart No. 4 formed by the image forming device.

11. The apparatus according to claim 1, wherein the toner includes a wax, the fixing unit fixes the toner image on the recording medium in an oilless fixing manner without applying a release agent, and an area having a largest amount of toner adhesion in the toner image fixed on the recording medium is exposed to a saturated vapor of a ruthenium tetroxide aqueous solution and irradiated with an electron beam at an accelerating voltage of 0.8 kV, an obtained reflection electron image is converted into a binarized image including a black area and a white area, and an area ratio of the black area to an entire area of the binarized image is 40% to 70%.

12. The apparatus according to claim 11, wherein a toner image is formed such that areas having highest toner densities for red, blue, and green in a sample toner image of ISO/IEC 15775:1999 compliant test chart No. 4 formed by the image forming device are exposed to a saturated vapor of a ruthenium tetroxide aqueous solution and irradiated with an electron beam at an accelerating voltage of 0.8 kV, an obtained reflection electron image is converted into a binarized image comprising a black area and a white area, and an area ratio of the black area to an entire area of the binarized image is 40% to 70%.

13. The apparatus according to claim 1, wherein the toner includes a wax, the fixing unit fixes the toner image on the recording medium in an oilless fixing manner without applying a release agent, and the toner and the energy-ray curable composition precursor to be used have a peeling strength of 80% to 130% that is obtained when the energy-ray curable composition precursor subjected to a treatment is applied onto the recording medium with no toner image thereon, and cured, and cured surfaces of the energy-ray curable composition precursor subjected to the treatment are attached to each other, and subjected to pressure bonding, compared to a peeling strength of the energy-ray curable composition precursor not subjected to the treatment, the treatment including: leaving, for 24 hours in a dark place at 40° C., a solid image of 5 $cm^2$ immersed in 100 g of the energy-ray curable composition precursor; and carrying out filtration.

14. A method of producing a detachable information sheet, the method comprising:

an image forming step including an electrostatic latent image forming step of forming an electrostatic latent image on an image bearing body, a development step of developing the electrostatic latent image with a toner to form a visible toner image, a transfer step of transferring the toner image from the image bearing body onto a recording medium, and a fixing step of fixing, on the recording medium, the toner image transferred onto the recording medium;

an applying and curing step of applying an energy-ray curable composition precursor onto the recording medium having the toner image fixed thereon, and curing the energy-ray curable composition precursor to form an energy-ray curable composition to coat the recording medium; and a heating and pressing step of heating and pressing the recording medium coated with the energy-ray curable composition.

15. The method according to claim 14, further comprising:

a folding step of folding the recording medium in two or three; and a pressure bonding step of pressure-bonding the recording medium folded in two or three in the folding step, wherein the energy-ray curable composition is an ultraviolet curable pressure-sensitive composition, and the applying and curing step, the heating and pressing step, the folding step, and the pressure bonding step are carried out in any one of the following orders a) to c):

a) the applying and curing step, the heating and pressing step, the folding step, and the pressure bonding step;

b) the applying and curing step, the folding step, the heating and pressing step, and the pressure bonding step; and c) the applying and curing step, the folding step, the pressure bonding step, and the heating and pressing step.

16. The method according to claim 15, wherein the pressure bonding step includes pressure-bonding the recording medium folded in two or three while applying to the recording medium a temperature equal to or higher than a softening temperature of the toner.

17. The method according to claim 15, wherein, in the order c), the heating and pressing step includes applying to the recording medium a temperature equal to or higher than a softening temperature of the toner.

18. The method according to claim 15, wherein the applying and curing step includes applying the ultraviolet curable pressure-sensitive composition to an area other than a folded section of the recording medium folded in two or three in the folding step.

19. The method according to claim 14, wherein the toner includes a release agent.

20. A recording medium produced by the method according to claim 14.

* * * * *